US006736332B2

(12) United States Patent
Sesser et al.

(10) Patent No.: US 6,736,332 B2
(45) Date of Patent: May 18, 2004

(54) ADJUSTABLE ARC, ADJUSTABLE FLOW RATE SPRINKLER

(75) Inventors: George L. Sesser, Walla Walla, WA (US); Lee A. Perkins, Lowden, WA (US); Steven T. McCoon, Waitsburg, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 272 days.

(21) Appl. No.: 10/119,294

(22) Filed: Apr. 10, 2002

(65) Prior Publication Data

US 2002/0166900 A1 Nov. 14, 2002

Related U.S. Application Data

(63) Continuation-in-part of application No. 09/818,275, filed on Mar. 28, 2001, now Pat. No. 6,651,905.

(51) Int. Cl.[7] ..... B05B 15/10

(52) U.S. Cl. ..... 239/204; 239/214.13; 239/222.13; 239/232; 239/247; 239/252; 239/257; 239/457; 239/581.2

(58) Field of Search ..... 239/203, 204, 239/205, 206, 214.13, 214.19, 214.23, 222.11, 222.15, 222.17, 231, 232, 233, 243, 244, 245, 246, 247, 249, 251, 252, 253, 256, 257, 451, 456, 457, 458–460, 505, 513, 514, 579, 580, 581.1, 581.2, 582.1

(56) References Cited

U.S. PATENT DOCUMENTS

| | | | | | |
|---|---|---|---|---|---|
| 4,471,908 | A | * | 9/1984 | Hunter | 239/11 |
| 4,892,252 | A | * | 1/1990 | Bruninga | 239/205 |
| 5,288,022 | A | * | 2/1994 | Sesser | 239/205 |
| 5,423,486 | A | * | 6/1995 | Hunter | 239/205 |

* cited by examiner

*Primary Examiner*—Dinh Q. Nguyen
(74) *Attorney, Agent, or Firm*—Nixon & Vanderhye P.C.

(57) ABSTRACT

A sprinkler head includes a base adapted to be secured to a component supplying water under pressure; an arc adjustment ring rotatably mounted on the base; a nozzle and a stream deflector supported by an elongated stem carried by the base, the nozzle and the stream deflector cooperating to define an adjustable nozzle orifice; a water distribution plate secured to a shaft in the stem and located downstream of the nozzle; the stem and the nozzle axially movable relative to the base; and a drive train operatively connected between the arc adjustment ring and the nozzle to rotate the nozzle relative to the stream deflector to thereby adjust the nozzle orifice between a pair of limit positions. The stem is rotatable within the base upon over-rotation of the arc adjustment ring beyond either of the pair of limit positions. The sprinkler head also incorporates a throttle control member secured to an upstream end of the shaft such that rotation of the shaft causes the throttle control member to move axially relative to a flow restriction seat portion, to thereby adjust flow rate through the nozzle, the throttle control member engageable with the seat in a maximum restriction position; and means for permitting rotation of the throttle control member with the shaft upon over-rotation of the shaft.

27 Claims, 46 Drawing Sheets

ADJUSTABLE ARC, ADJUSTABLE FLOW RATE SPRINKLER

This application is a continuation-in-part of application Ser. No. 09/818,275 filed Mar. 28, 2001 now U.S. Pat. No. 6,651,905.

BACKGROUND AND SUMMARY OF THE INVENTION

This invention relates to sprinklers and, specifically, to a sprinkler that incorporates adjustable arc and/or adjustable flow rate features.

It is known to utilize interchangeable arc or other shaped nozzles in sprinklers in order to permit adjustment of the degree of coverage of the discharge stream, while maintaining a constant flow or precipitation rate in the watered areas. Typically, these nozzles comprise orifice plates which have a central hole for receiving a shaft that supports the distributor above the nozzle. The orifice itself is generally radially outwardly spaced from the shaft hole in the orifice plate. Representative examples of this type of construction are found in U.S. Pat. Nos. 4,967,961; 4,932,590; 4,842,201; 4,471,908; and 3,131,867. Other arc adjustment techniques are described in U.S. Pat. Nos. 5,556,036; 5,148,990; 5,031,840; 4,579,285; and 4,154,404.

It is also known to incorporate adjustable flow rate arrangements in sprinklers, within the context of a substantially constant water pressure. For example, see U.S. Pat. Nos. 5,762,270; 4,898,332; and 4,119,275. Such arc adjustment and flow rate adjustment features are often incorporated in pop-up sprinklers. Examples of pop-up sprinklers are found in U.S. Pat. Nos. 5,288,022; 5,058,806; 4,834,289; 4,815,662; and 4,790,481.

There remains a need, however, for a reliable sprinkler that incorporates an arc adjustment and/or a throw radius adjustment feature, and that provides constant precipitation rate and good uniformity, without excess leakage in the nozzle area.

There is also a need to provide a sprinkler head that permits reorientation of a fixed edge of the sprinkling pattern after the sprinkler has been fixed to an otherwise non-rotatable support, such as a riser tube in a pop-up sprinkler system. With one edge fixed, the nozzle can then be manipulated to adjust the movable edge of the pattern defining opening as needed to produce the desired pattern. This feature may also be utilized with a nozzle designed to produce a fixed sprinkler pattern (for example, a rectangular pattern), where it is desirable to locate one edge of the pattern next to a wall, fence or the like.

The present invention relates to a sprinkler designed especially (but not exclusively) for incorporation in pop-up type sprinklers, and that provides within limits, essentially infinite arc adjustment and throw radius adjustment features, while at the same time, providing constant precipitation rates and good uniformity. The invention also provides a sprinkler that minimizes suckback plugging of the nozzle; permits active cleaning of the nozzle, and minimizes potential damage to critical internal components when, for example, impacted during use.

In one exemplary embodiment, the sprinkler head itself includes a nozzle, a rotary water distribution plate (or rotor plate) mounted on a shaft so as to be axially spaced from the nozzle. The rotor plate is formed with a plurality of curved, generally radial grooves that cause the rotor plate to rotate when impinged upon by a hollow, generally cone-shaped stream emitted from the nozzle. The rotor plate may incorporate a viscous damping mechanism to slow its rate of rotation.

In the pop-up embodiment, the nozzle and associated stream deflector are supported within a hollow stem which, in turn, is supported within a cylindrical base. A coil spring is located axially between a flange at the upper end of the stem and an arc adjustment ring at the upper end of the base. This coil spring biases the rotor plate, shaft, nozzle, deflector and stem to a retracted position relative to the base.

The shaft on which the rotor plate is mounted extends downwardly into and through the deflector, and is provided with an externally threaded sleeve fixed to the lower end of the shaft. A throttle member is threadably mounted on the fixed sleeve, so that rotation of the shaft will result in the throttle member moving axially upwardly or downwardly on the shaft, depending on the direction of rotation of the shaft, toward or away from a stop formed near the lower end of the stem. The invention also provides a "slip clutch" mechanism to protect the throttle assembly in the event of over-rotation of the shaft.

The throw radius adjustment mechanism in the exemplary embodiment is implemented by flow rate adjustment, but, preferably, the arrangement is such that the flow cannot be completely shut off. In other words, even in a position where the throttle member is moved to its maximum restrictive position on an associated stop (and thus provide the smallest throw radius), enough water is permitted to flow through the base to the nozzle so that the rotor plate continues to rotate, albeit at a slower speed. This preferred configuration is intended to prevent stalling, a condition where the rotor plate ceases rotation as water pressure drops. The flow rate and hence throw radius adjustment is effected by rotation of the shaft by a suitable tool engageable with an end of the shaft that is externally accessible to the user. Aside from the flow rate adjustment function, the shaft is otherwise rotationally stationary during normal operation, i.e., the rotor plate rotates about the shaft.

The nozzle is rotatably mounted within the base, and cooperates with the stream deflector to define an arcuate water discharge orifice. The nozzle is operatively connected through a drive mechanism to the arc adjustment ring mounted on the top of the base, and externally accessible to the user. Thus, the user may rotate the arc adjustment ring to lengthen or shorten the arcuate length of the discharge orifice. It is presently contemplated that a pair of nozzle/deflector combinations may be employed to provide adjustable arcs between 90° and 210°, and between 210° and 270°. In accordance with another embodiment, the nozzle and deflector are further modified to provide a 360° or full circle pattern, and for this embodiment no arc adjustment is possible. Nevertheless, this latter embodiment may still include the above described flow rate adjustment feature. In the full circle version, the nozzle and stream deflector are modified, but all other components are retained, some to good advantage. The arc adjustment ring, for example, may be rotated to loosen and effect removal of debris lodged in the nozzle, without otherwise altering the arc of coverage.

The arc adjustment feature can be utilized only when the rotor plate is extended relative to the base. In other words, components of the drive mechanism are fully engaged only when the nozzle, deflector and stem move upwardly with the rotor plate to engage complementary drive components on the arc adjustment ring. This arrangement prevents accidental arc adjustment when the sprinkler is not in use, e.g., through contact with a lawn mower, weed trimmer or the like. In addition, the arc adjustment ring is configured to permit re-orientation of the sprinkler pattern after the sprinkler is secured to, for example, a fixed, non-rotatable stem or riser in a pop-up assembly.

The rotor plate may also incorporate a known viscous dampening type "motor" (or "viscous retarder") that slows the rotation of the rotor plate, thereby increasing the throw radius of the stream.

When used in a pop-up type sprinkler, the invention employs a two-stage pop-up mechanism. First, the extendable tube of the pop-up assembly will extend as water under pressure is introduced into the assembly. After the tube extends out of the fixed riser, the rotor plate, nozzle, deflector and stem extend away from the base at the distal end of the extendable tube so that water emitted from the nozzle can be distributed radially by the rotor plate. This two-stage action is reversed when the flow of water is shut off, so that the rotor plate is in a retracted position that prevents any foreign matter from entering into the nozzle area before the extendable tube of the pop-up assembly is retracted.

The arc adjustment ring and the extendable tube are configured such that the application of sufficient torque to the arc adjustment ring in either an opening or closing direction results in the movement of the normally fixed internal edge that determines one end of the pattern arc. When the fixed edge is located as desired, the arc adjustment ring may be rotated in the opposite direction to enlarge or reduce the pattern, by moving the adjustable edge toward or away from the fixed edge until the desired arc is obtained.

Thus, in accordance with one aspect, the present invention relates to a sprinkler head comprising a base adapted to be secured to a component supplying water under pressure; an arc adjustment ring rotatably mounted on the base; a nozzle and a stream deflector supported by an elongated stem carried by the base, the nozzle and the stream deflector cooperating to define an adjustable nozzle orifice; a water distribution plate secured to a shaft in the stem and located downstream of the nozzle; the stem and the nozzle axially movable relative to the base; a drive train operatively connected between the arc adjustment ring and the nozzle to rotate the nozzle relative to the stream deflector to thereby adjust the nozzle orifice between a pair of limit positions; the stem rotatable within the base upon over-rotation of the arc adjustment ring beyond either of the pair of limit positions.

In another aspect, the present invention relates to a sprinkler head comprising a base adapted to be secured to a sprinkler component; a nozzle and a stream deflector supported in a stem mounted in the base for axial extending and retraction relative to the base, the nozzle having a first movable edge and the stream deflector having a second normally fixed edge cooperating to establish an adjustable arcuate discharge orifice defining a sprinkling pattern; a water distribution plate supported on a shaft extending upwardly from the base, and adapted to be impinged by a stream emitted from the nozzle; an arc adjustment ring rotatably mounted on the base, the arc adjustment ring operatively connectable with the nozzle for rotating the nozzle and first movable edge relative to the stream deflector and second normally fixed edge for adjusting an angular extent of the arcuate discharge orifice; and means for adjusting the second normally fixed edge relative to the base and the sprinkler component to reorient the sprinkling pattern, the means implemented via the arc adjustment ring.

In still another aspect, the present invention relates to a sprinkler head comprising a base; an elongated stem supported within the base; a nozzle and a stream deflector supported within the stem, the nozzle and stream deflector cooperating to define an arcuate orifice; a water distribution plate supported on a shaft extending upwardly from the base, the water distribution plate located in axially spaced relationship to the nozzle and adapted to be impinged by a stream emitted from the nozzle; a throttle control member secured to an upstream end of the shaft such that rotation of the shaft causes the throttle control member to move relative to a flow restriction portion, to thereby adjust flow rate through the nozzle and a throw radius of the stream emitted from the nozzle, the throttle control member engageable with a seat in a maximum restriction position; and the throttle control member having flexible tabs extending radially therefrom for interaction with axially extending ribs on an interior surface of the stem to thereby constrain the throttle control member against rotation when the shaft is rotated and to thereby move the throttle control member axially toward or away from said maximum restriction position; the flexible tabs permitting rotation of the throttle control member with the shaft upon over-rotation of the shaft.

In still another aspect, the present invention relates to a sprinkler head comprising a base; an elongated stem supported within the base; a nozzle and a stream deflector supported within the stem, the nozzle having a first moveable edge and deflector having a second normally fixed edge cooperating to define an adjustable arcuate discharge orifice; a water distribution plate supported on a shaft extending upwardly from the stem, the water distribution plate having a plurality of water distribution grooves therein located in axially spaced relationship to the nozzle and adapted to be impinged by a stream emitted from the nozzle; an arc adjustment ring rotatably mounted on the base, the arc adjustment ring operatively connectable with the nozzle for rotating the nozzle and first movable edge relative to the stem and second normally fixed edge for adjustment of the arcuate discharge orifice; means operable through the arc adjustment ring for adjusting the second normally fixed edge to reorient the sprinkling pattern; and a throttle control member secured to an upstream end of the shaft such that rotation of the shaft causes the throttle control member to move axially relative to a flow restriction seat portion, to thereby adjust flow rate through the nozzle, the throttle control member engageable with the seat in a maximum restriction position; and means for permitting rotation of the throttle control member with the shaft upon over-rotation of the shaft.

A detailed description of the invention follows in connection with the attached drawings that are identified below.

DETAILED DESCRIPTION OF THE DRAWINGS

Figure 1:
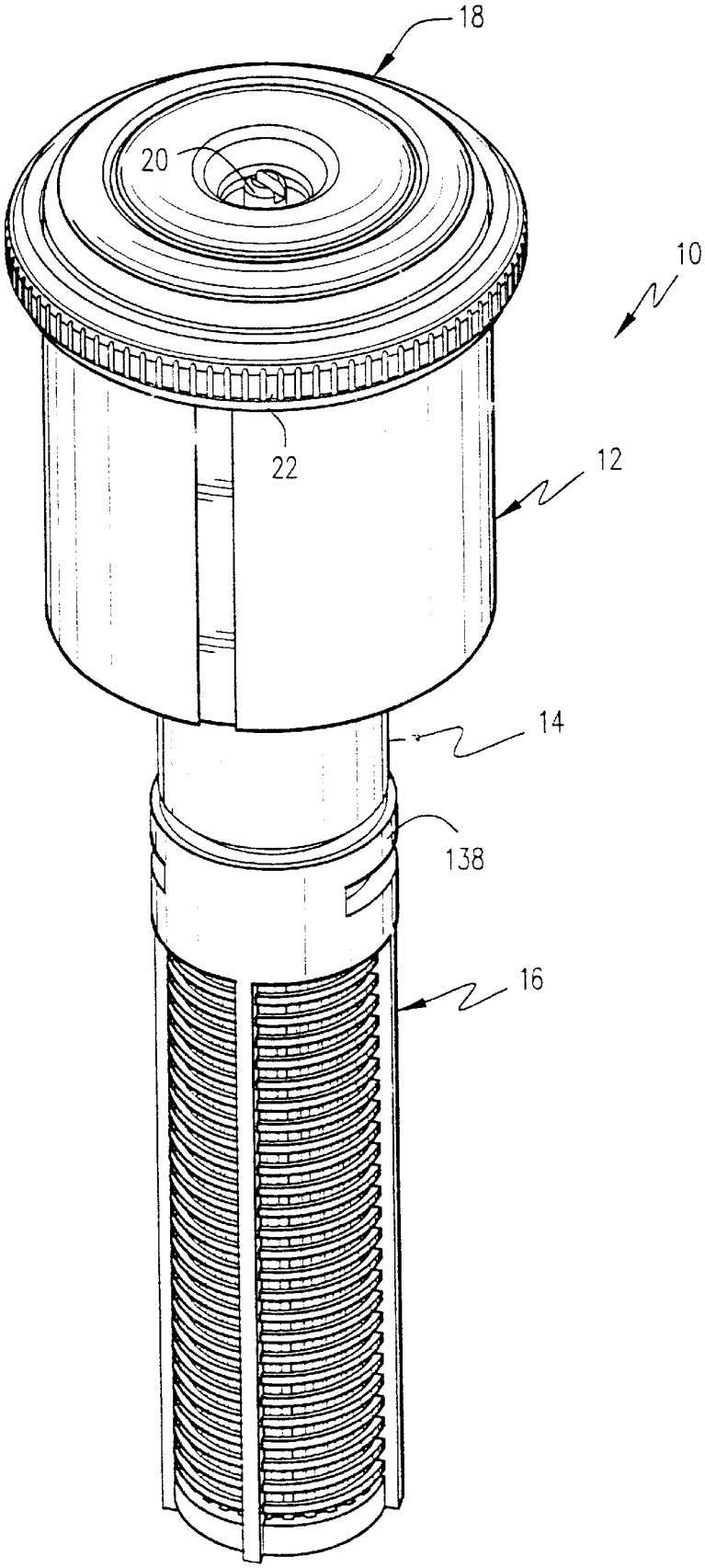
FIG. 1 is a perspective view of a sprinkler head in accordance with the invention.

FIG. 1 illustrates the sprinkler head 10 in accordance with an exemplary embodiment of the invention. The sprinkler head includes a base or housing 12 and a stem 14, with a conventional filter 16 attached to the lower end of the stem. Base 12 is adapted to be threadably attached to a pressurized water source that could include, for example, a fixed riser, a pop-up sprinkler stem, or other sprinkler system component or adapter, etc. In an alternative configuration, the base 12 could be made integral with a fixed riser, pop-up stem or other sprinkler system component. A water distribution plate 18 (or "rotor plate") is mounted in the base 12, with the plate 18 shown in a retracted, inoperative position in the Figure. A flow rate or throttle adjustment shaft 20 (preferably stainless steel) projects through the plate 18, while a rotatable arc adjustment ring 22 is secured to the top of the base 12. These and other internal components will be described in further detail below.

In the description that follows, it will be appreciated that references to "upper" or "lower" (or similar) in the descriptions of various components are intended merely to facilitate an understanding of the sprinkler head as it is oriented in the drawing figures, recognizing that the sprinkler head may be utilized in an inverted orientation as well.

Figure 2:
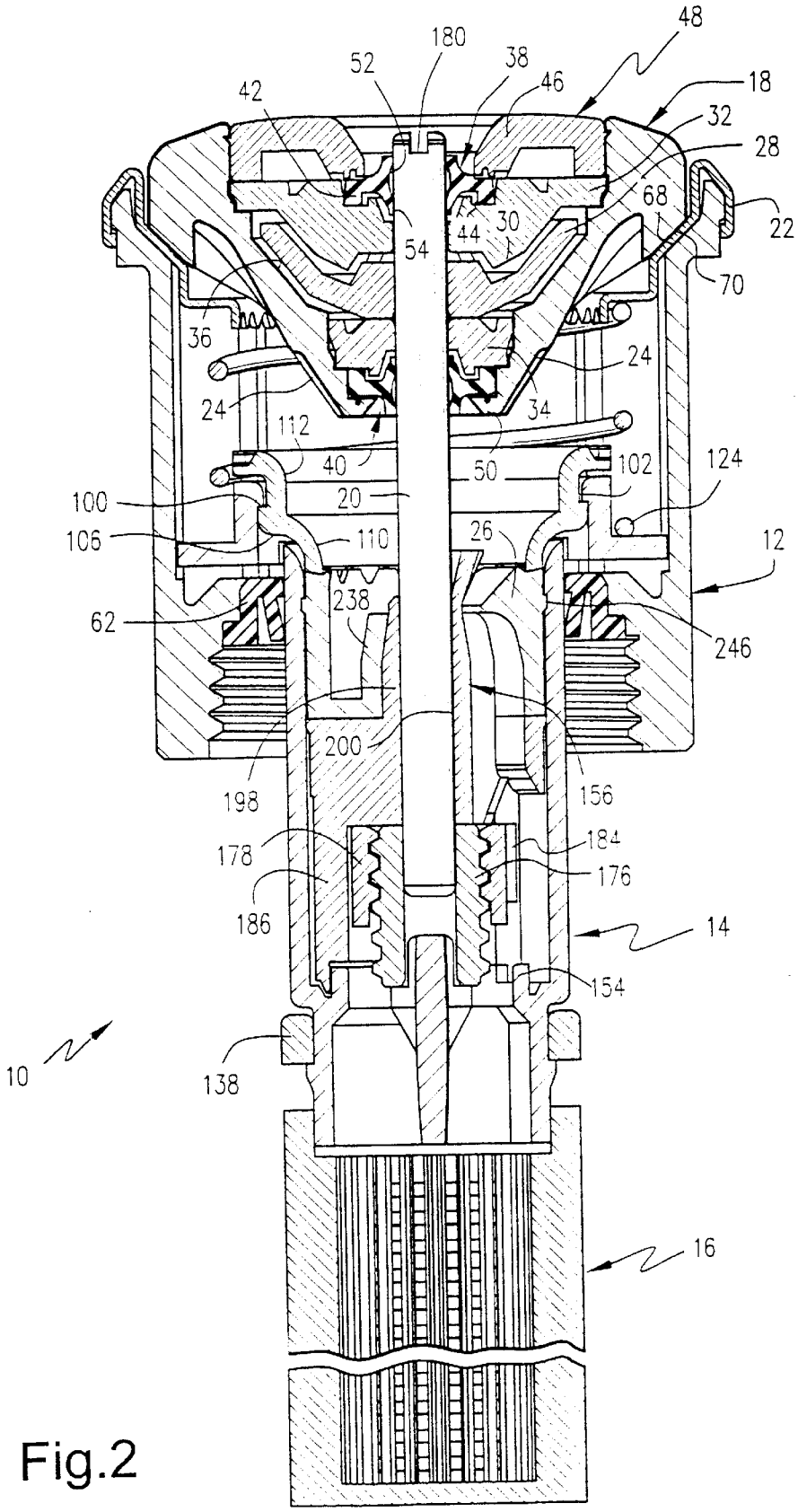
FIG. 2 is a cross section through the sprinkler head shown in FIG. 1.
Figure 33:
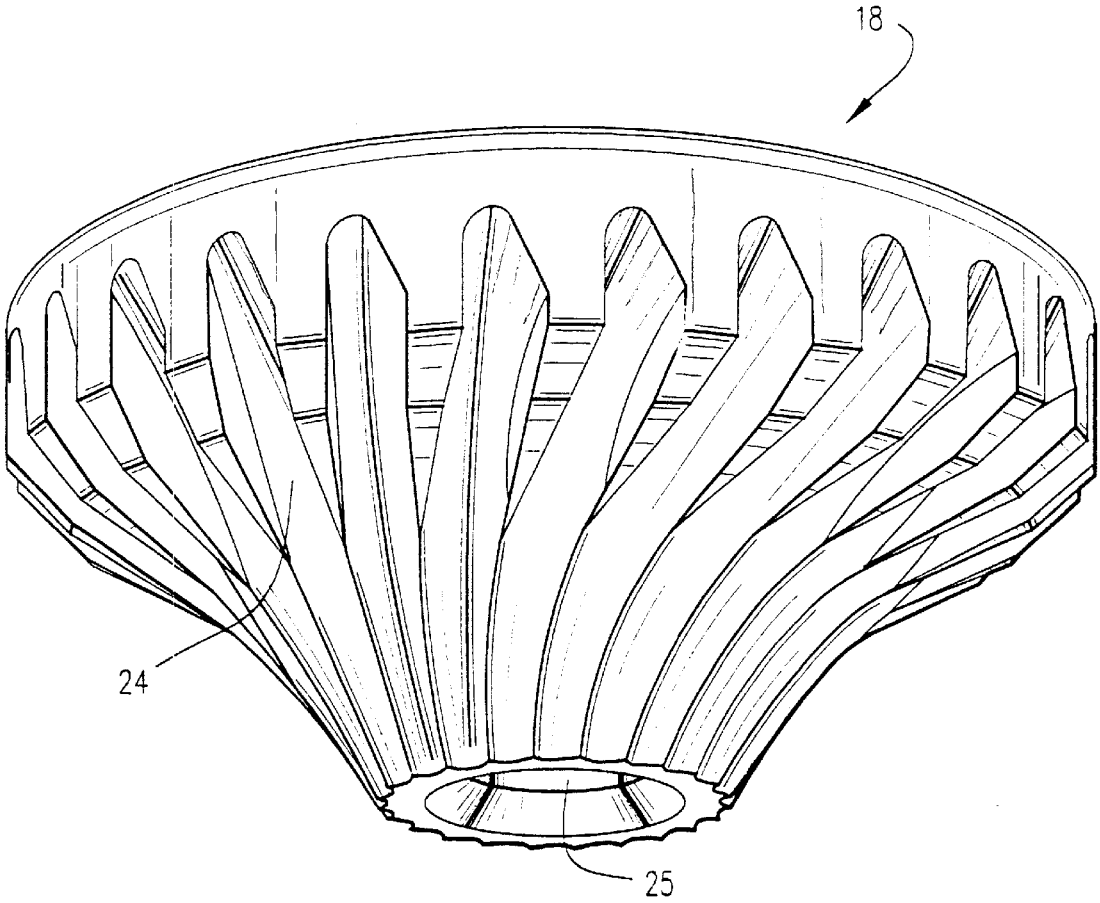
FIG. 33 is a perspective view of a rotor plate incorporated in the sprinkler head of FIGS. 1–3.

Turning to FIG. 2, the rotor plate 18 is mounted for rotation relative to the normally stationary shaft 20. Externally, the rotor plate 18 is formed with a series of generally radially oriented water distribution grooves 24 (see also FIG. 33) that extend angularly upwardly and radially outwardly from a lower end of the plate that is formed with a hole 25 for receiving the shaft 20. The grooves have lowermost entrance points that are preferably radially spaced from the shaft 20 in order to catch and distribute the stream emanating from a nozzle 26, and deflected outwardly by a stream deflector as discussed further herein. Grooves 24 are slightly curved and have a circumferential component best seen in FIG. 33, so that the rotor plate 18 is caused to rotate when the stream impinges on the plate.

The rotational speed of the rotor plate 18 in this embodiment may be slowed by a viscous dampening mechanism or "motor" (or "viscous retarder") similar to that described in commonly owned U.S. Pat. No. 5,058,806. The motor is incorporated into the rotor plate 18 and includes a generally cup-shaped stator 28 fixed to the shaft 20. The stator is located in a chamber 30 defined by upper and lower bearings 32, 34 as well as the interior surface 36 of the rotor plate 18. The chamber 30 is filled or partially filled with a viscous fluid (preferably silicone) that exhibits viscous shear as the rotor plate 18 rotates relative to the fixed stator 28, significantly slowing the rotational speed of the rotor plate as compared to a rotational speed that would be achieved without the viscous dampening motor. The viscous shearing action is enhanced by the shape of the upper bearing 32, the lower portion of which fits within, but remains spaced from, the cup-shaped stator 28.

The bearings 32, 34 are press-fit within the hollow rotor plate 18 so as to remain in place within the rotor plate. A very slight clearance between the shaft 20 and the bearings 32, 34 allows the rotor plate 18 to rotate relative to the shaft 20. At the same time, at least the upper bearing establishes a seal with the rotor plate 18 at the radially outer surface of the upper bearing. Upper and lower annular seals 38, 40 (preferably rubber) are mounted on the shaft and are provided for preventing leakage of silicone fluid out of the chamber 30, along the shaft 20. The seals are substantially identical, and thus only one need be described in detail. The upper seal 38 includes an outermost axial flange 42 by which the seal is secured between an annular groove 44 in the upper bearing 32 and a tapered, radially inner flange 46 on a retainer ring 48. The retainer ring 48 is also pressed and snap-fit within the rotor plate, preferably in permanent fashion. Lower seal 40 is similarly captured between lower bearing 34 and a radially in-turned flange 50 on the rotor plate, noting that lower seal 40 is inverted relative to the orientation of seal 38.

The seal 38 has a pair of axially spaced sealing surfaces 52, 54 that resiliently engage the shaft 20. In this regard, it is possible that some silicone fluid will run along the shaft 20 in an upward direction. Any such fluid will enter the space between the upper surface of the upper bearing 32 and the seal, but will not escape past the seal. A similar arrangement exists with respect to the lower bearing 34 and seal 40, where fluid may run due to gravity along the shaft and into the space between the lower bearing 34 and the seal 40. Seals 32 and 40 also serve to prevent foreign material from entering the chamber 30.

It will be appreciated that the sprinkler head could also employ a fixed water distribution or spray plate without any need for a viscous dampening motor.

Figure 4:
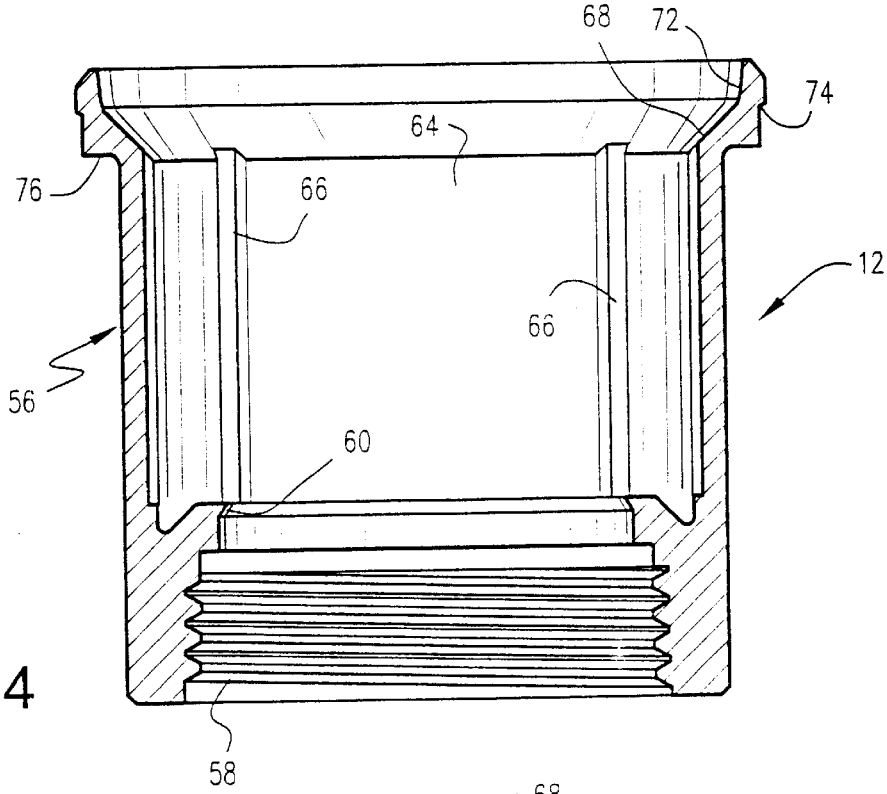
FIG. 4 is a side section through a base component of the sprinkler head shown in FIGS. 1–3.
Figure 5:
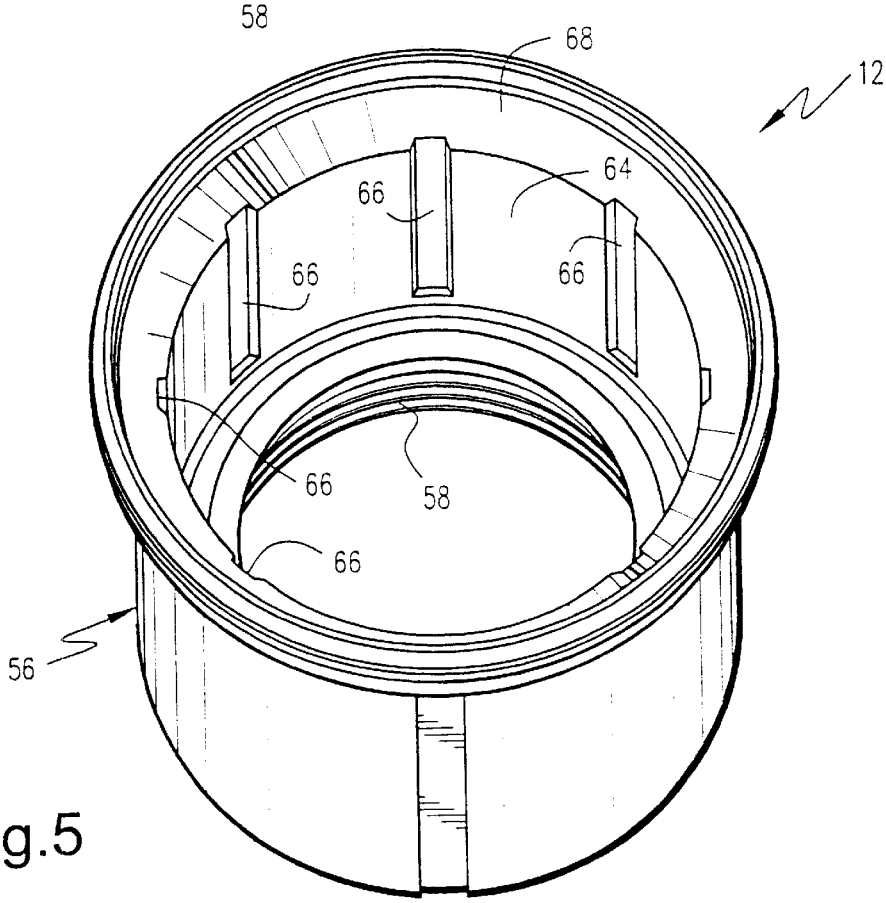
FIG. 5 is a perspective view of the base shown in FIG. 4.
Figure 27:
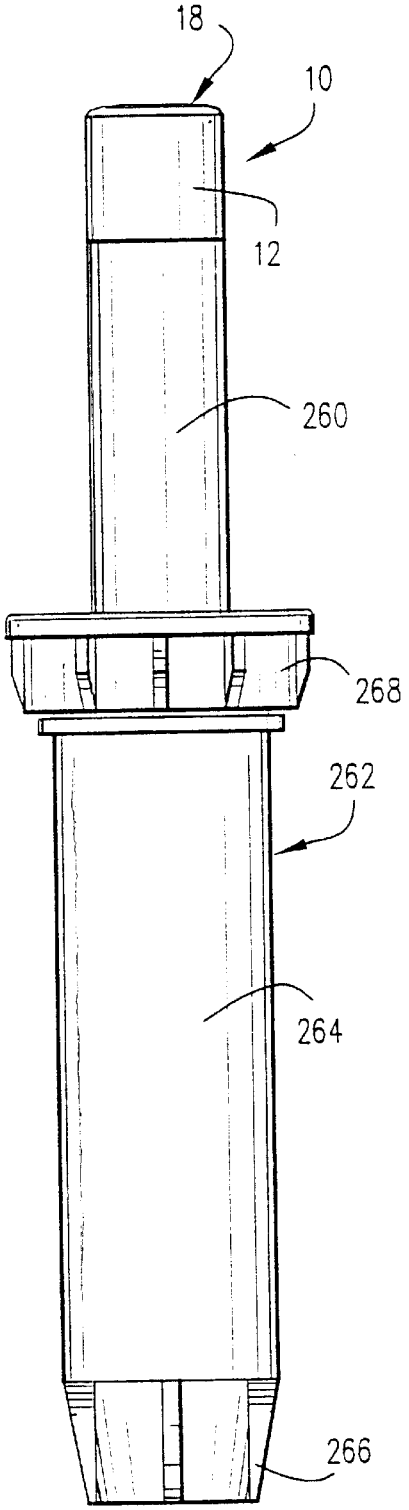
FIG. 27 is a side elevation of a pop-up sprinkler incorporating the sprinkler head in accordance with the invention.
Figure 28:
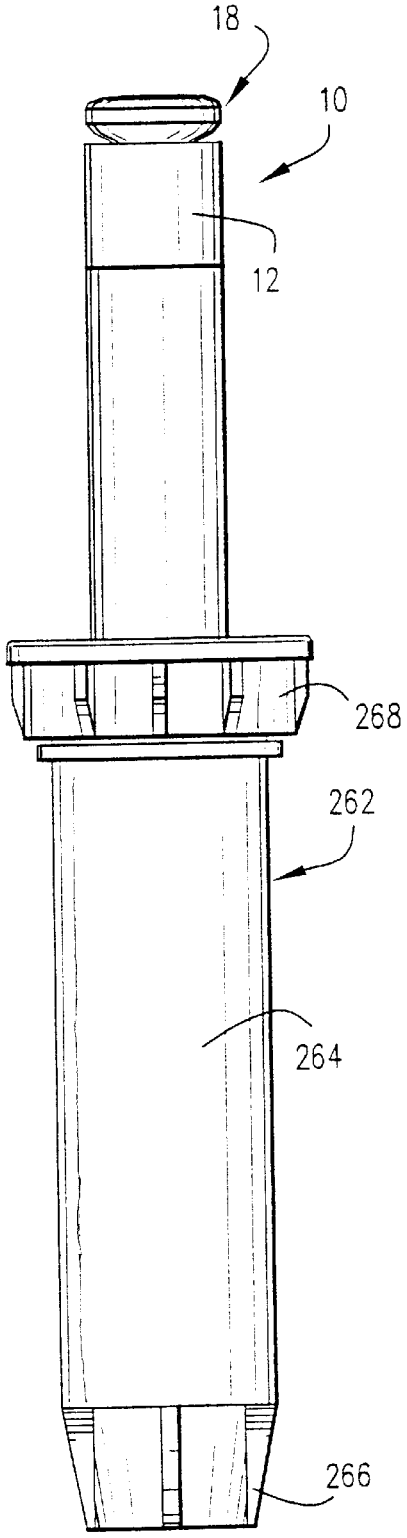
FIG. 28 is a side elevation similar to FIG. 27 but with the rotor plate in an extended, operative position.

Turning now to FIGS. 4 and 5, the base 12 includes a substantially cylindrical sleeve-like member 56 that is formed with an internally threaded inlet 58 by which the sprinkler head 10 may be attached to, for example, a conventional pop-up assembly, shown in FIGS. 27, 28, and discussed further herein (as already noted, the sleeve 56 could also be attached to a fixed riser or other sprinkler system component). The inlet 58 also includes a radially in-turned edge 60 that serves as an annular seat for a seal 62 (preferably 75D urethane). The main portion of the base 12 is formed with a substantially smooth interior surface 64 that is interrupted by a plurality of unequally circumferentially spaced, axially extending grooves 66. The upper end of the base 12 is diametrically enlarged to include a radially outwardly and upwardly tapered surface 68 that serves as a seat for a similarly tapered surface 70 on the arc adjustment ring 22 when the rotor plate 18 is in the retracted, inoperative position shown in FIG. 1.

Surface 68 merges with a less sharply tapered rim 72 that has an undercut 74 on its outer side to facilitate retention of the arc adjustment ring 22 as explained further herein. A shoulder 76 is adapted to engage an annular surface on the pop-up sprinkler body. As also explained further below, the axially extending internal grooves 66 on the base 12 are used to locate the stem 14 and to insure that the latter does not rotate relative to the base 12.

Figure 3:
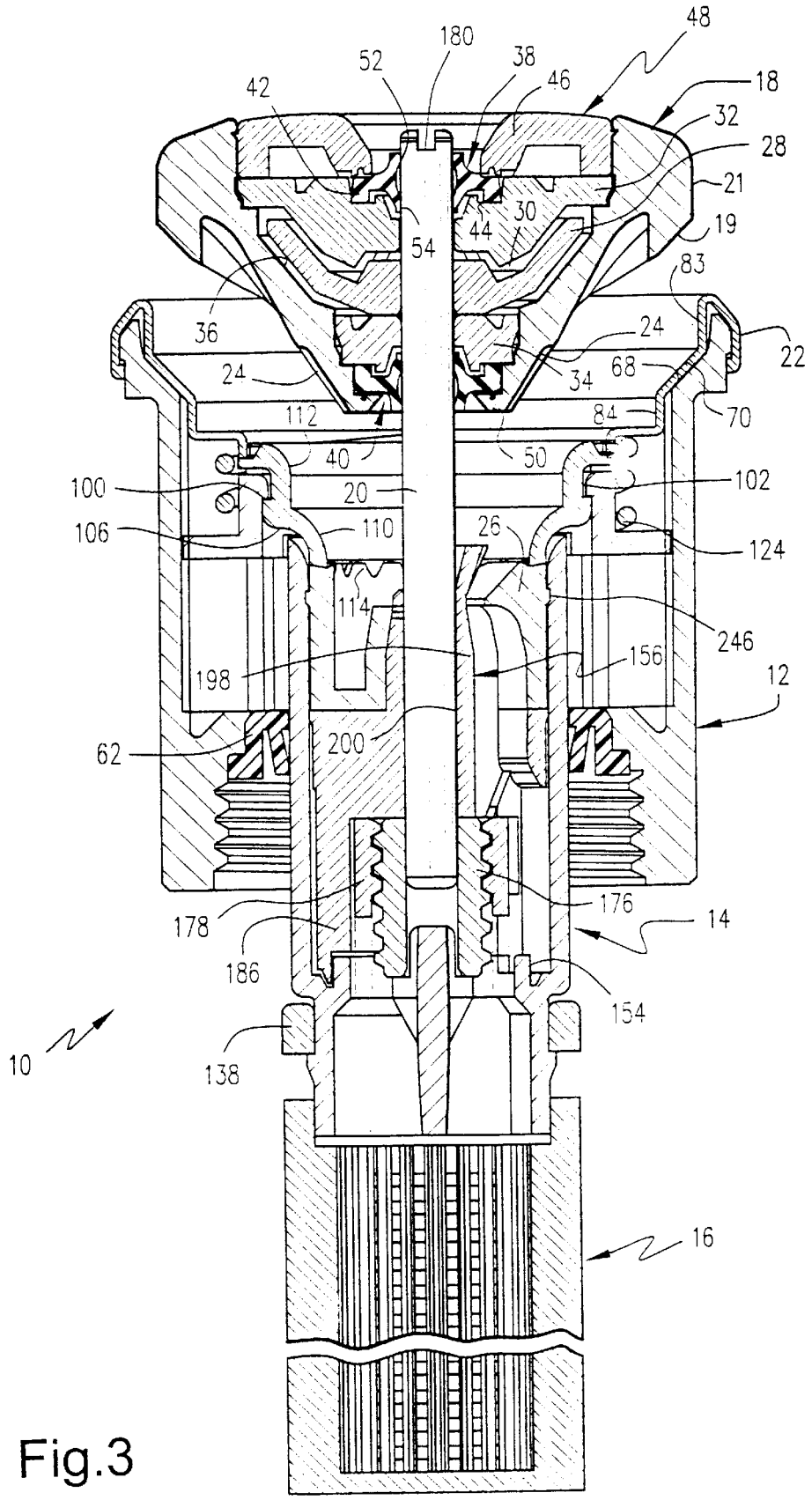
FIG. 3 is a cross section similar to FIG. 2 but with the rotor plate in an extended, operative position.
Figure 6:
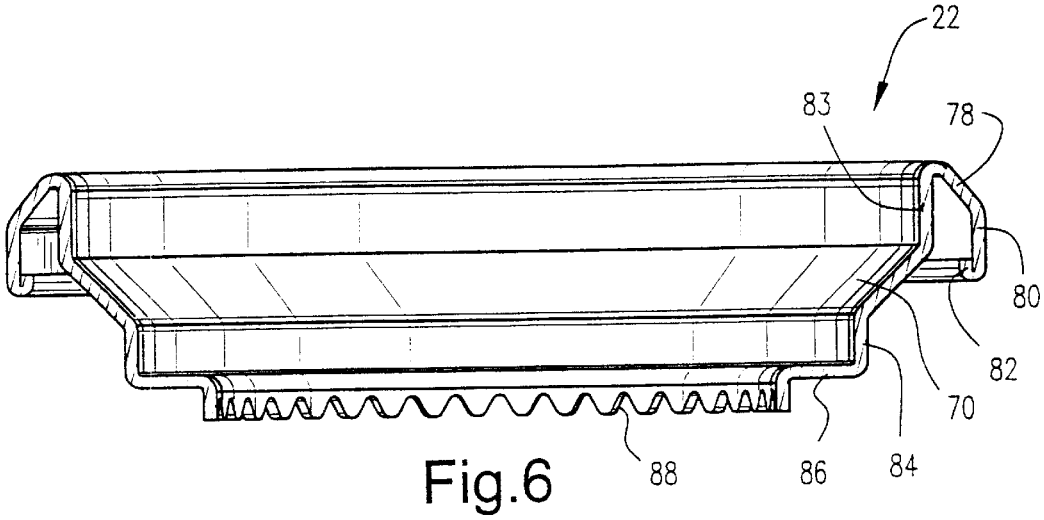
FIG. 6 is a cross section through an arc adjustment ring incorporated in the sprinkler head shown in FIGS. 1–3.
Figure 7:
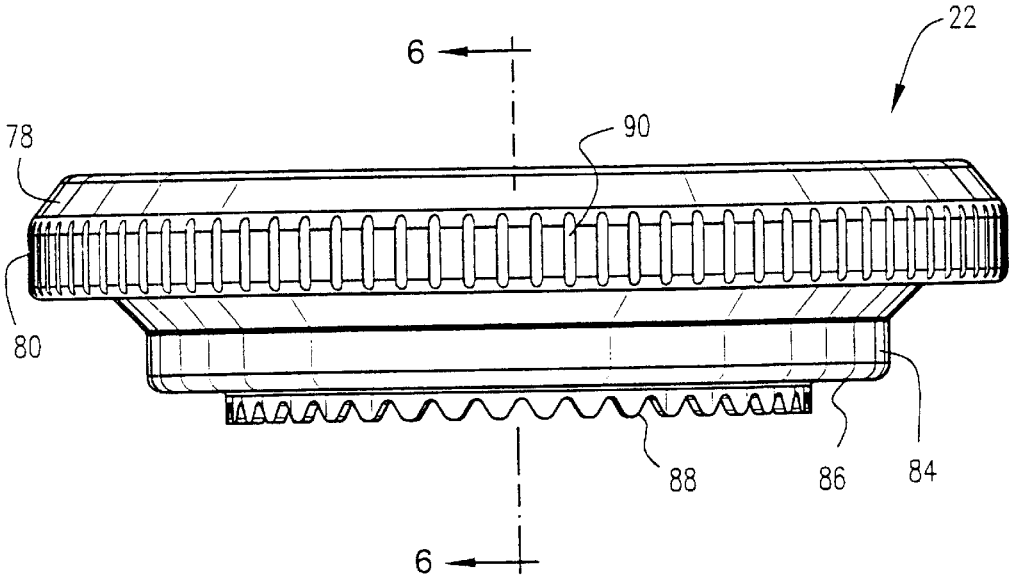
FIG. 7 is a side elevation of the arc adjustment ring shown in FIG. 6.

The arc adjustment ring 22 shown in FIGS. 2 and 3 but best seen in FIGS. 6 and 7, includes an upper radially outturned rim 78 that is adapted to fit over the upper rim 72 of the base 12. Rim 78 includes a depending skirt 80 that forms the outer diameter of the ring 22. The lower end of skirt 80 is provided with a radially in-turned curl 82 engaged in the undercut 74 such that the arc adjustment ring 22 is rotatable, but otherwise axially fixed relative to the base. The previously described tapered surface 70 extends downwardly and inwardly from a first axial portion 83 to a second axial portion 84 and radial wall 86 that extends inwardly to an annular row of gear teeth 88 that are used in the implementation of the arc adjustment capability as described further below. The row of teeth form the radially inner diameter of the ring 22. To facilitate rotation of the ring 22, the outer and axially extending surface of the rim 78 may be formed with a series of closely spaced grooves 90 (or similar tactile surface enhancements), best seen in FIGS. 1 and 7.

Figure 8:
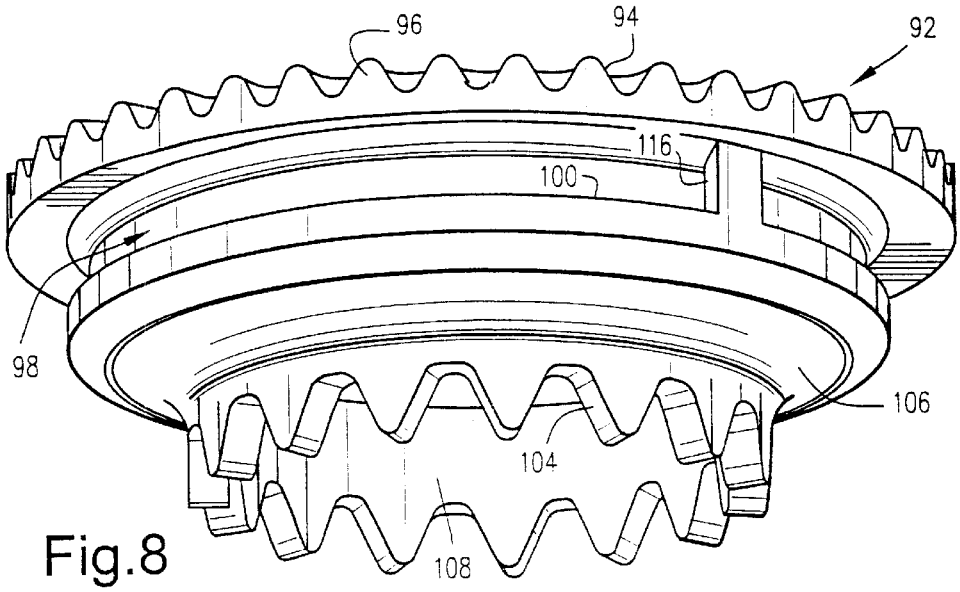
FIG. 8 is a perspective view of an intermediate drive component incorporated in the sprinkler head shown in FIGS. 2 and 3.

With reference now to FIG. 8, and with continuing reference to FIGS. 2 and 3, an arc adjustment actuator or drive ring 92 is axially interposed between the arc adjustment ring 22 and the nozzle 26. The drive ring 92 is formed with a first upwardly facing annular row of teeth 94, the outer surface 96 of which forms the outer diameter of the ring 92. An undercut or groove 98 on the outer surface of the ring provides an annular seat or shoulder 100 (FIGS. 2 and 3) adapted to receive radially inwardly directed ribs 102 on the stem 14 (FIGS. 2 and 3). A second annular row of teeth 104 project downwardly from the lower end of the ring, spaced radially inwardly of the upper row of teeth and seat 100 by the radial flange 106. The inner surface 108 defines the inner diameter of the ring.

The upper row of teeth 94 are adapted to mesh with the row of teeth 88 on the arc adjustment ring 22, but only when the rotor plate 18 is extended as shown in FIG. 3. The lower row of teeth 104 is adapted to always mesh with an upper row of teeth 114 on the nozzle 26 as described further below. In an alternative arrangement, the drive ring 92 could be made integral with the nozzle 26, eliminating the teeth 104 and 114.

A vertical rib 116 in the groove 98 limits rotation of the ring 22 and nozzle 26 by engaging a selected edge of one of the radially inwardly directed ribs 102. As will be explained further below, this rib insures that the nozzle 26 will not be over-rotated when adjusting the arc of coverage, thus greatly minimizing the possibility of undesirable leakage through the nozzle area.

FIGS. 9–12 illustrate the stem 14 in further detail. With continuing reference also to FIGS. 2 and 3, and as already mentioned, the stem 14 is formed at its upper end with a pair of the circumferentially spaced, radially inwardly directed, arcuate ribs 102. These ribs extend from an outer cylindrical wall 118 that extends downwardly to a radial flange 120 that provides a seating surface 122 for a coil spring 124. The flange 120 includes a plurality of circumferentially spaced, laterally extending teeth or ribs 126 that are unequally spaced about the flange 120 so as to match (in a single matched orientation) the unequally spaced axial grooves 66 formed in the base. This arrangement serves to circumferentially orient the stem 14 relative to the base 12 in the desired manner during assembly.

In order to form the arcuate, radially inwardly directed ribs 102, slots 128,130 are formed at the root of the corresponding flange 120, thus permitting access by forming tools during manufacture.

Below flange 120, the stem 14 is made up of a substantially cylindrical tubular portion 132, with a lower end having an annular groove 134 and a reduced diameter portion 136. Groove 134 is adapted to receive an upper end 138 of the filter 16 in snap-fit relationship (best seen in FIGS. 2 and 3). Interiorly, the tubular portion 132 is formed with a pair of diametrically opposed ribs 140,142, each having respective tapered top portions 144,146, extending radially inwardly from the interior surface 148 of the tubular portion 132. At their lower ends, the ribs 140,142 are connected by a cross web 150 that extends diametrically across the inlet opening 152 of the stem.

Figure 9:
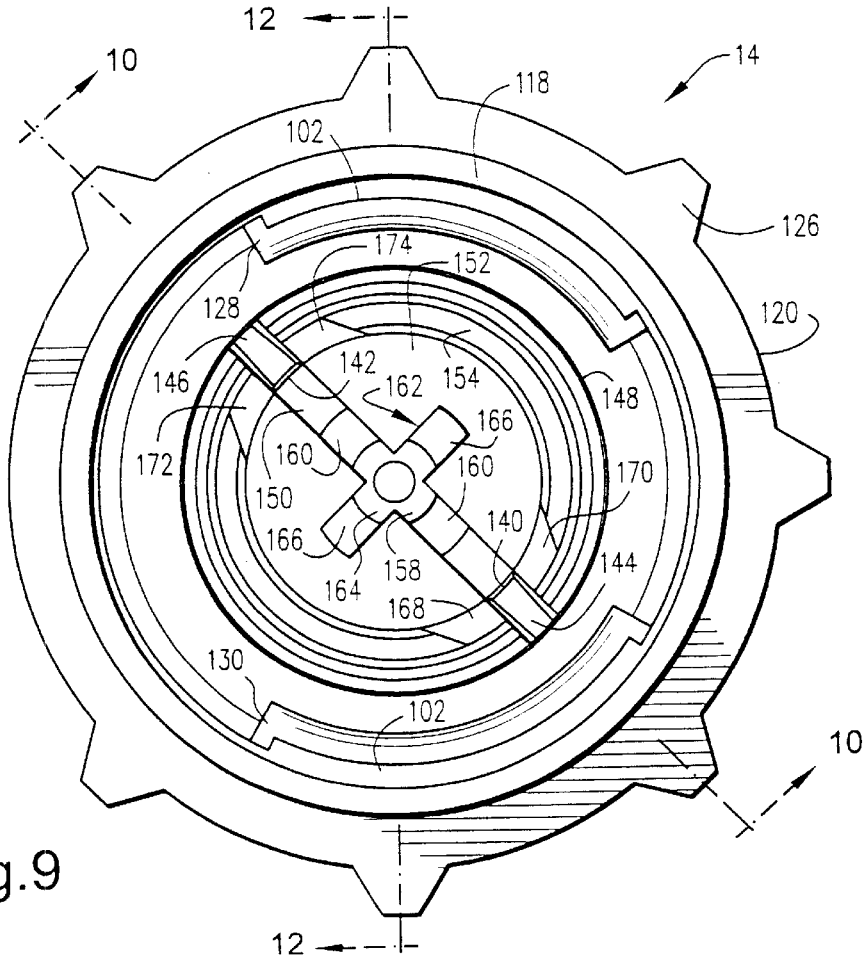
FIG. 9 is a plan view of a stem component incorporated in the sprinkler head shown in FIGS. 1–3.
Figure 10:
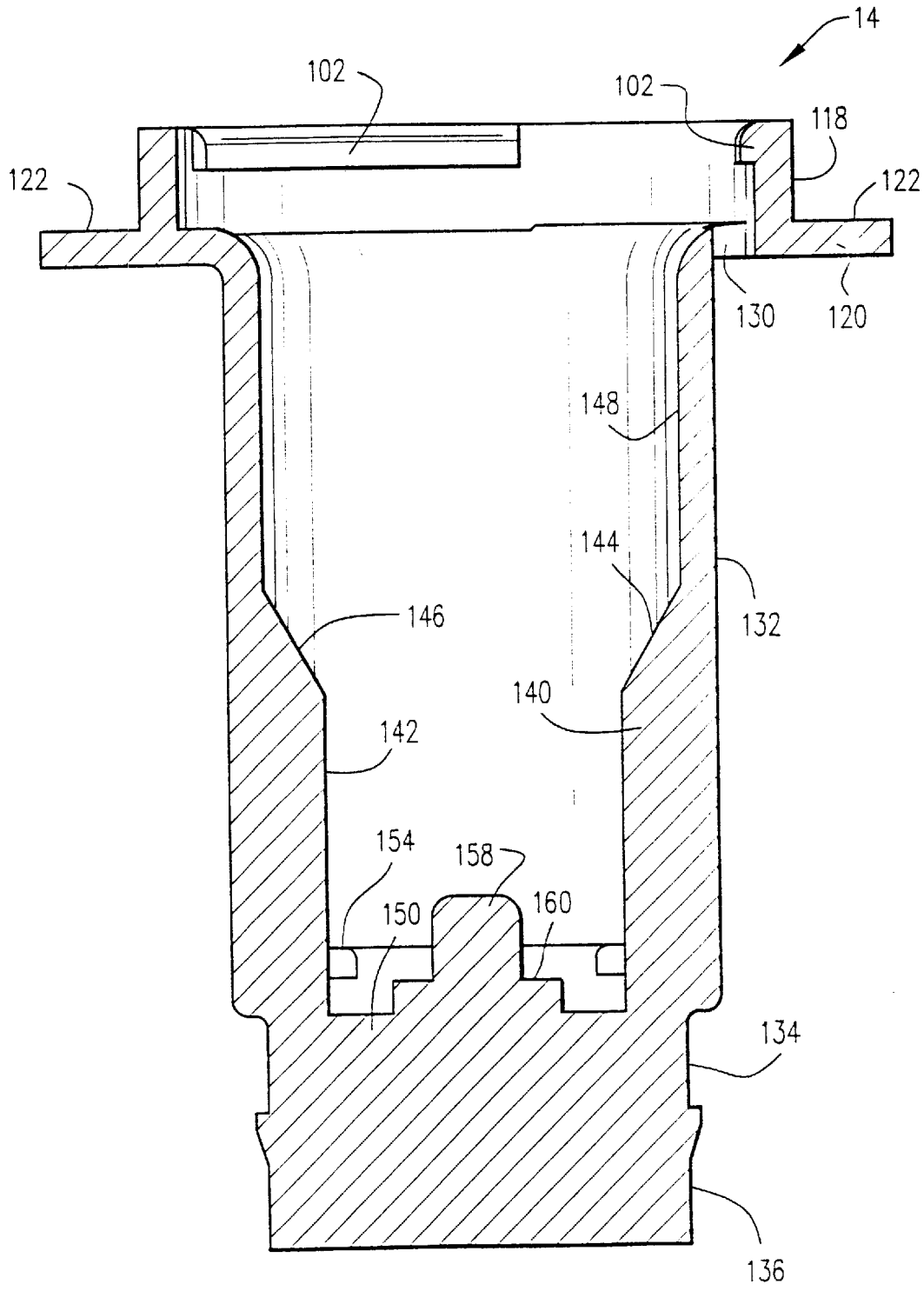
FIG. 10 is a section taken along the line 10—10 of FIG. 9.
Figure 11:
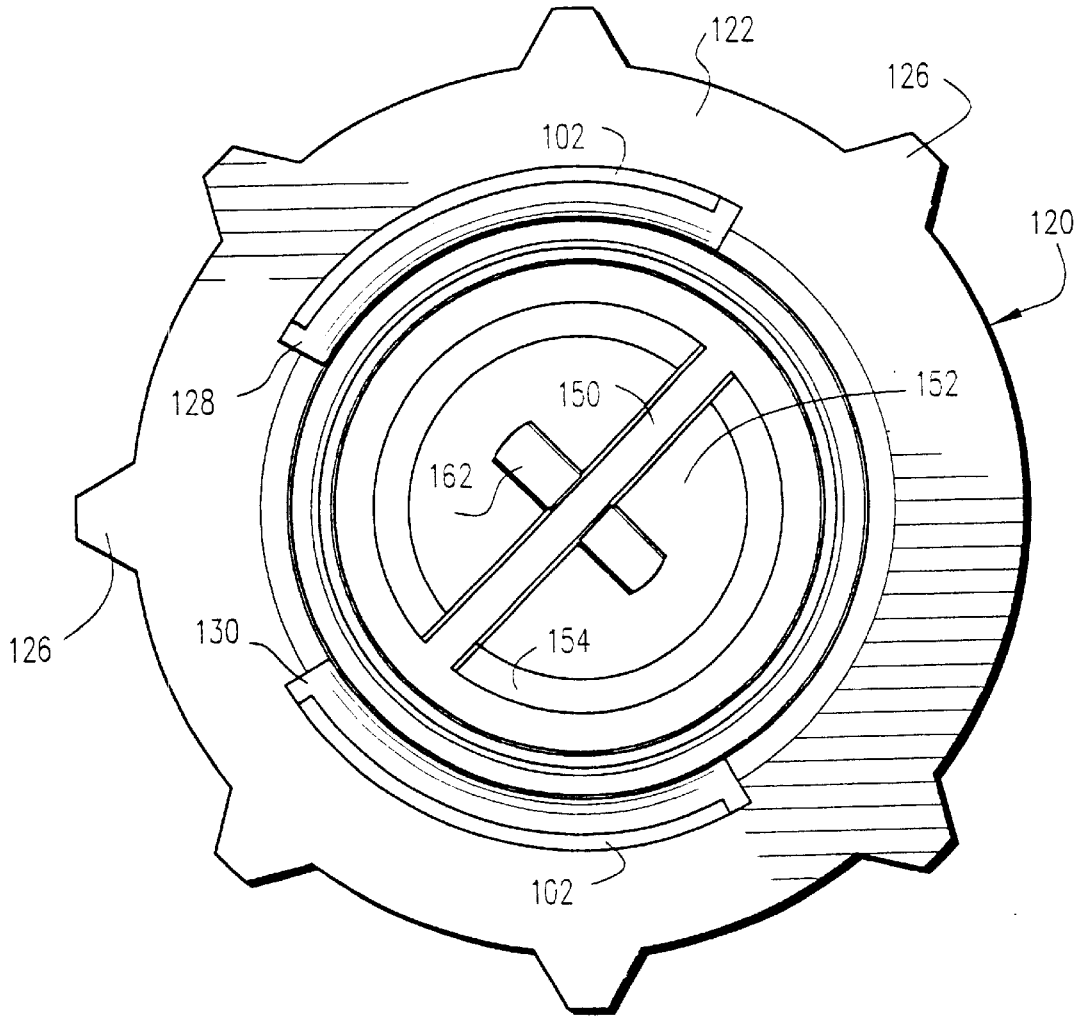
FIG. 11 is a bottom plan view of the stem shown in FIG. 9.
Figure 12:
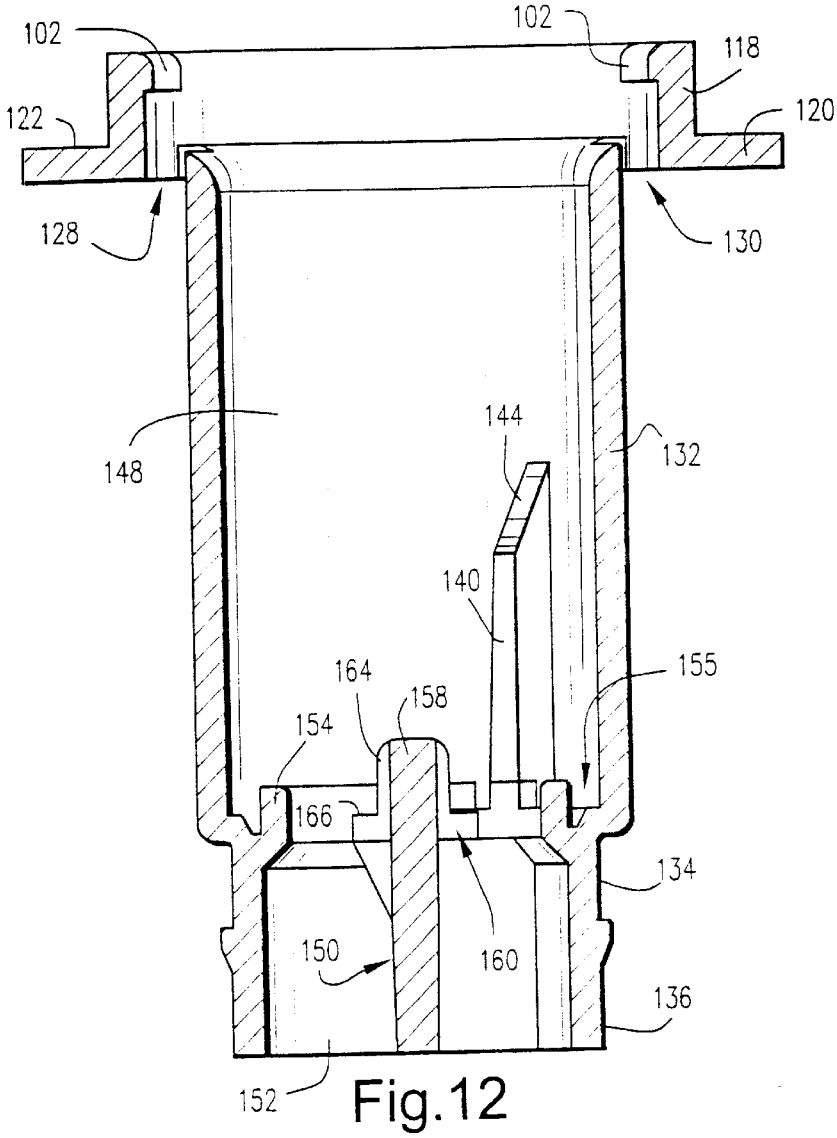
FIG. 12 is a section taken along the line 12—12 in FIG. 9.

Opening 152 is defined by an annular ring or shoulder 154, spaced radially inwardly of surface 148, that extends approximately 180° on either side of the web 150, and that provides a seat 155 for the lower end of a stream deflector 156 described further herein. The web 150 is formed with a raised center boss 158 and intermediate, adjacent ledges 160 (FIG. 10). This construction is continued on a radially shortened cross piece 162 that extends perpendicular to the web 150, terminating at distal ends that lie approximately halfway between the center boss 158 and the interior shoulder 154. This cross piece 162 has a similar raised center surfaces 164 that join with the boss 158, and intermediate, adjacent ledges 166. Thus, the combined center boss 158, 164 and associated intermediate ledges 160, 166 form an X or cross-shape. The annular shoulder 154 is formed with recessed areas 168,170 (FIG. 9) adjacent rib 140 and similarly recessed areas 172,174 adjacent rib 142. This construction at the base of the stem facilitates the flow rate adjustment feature of the sprinkler as described further below.

Returning to FIGS. 2 and 3, the shaft 20 extends downwardly through the nozzle 26 and through the stream deflector 156. The lower end of the shaft is provided with an externally threaded sleeve 176 (preferably brass) that is pressed onto the shaft so as to be fixed thereto. It may be possible, however, to have sleeve 176 made integral with the shaft. The sleeve rests on the intermediate ledges 160, 166. An internally threaded throttle control member 178 (see also FIG. 13) is threadably received on the axially fixed sleeve 176, such that rotation of the shaft 20 causes the throttle control member 178 to move toward or away from the cross web 150, depending upon the direction of the rotation of the shaft. A slot 180 at the top of the shaft enables rotation of the shaft by a screw driver or similar tool.

It will be seen that as the throttle control member moves toward a flow restriction portion which, in this case, is the annular shoulder 154 and cross web 150, the cross-sectional area available for flow, and hence the flow rate through the sprinkler, decreases, and reaches a minimum when the throttle control member is seated on the cross web, or stop, 150. In this position, however, there is still sufficient flow around the stream deflector 156 and through the stem 14 and nozzle 26 to rotate the rotor plate 18, albeit at a reduced speed. This arrangement prevents the device from stalling, i.e., from stopping when the flow rate is significantly reduced. Note that shaft 20 is stationary during normal operation, and is rotatable only to adjust the flow rate.

Figure 13:
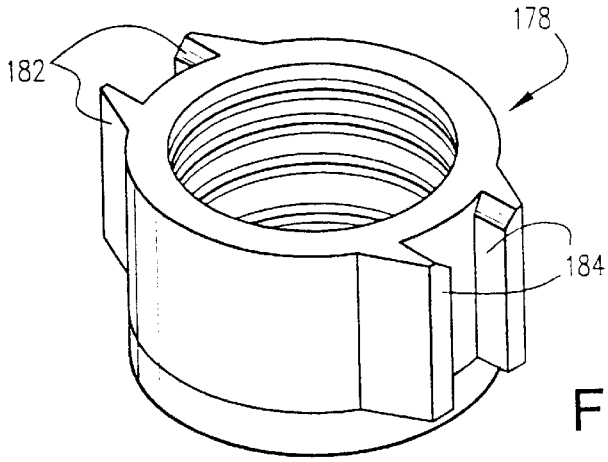
FIG. 13 is a perspective view of a throttle member incorporated in the sprinkler head shown in FIGS. 2 and 3.

The throttle control member 178, as best seen in FIG. 13, is formed with pairs of diametrically opposed ears 182, 184 that locate along the ribs 140, 142 to guide the throttle member 178 axially and to prevent rotation thereof. The ears are adapted to seat in the recessed areas 168, 170 and 172, 174 on opposite sides of the respective ribs 140, 142 when the throttle control member is in its most restrictive position.

Note also that the raised boss 158,164 extends into the hollow sleeve 176 to maintain proper vertical alignment of the shaft 20.

Turning now to FIGS. 14–19, along with FIGS. 2 and 3, the stream deflector 156 is received within the stem 14 and cooperates with the nozzle 26 to define an arcuate water discharge orifice (see 259 in FIGS. 25 and 26) with an adjustable arcuate length. As already noted, the lower or tail end 186 of the deflector is formed with a tapered edge 188 supported in the groove 155 at the base of the stem 14. The stream deflector 156 also includes an annular ring 190 approximately mid-way along its axial length. A skirt portion 192 of the ring is formed with a pair of notches 194,196 that open along the bottom edge of the skirt and are adapted to receive the tapered upper ends 144,146 of the ribs 140,142. This arrangement fixes the stream deflector 156 against rotation.

Figure 16:
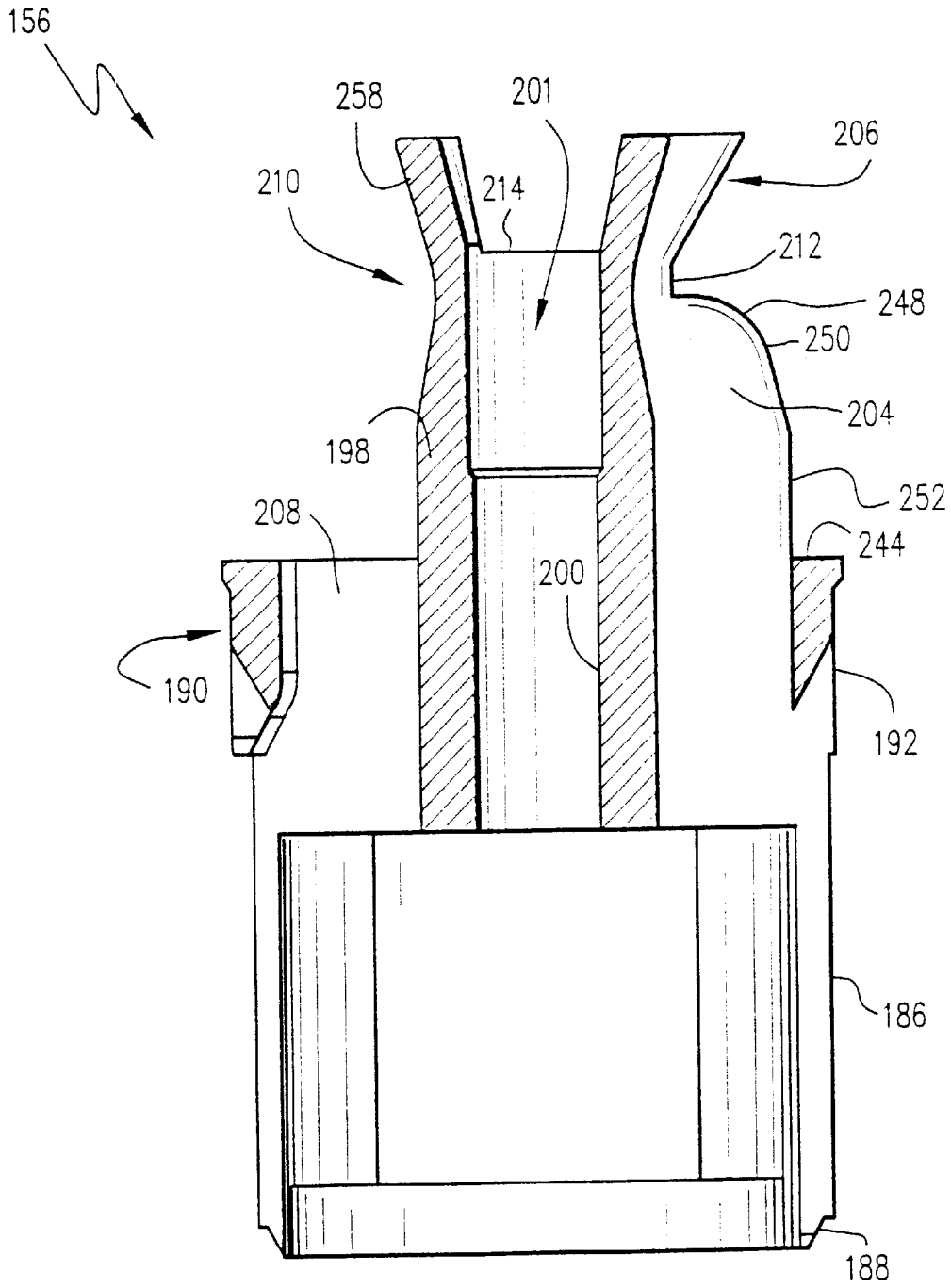
FIG. 16 is a section taken along the line 16—16 of FIG. 15.
Figure 17:
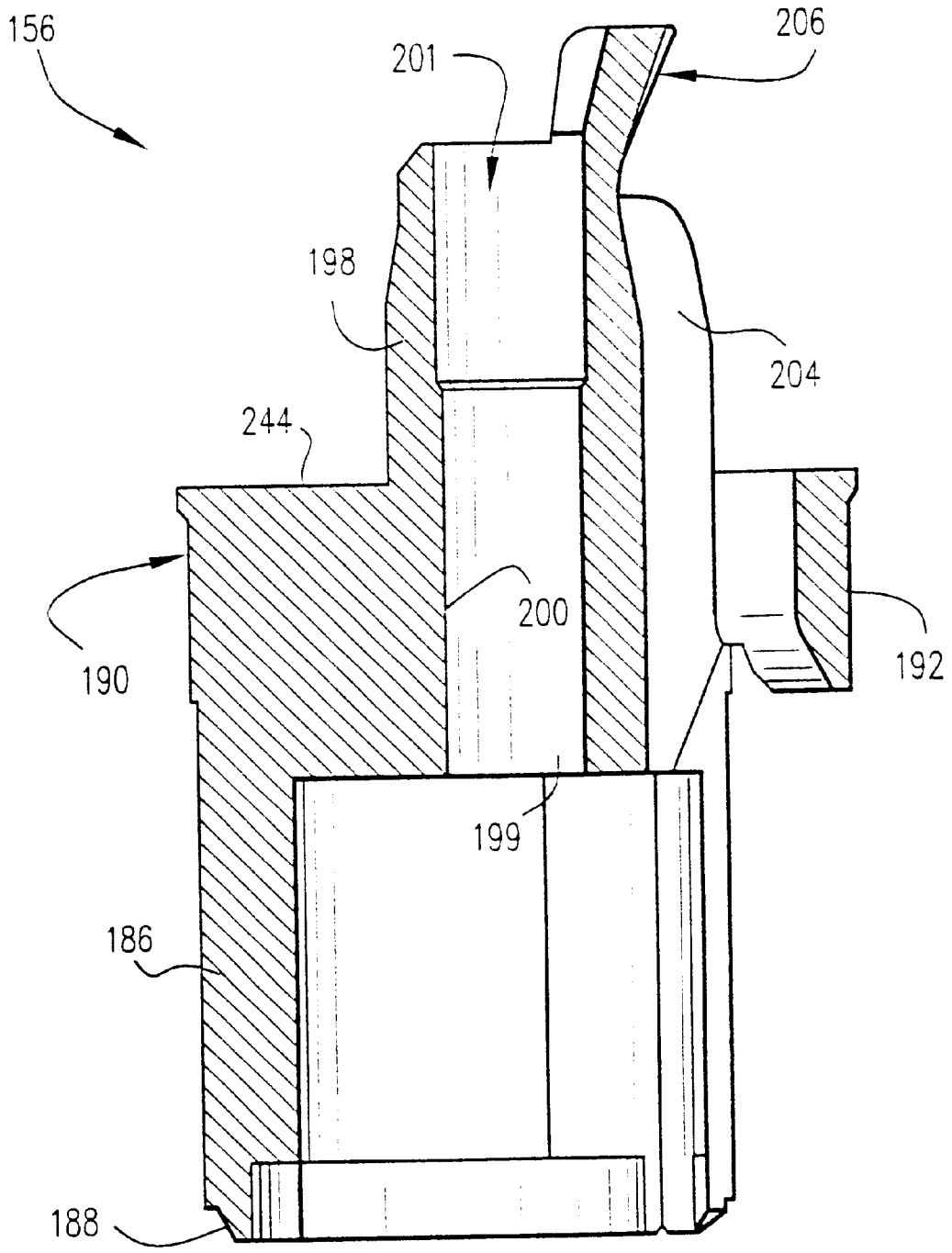
FIG. 17 is a section taken along the line 17—17 of FIG. 15.

A center hub 198 lies at the center of the stream deflector 156 and, for axial distances above and below the ring 190, the hub is cylindrical in shape, the lower portion being of substantially greater diameter (i.e., a relatively thick wall section) for strength so as to provide support for the shaft 20. The hub is formed with a bore 201 that receives the shaft 20 as best seen in FIGS. 2 and 3. The shaft 20 is press-fit within a slightly reduced diameter portion 200 of the bore 201, thus preventing water from leaking along the shaft, and preventing rotation of the shaft during normal operation. The reduced diameter portion 200 is shown in FIGS. 16 and 17 but is not apparent in the reduced scale of FIGS. 2 and 3.

Note that the shaft 20 and other internal components are protected in the event of external impacts. Specifically, impact forces acting on the rotor plate 18 will be transferred to the base 12 and, in turn, to the sprinkler system component to which the base is attached, especially when the rotor plate is in the retracted position, or if pushed down into the retracted position as a result of the impact. This is because the rotor plate 18 engages the arc adjustment ring along tapered surface 70, thus transferring the impact forces directly to the base 12 via surface 68.

The deflector is open between the ring 192 and hub 198 for approximately 195°. The maximum arc for this deflector (and associated nozzle) is 210°. The arcuate opening is bisected by a radial strengthening rib 202. Below the ring 190, the remaining approximately 150° of the tail end 186 is primarily intended as a flow restrictor for sprinklers with limited arcuate nozzle openings, thus reducing the sensitivity of the throttling action. As will be described below in connection with an alternative 360° nozzle, the tail end 186 of the deflector may be omitted.

A vertical wall surface 204 of an upstanding vertical, radially extending tab 206 defines one end of the 210° arcuate opening. It is important that this wall surface 204 extend axially upstream from the discharge orifice at least as far as surface 244 and extend downstream to the downstream end of the deflecting surface 258 in order to smooth the water flow onto the rotor plate in a concentrated, non-turbulent manner. A second vertical wall surface 208 defines the other end of the arcuate opening. The tab 206 extends upwardly beyond the ring 190 axially along the hub 198 and interacts with the nozzle 26, such that surface 204 defines the non-adjustable end (or "fixed edge") of the adjustable arcuate discharge orifice. The other end 208 of the arcuate opening may be considered the adjustable end or edge in that a wall surface 230 (described further below) of the nozzle 26 is movable toward and away from the tab 206 from end 208 to reduce the size of the length of the arc as described below.

Figure 14:
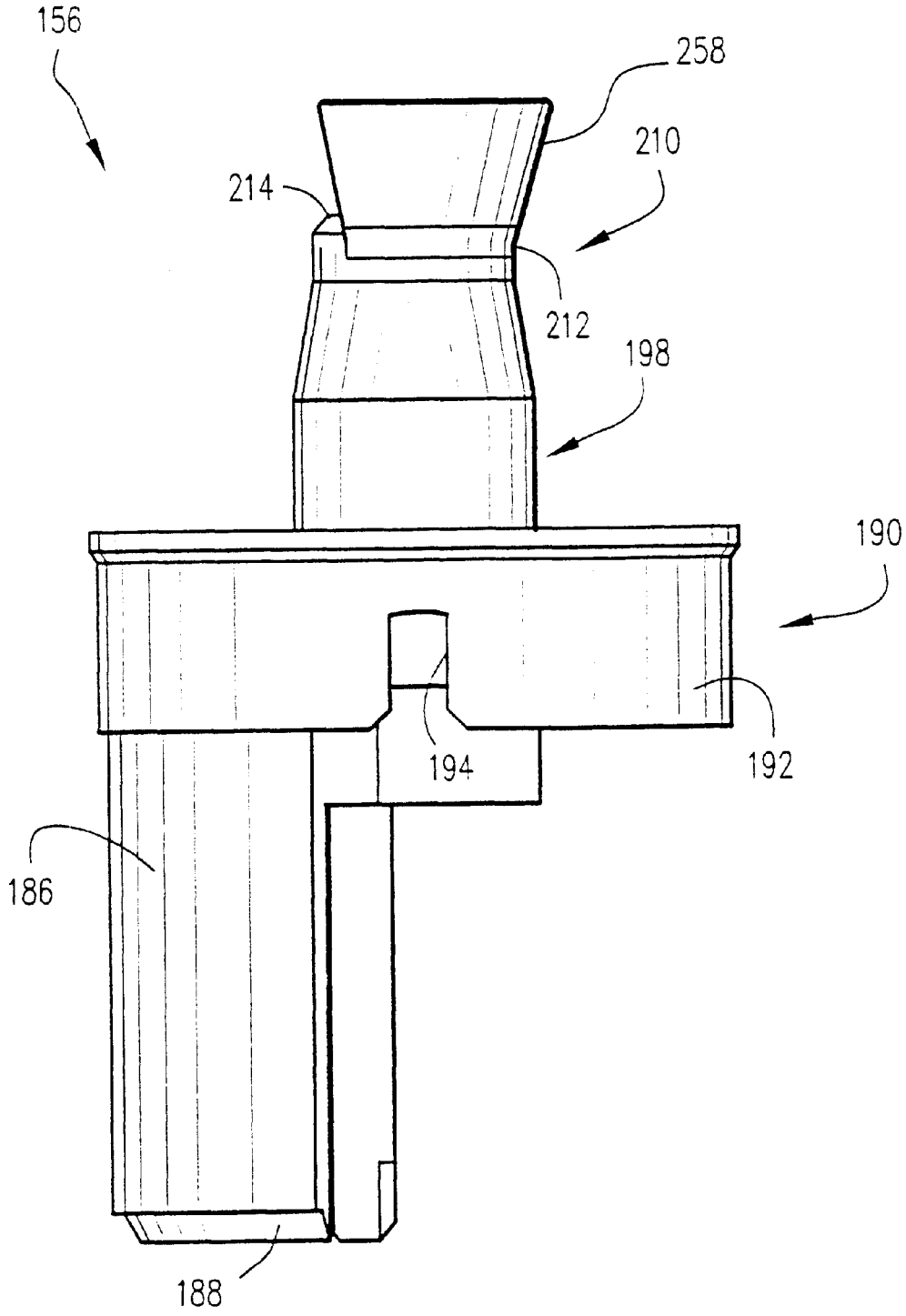
FIG. 14 is a side elevation of a stream deflector component incorporated in the sprinkler head shown in FIGS. 2 and 3.
Figure 15:
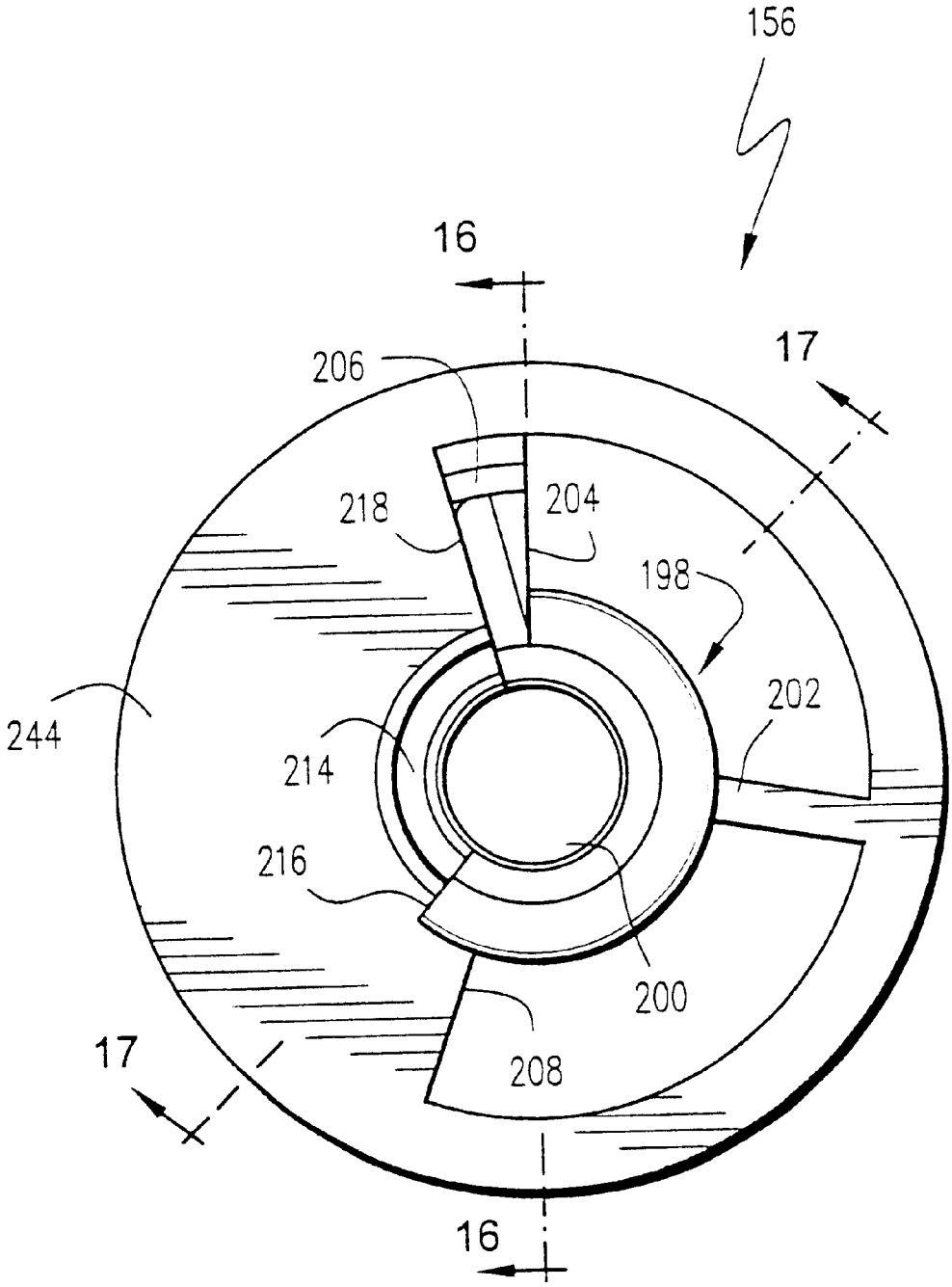
FIG. 15 is a plan view of the stream deflector component shown in FIG. 14.
Figure 18:
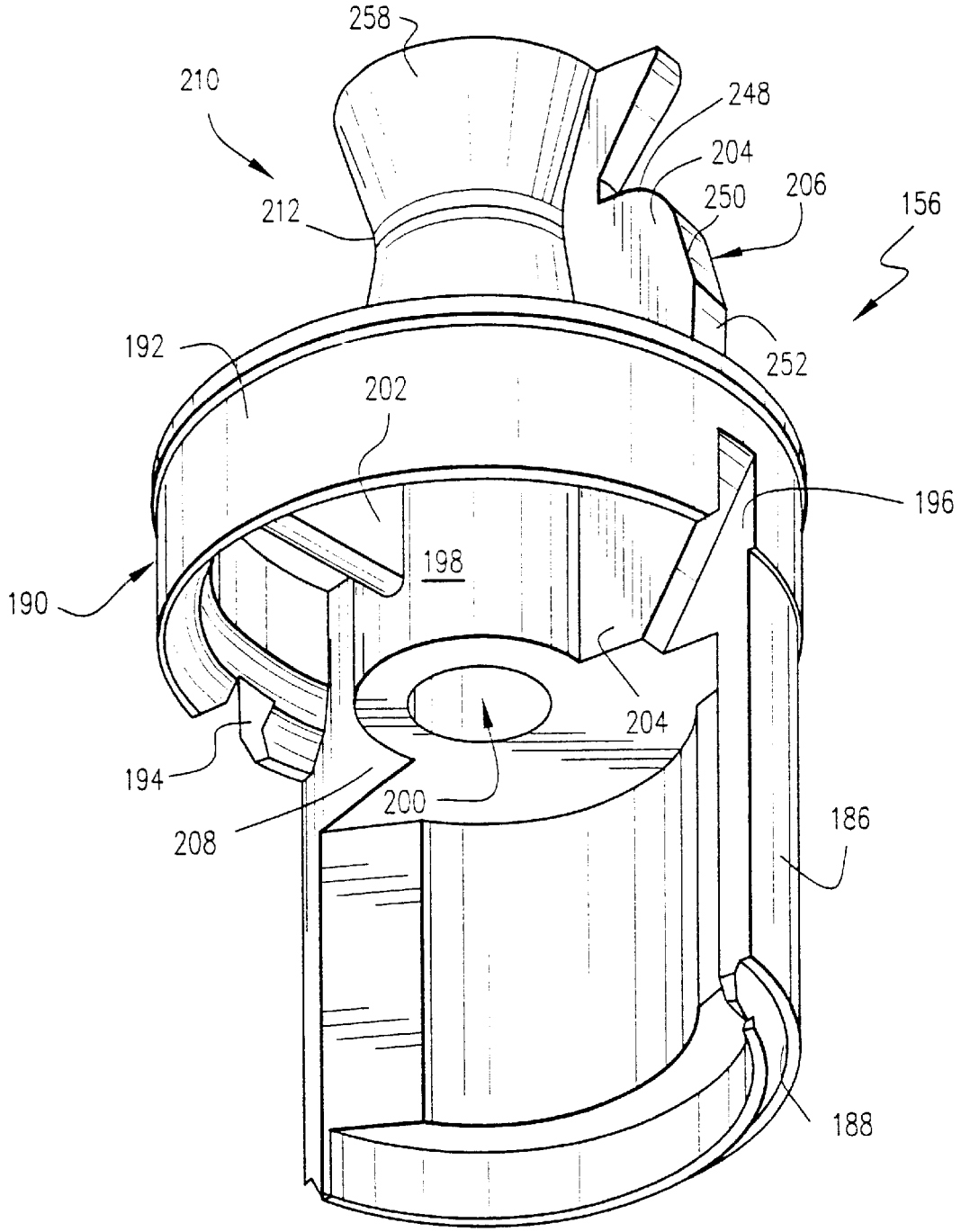
FIG. 18 is a perspective view of the stream deflector component.
Figure 19:
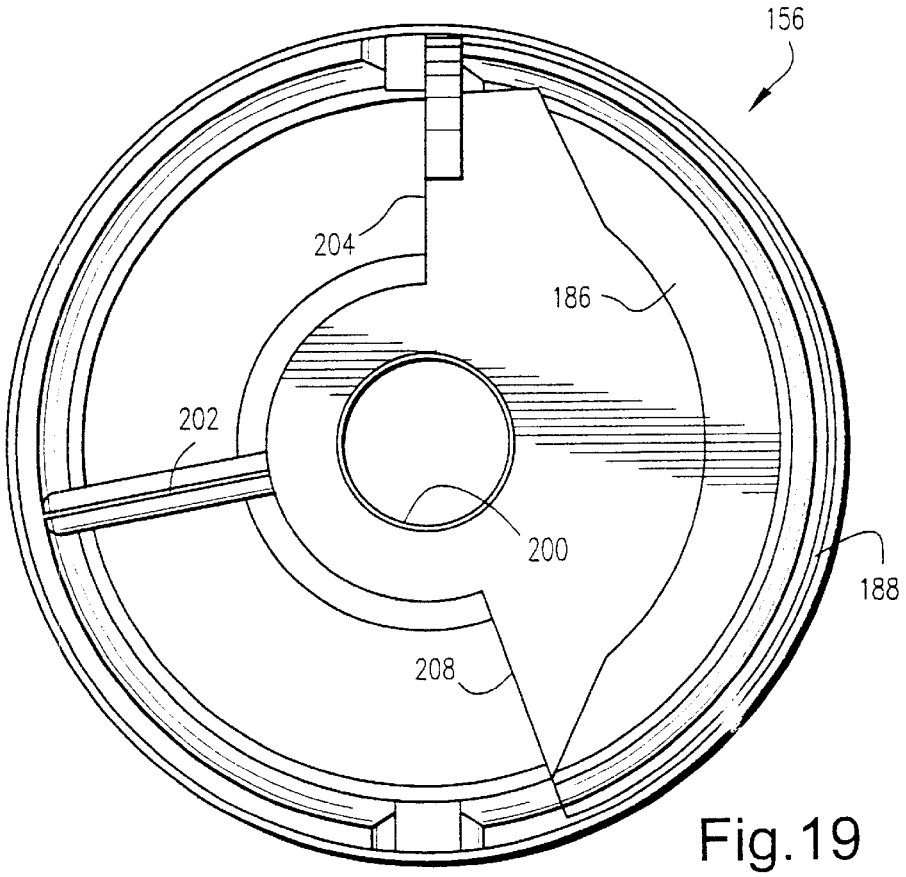
FIG. 19 is a bottom plan view of the stream deflector component.
Figure 20:
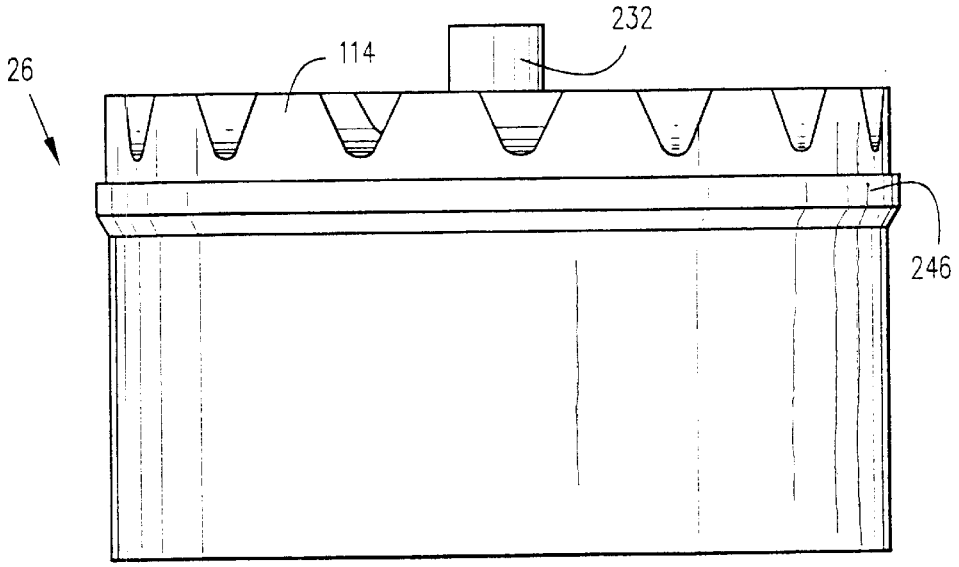
FIG. 20 is a side elevation of the nozzle component incorporated in the sprinkler head shown in FIGS. 2 and 3.
Figure 21:
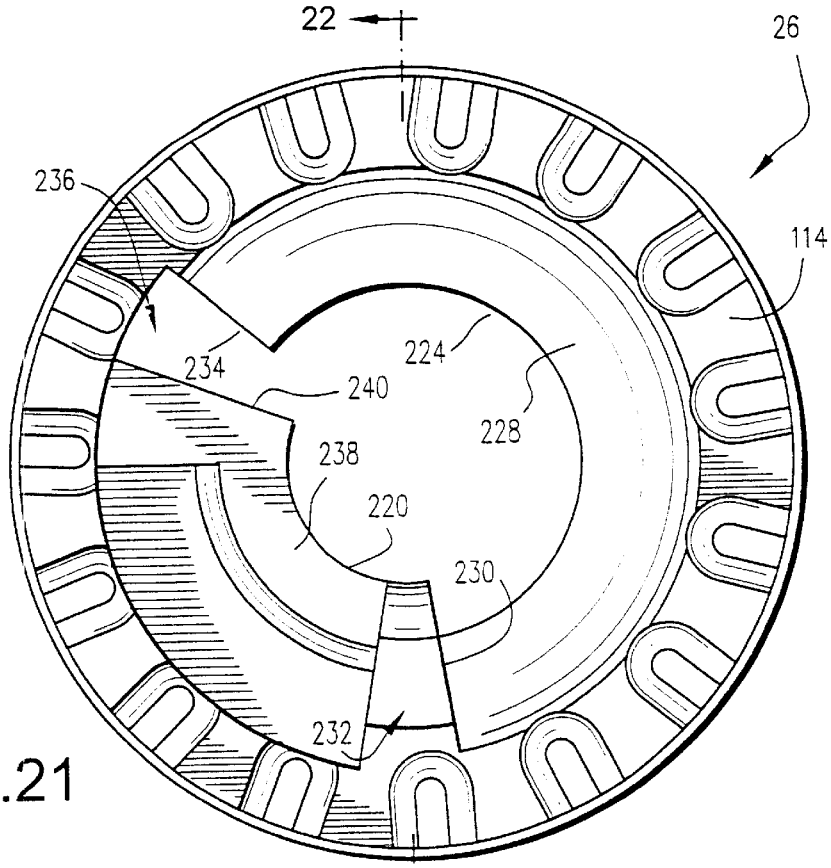
FIG. 21 is a top plan view of the nozzle component shown in FIG. 20.
Figure 22:
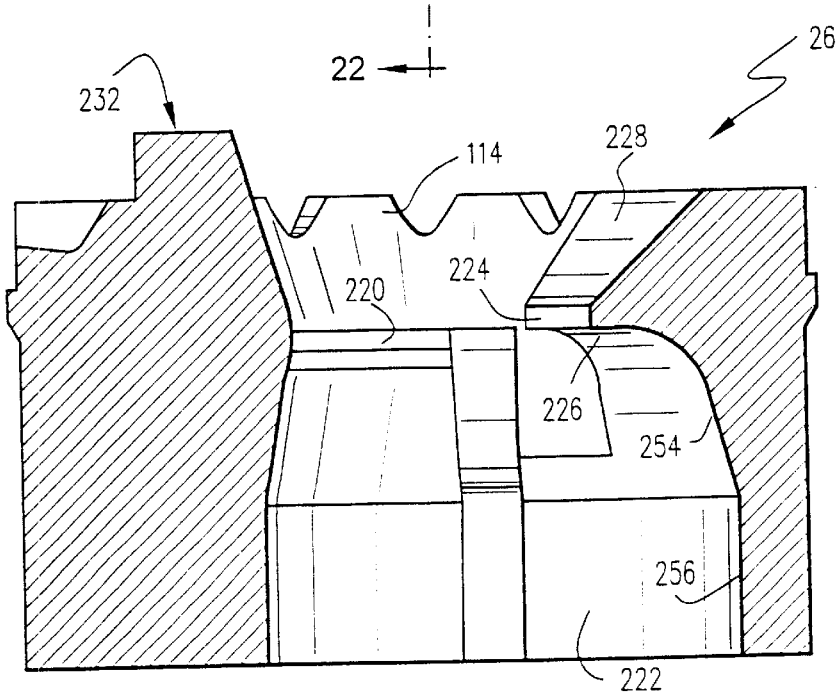
FIG. 22 is a section taken through line 22—22 of FIG. 21.
Figure 23:
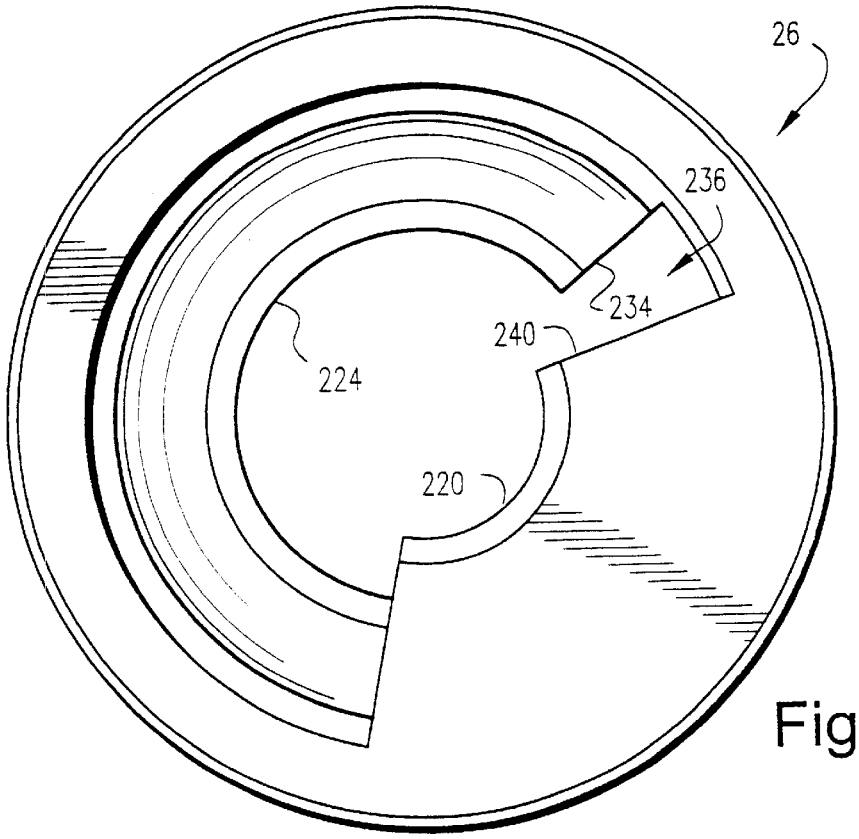
FIG. 23 is a bottom plan view of the nozzle component shown in FIG. 20.
Figure 24:
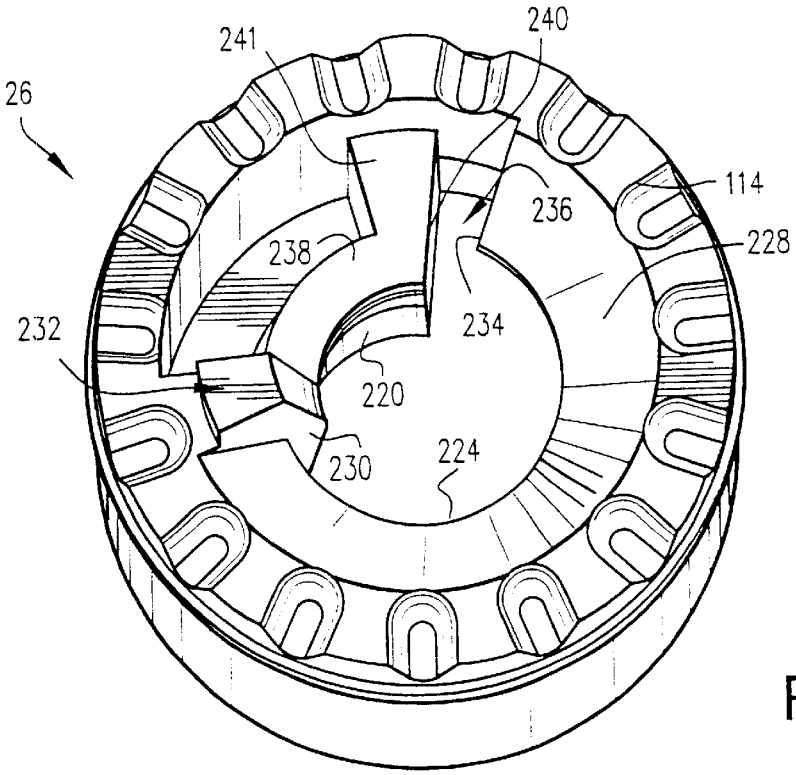
FIG. 24 is a perspective view of the nozzle component shown in FIG. 20.

With specific reference especially to FIGS. 14,16 and 18, it may be seen that the hub 198 has a substantially hourglass shape 210 above the ring 190, the hourglass shape extending from one side of the tab 206 about the 195° arcuate opening and beyond the wall surface 208 (see FIG. 15). Thus, the hourglass shape is interrupted only at a location beyond the wall 208 and above the smallest diameter portion 212 of the hourglass part 210 of the deflector. This interrupted or cut-out area is defined by a part annular surface 214 extending from an edge 216 to the opposite wall surface 218 of the tab 206. As will be explained further below, the circumferential overlap of the wall 208 by the hourglass surface insures good sealing with cooperating surfaces of the nozzle 26. Before discussing the latter in detail, it should be noted that the radially innermost portion 212 of the hourglass surface defines the radially inner edge of the water discharge orifice formed with the nozzle. Placing this inner edge as close as possible to the central axis (or shaft 20) provides the largest possible radial opening for any given flow rate, thereby enabling passage of the largest possible contaminants without plugging the discharge orifice.

FIGS. 20–24 illustrate in greater detail the nozzle 26 that is supported on the stream deflector 156 (within the stem 14) for rotation relative to the stream deflector 156. The nozzle 26 is a generally cylindrical member with a centered, axial opening that the deflector 156 and the shaft 20 pass through, with an arcuate surface 220 engaged by the hub 198 of the deflector. The nozzle has an inlet end 222 and an outlet formed by an arcuate edge 224 with a rounded undercut 226 below the edge and a radially outwardly tapering surface 228 above the edge. Arcuate edge 224 is spaced radially outwardly of deflector surface 212 to thereby define the width of the arcuate discharge orifice 259. Circumferentially, the edge 224 extends approximately 250° from a first vertical surface 230 of an upstanding tab 232, to an edge 234 of a radial opening or notch 236. Vertical surface 230 thus comprises the "adjustable edge" of the nozzle orifice. The radially inner axial contour of surface 230 substantially conforms to the hourglass-shaped portion of the stream deflector. Note that surface 220 that defines a radially inner surface of a partial hub 238 substantially completes the nozzle center opening, save the radial notch 236 that receives the vertical tab 206 of the deflector 156. The radial notch 236 is also defined by a radial wall surface 240 along a radial tab 241 of the hub 238. The nozzle shown is designed to cooperate with the deflector 156 to provide a nozzle orifice 259 of 90°–210°.

The upper annular edge of the nozzle is formed with a plurality of upwardly directed teeth 114 that mesh with the corresponding teeth 104 on the drive ring 92.

When the nozzle is in place as best seen in FIG. 3, and with the rotor plate 18, stem 14 and deflector 156 extended relative to the base 12, a gear drive is established between the arc adjustment ring 22 and the nozzle 26 by reason of the engagement of teeth 104 on the ring 92 with teeth 114 on the nozzle 26. Thus, rotation of ring 22 will rotate the nozzle 26, relative to the deflector 156 to alter the arcuate length of the water discharge orifice 259 as further described below.

When assembled as shown in FIG. 2, the nozzle 26 is seated on and seals against the surface 244 of the stream deflector 156, with an annular rib 246 on the nozzle engaging the interior wall of the stem 14 such that the nozzle can rotate relative to the deflector and the stem. Tab 206 extends upwardly through the radial notch 236 at assembly. Note that the interior surface of hub 238 of the nozzle conforms to the exterior surface of the deflector hub 198 preventing any leakage past surface 230 as the nozzle is rotatably adjusted relative to the deflector. Similarly, the radially outer edge surfaces 248, 250, 252 of the tab 206 (see FIGS. 16, 18) conform closely to undercut 226 and adjacent surfaces 254, 256 on the interior of the nozzle 26 to prevent leakage along the nozzle/deflector interface at the fixed end of the arcuate orifice 259. Rotation of the nozzle 26 relative to the deflector 156, causes nozzle surface 230 to move toward the fixed deflector surface 204, reducing the arcuate extent of the orifice. It is also important for surface 230 to extend axially upstream from the discharge orifice to the upstream end of the nozzle and downstream to the downstream end of the mating deflector surface 258 in order to smooth the water flow onto the rotor plate in a concentrated, non-turbulent manner. Note also that the axially extending cylindrical surface of the hub 198 of the stream deflector and the surfaces 256 and 254 of the nozzle interior also smooth the flow of water as it enters the nozzle orifice. Similarly, the deflecting surface 258 (the downstream end of the hourglass-shaped portion of the stem deflector) directs the flow downstream of the discharge orifice. It is this surface 258 that serves to deflect the stream emitted from the discharge orifice onto the grooves 24 of the rotor plate 18.

Figure 25:
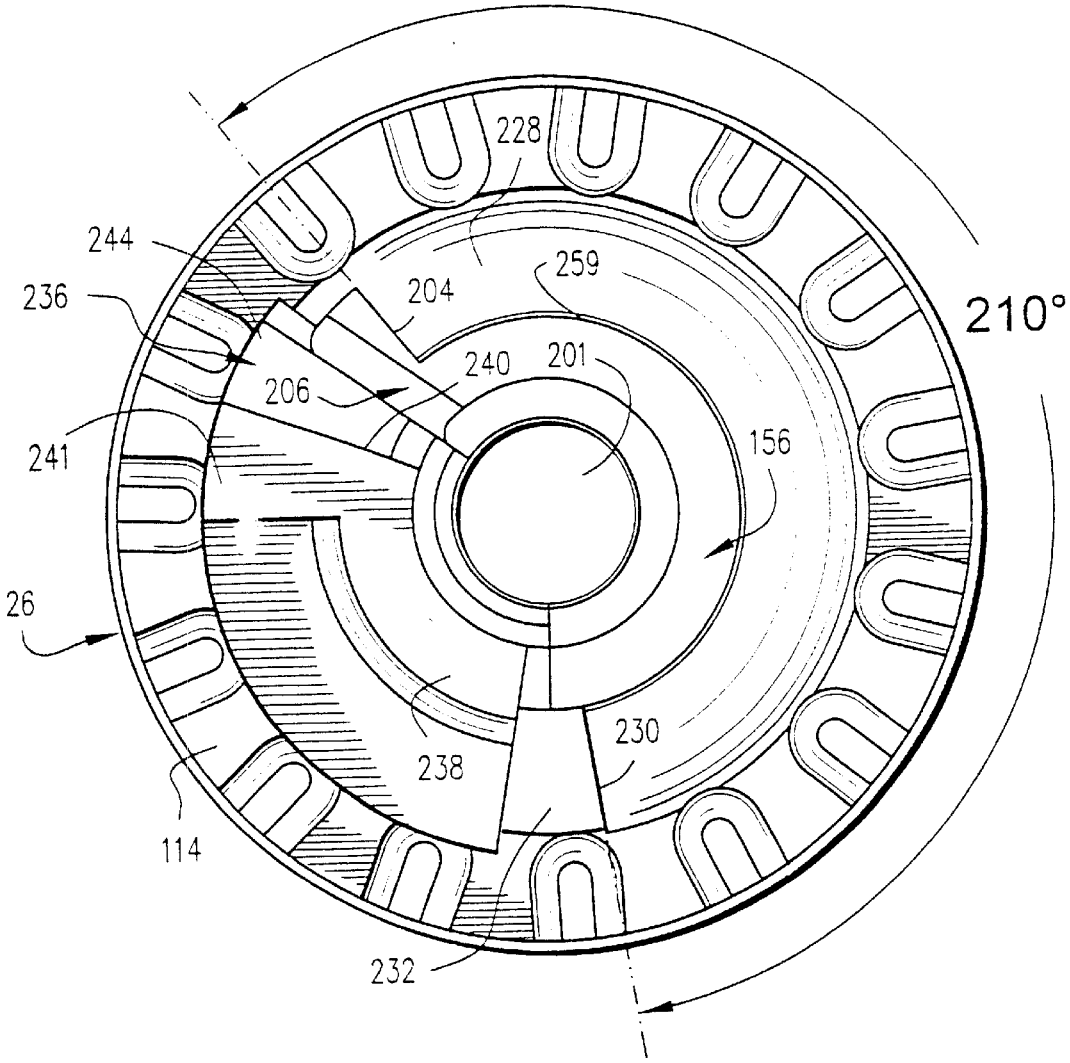
FIG. 25 is a top plan view of the deflector and nozzle arranged to provide a distribution arc of 210°.

FIG. 25 shows the nozzle 26 and stream deflector 156 in assembled position (all other components are omitted for clarity), with the nozzle 26 rotated slightly in a counterclockwise direction offsetting the radial notch 236 from the deflector tab 206 after insertion of the tab 206 through the notch 236 during assembly. This represents the maximum 210° arc for the orifice 259 as indicated in the Figure.

Figure 26:
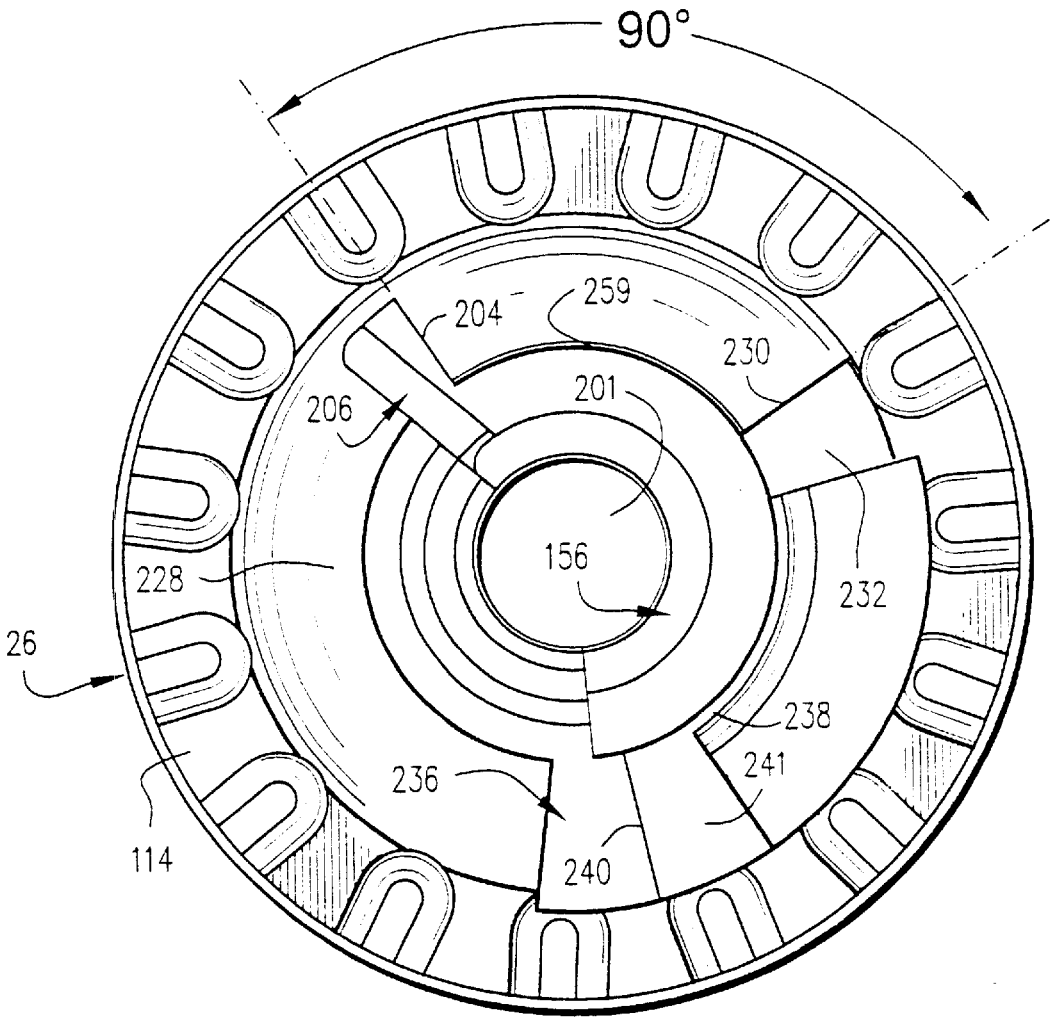
FIG. 26 is a top plan view of the deflector and nozzle as shown in FIG. 25 but adjusted to provide a distribution arc of 90°.

With further reference to FIG. 26, the nozzle 26 has been rotated further in a counterclockwise direction so that surface 230 moves toward fixed surface 204 to thereby reduce the arcuate length of the discharge orifice 259 from 210° to 90°. As explained previously, the nozzle can be rotated only when the teeth 88 on the arc adjustment ring 22 are engaged by the teeth 96 on the drive ring.

It is significant that the drive ring 92 is limited in its rotation by the vertical rib 116 that engages the edges of the two ribs 102 on the stem 14 at the arcuate limit of its travel in either direction. With reference to FIG. 9, the rib 116 on the actuator ring is located on the left of the centerline for a 90–210° head, and on the right of the centerline for a 210–270° head. Thus, for a 90°–210° configuration, the ring 22 can rotate only through the arc between adjacent edges of the pair of ribs 102 to the left of the centerline. This means that the edge 240 of the nozzle 26 cannot move beyond edge 208 of the stream deflector opening, as the result of over-rotation and thus preventing unwanted leakage of water through areas of the nozzle other than the arcuate discharge orifice.

With continuing reference to FIGS. 2 and 3 but also with reference to FIGS. 27 and 28, the sprinkler head 10 may be threadably secured to an extendable tube 260 of a conventional pop-up sprinkler device 262. The latter also includes a fixed riser or housing 264, adapted to be secured via a lower, threaded end 266 to a fitting or the like connected to a pipe that is, in turn, connected to a source of water under pressure.

The otherwise conventional pop-up mechanism 262 has an internal spring (not shown) that biases the extendable tube 260 to a retracted position where the sprinkler head 10 is essentially flush with the cap 268. When the system is turned on, the water pressure forces the tube 260 to the extended position shown in FIG. 27, against the bias of the internal spring.

As best seen in FIGS. 2 and 3, the coil spring 124 extends between the surface 122 of the stem 14 and surface 86 of the arc adjustment ring 22. Spring 124 thus exerts force on the subassembly of the stem 14, nozzle 26, deflector 156 and rotor plate 18 (the head subassembly) to bias the head subassembly to a retracted position within the base 12 as shown in FIGS. 2 and 27. In this position, a surface 19 of the rotor plate 18 engages along the surface 70 of the arc adjustment ring 22. As explained above, this arrangement, by which external forces acting on the rotor plate are transferred to the base and to the tube 260, protects the shaft 20 and other internal components. In addition, it will be appreciated that the small radial clearance between the outer diameter of the rotor plate (along a surface 21) and the axial surface 83 of the arc adjustment ring (see FIGS. 2 and 3) prevents foreign matter from lodging in this area, and that otherwise might fall into the nozzle area when the rotor plate is next extended to its operative position. Any foreign matter small enough to enter into the clearance area is also sufficiently small that it would not clog the discharge orifice 259. Note also in this regard that, as best seen in FIG. 2, the upper ends of grooves 24 in the rotor plate 18 are isolated from the engagement of the rotor plate with the arc adjustment ring.

After the pop-up tube 260 has extended as shown in FIG. 27, further pressure will cause the head subassembly to extend upwardly relative to the base 12 as shown in FIG. 28, thereby exposing the rotor plate 18 and permitting the radial distribution of the stream via grooves 24. This two-stage extension (and retraction) helps keep debris out of the area of spring 124 and around the upper end of the stem 14. Any sand or other small debris that may have migrated from the top of the rotor plate into the nozzle area is flushed from the head via the emitted stream. It is also significant that by locating spring 124 radially outside of the stem 14 and nozzle 26, it remains substantially out of the flowpath of the water through the sprinkler head, thereby increasing the cross-sectional area available for water flow.

With the head subassembly extended as shown in FIG. 28, the arc adjustment drive between the nozzle 26, drive ring 92 and arc adjustment ring 22 is engaged, thus now also permitting the user to adjust the arc between 90° and 210°. Typically, the arc would be pre-set to the smallest length, i.e., 90°, with the throttle member 178 in its wide open position. Suitable indicator means may be employed so that the user can orient the sprinkler head 10 generally to face the area to be watered. This then also alerts the user to stand behind the arc so that further adjustments to the arc and flow rate can be made without getting wet. As the arc is increased from 90°, there will be a slight drop in the radius of throw, but the precipitation rate will remain substantially constant. The flow rate adjustment further controls the radius of throw so that individual sprinklers can be adjusted to match specific pattern areas, keeping the precipitation rate substantially constant.

For non radius adjustment applications, the sprinkler head could be constructed to omit the arc adjustment ring and to hold the nozzle stationary while rotating the shaft 20 and stream deflector 156 to achieve arc adjustment.

The deflector 156 and nozzle 26 shown in the drawings are for a 90–210° head. For a 210–270° head, it will be appreciated that the deflector and nozzle require appropriate modification to provide the larger discharge orifice.

Figure 29:
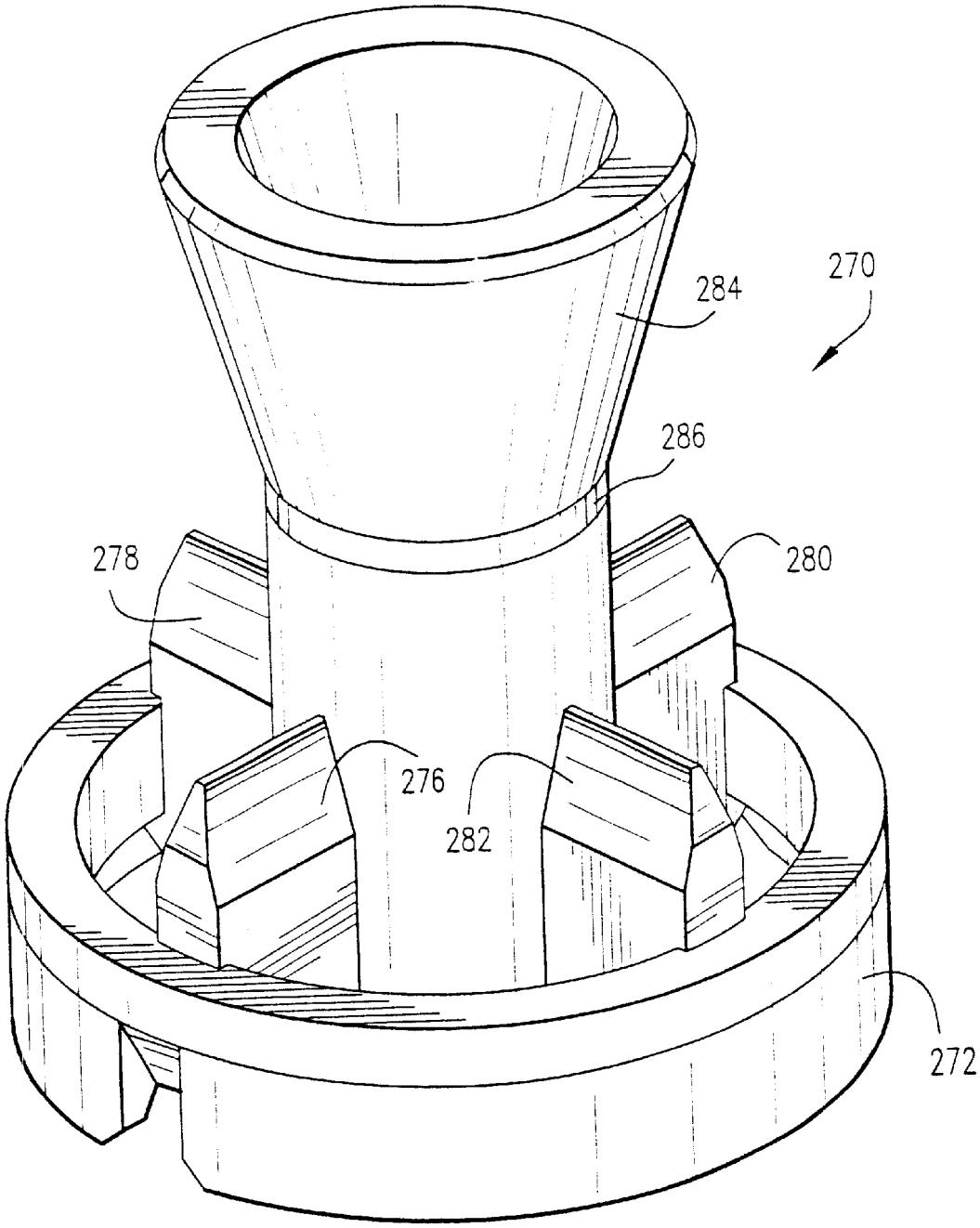
FIG. 29 is a perspective view of a stream deflector component in accordance with an alternative embodiment of the invention.
Figure 30:
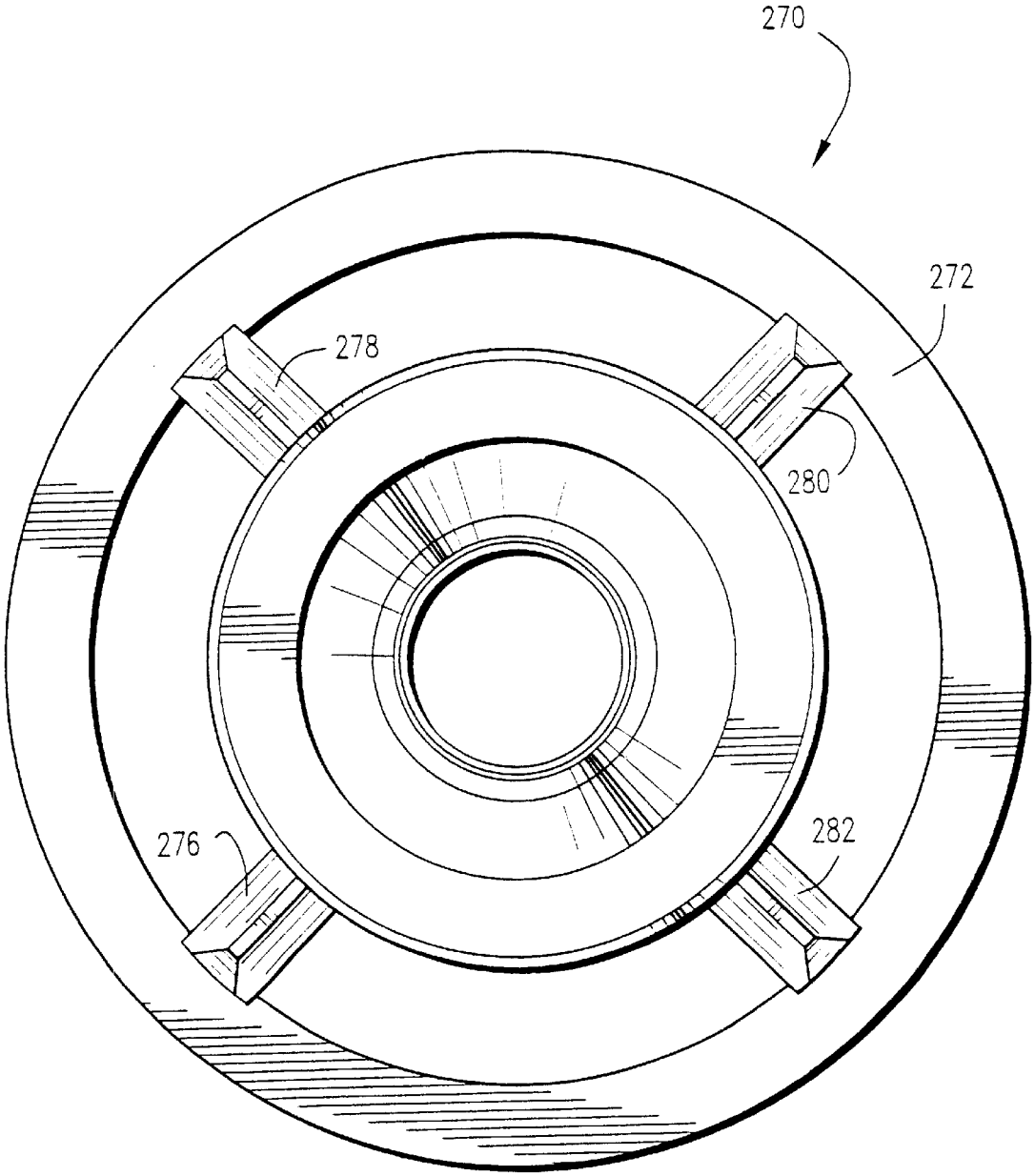
FIG. 30 is a top plan view of the stream deflector component shown in FIG. 29.
Figure 31:
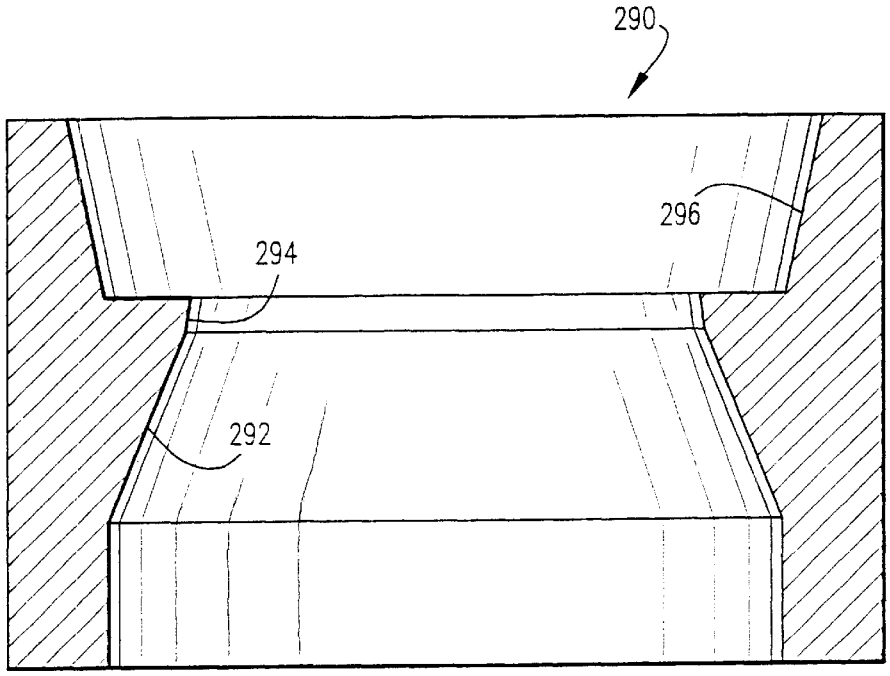
FIG. 31 is a side elevation of a nozzle in accordance with an alternative embodiment of the invention.

It is also possible in accordance with another embodiment of this invention to provide a 360° head, with adjustment of the flow rate, and hence throw radius adjustment, as previously described, but without any adjustment of the arc. With reference to FIGS. 29–31, a deflector and nozzle combination are illustrated for enabling a full 360° arc of coverage. The deflector 270 includes an outer ring 272 otherwise similar to ring 190 on deflector 156, but with the entire lower or tail end omitted. In addition, the opening between ring 272 and center hub 274 extends a full 360°, with connecting web or spokes 276, 278, 280 and 282 connecting the ring to the hub. No fixed arc edges are required, so that the deflecting surface 284 extends a full 360°, as does the radially inner edge surface 286 of the discharge orifice. The corresponding nozzle 290 is shown in FIG. 31. The nozzle includes a tapered inlet 292 and a smooth, 360° interior edge 294 that cooperates with surface 286 on the deflector to define the 360° discharge orifice. A tapered surface 296 on the downstream side of the orifice corresponds to surface 228 on nozzle 26. With this arrangement, no arc adjustment is possible, but, of course, flow rate adjustment is available as described above.

It will be appreciated that the nozzle and stream deflector components could be modified to provide interchangeable, non-adjustable part circle arcs if the adjustability feature is otherwise not required.

Figure 32:
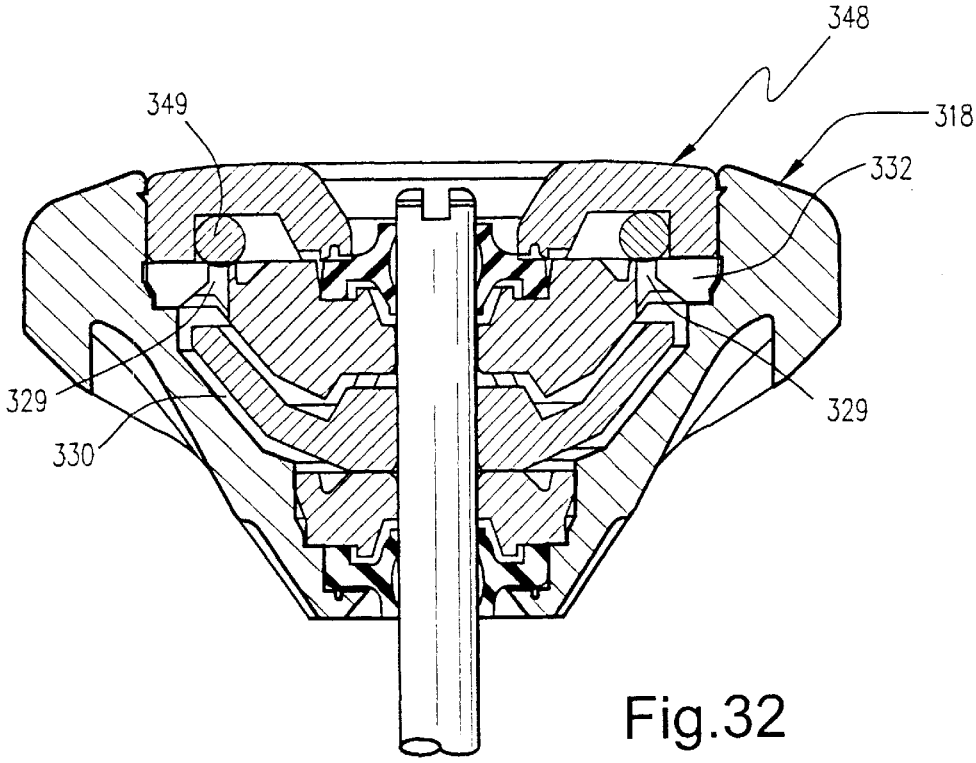
FIG. 32 is a cross section through a rotor plate in accordance with another exemplary embodiment of the invention.

FIG. 32 shows a modified rotor plate 318 that is similar to rotor plate 18, but the upper bearing 332 has been modified to include two (or more) axially oriented holes 329 that allow air to escape chamber 330 during assembly of the upper bearing, and move into the area between the bearing and the retainer 348. After the bearing is in place, an O-ring 349 is used to seal the holes 329 to prevent any viscous fluid from escaping the chamber 330.

Figure 34:
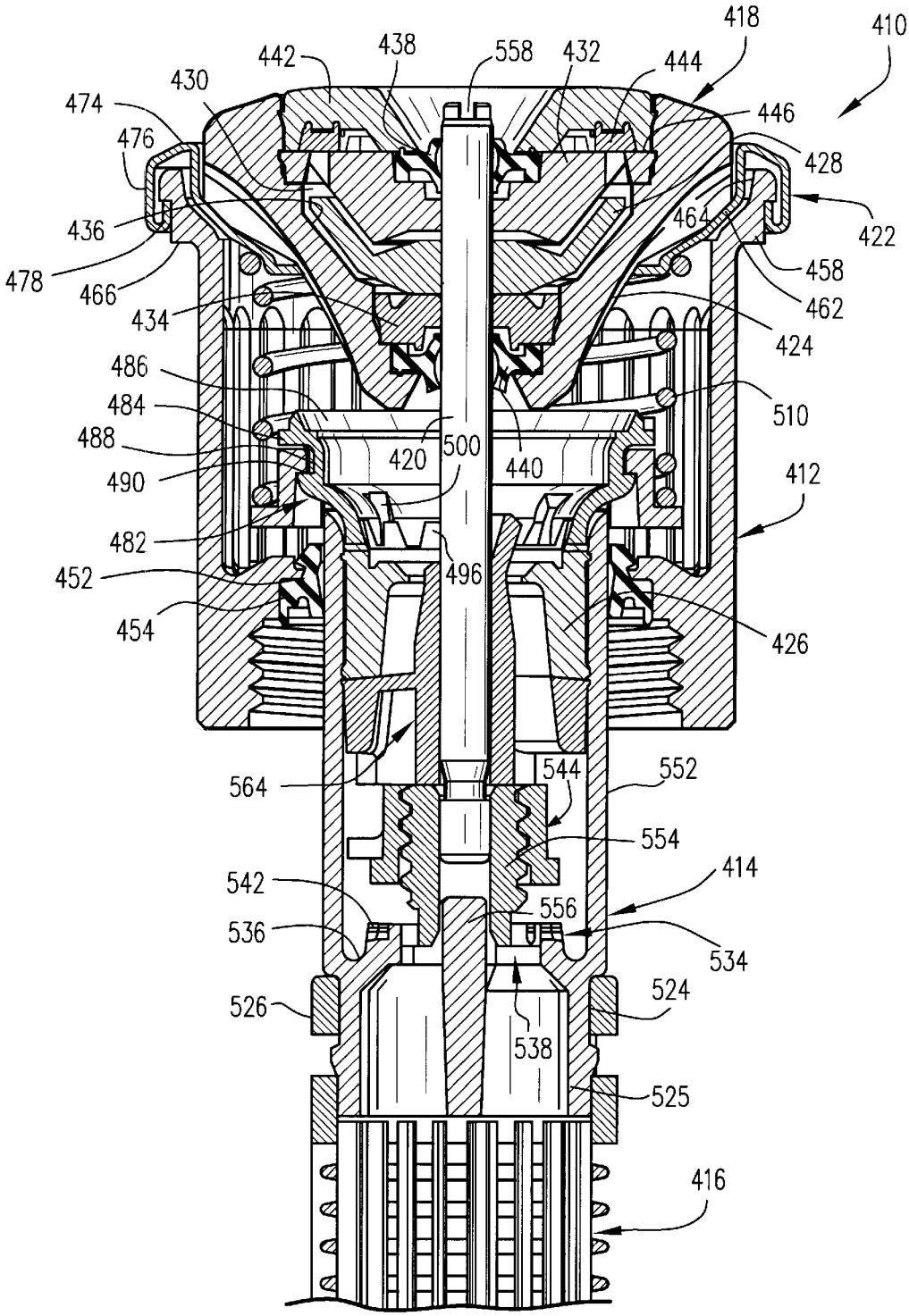
FIG. 34 is a cross sectional view of a sprinkler head in accordance with another embodiment of the invention.

A sprinkler head in accordance with a presently preferred embodiment appears in FIG. 34. Except for differences made apparent from the description below, the interaction of the components remains as described above.

Specifically, as shown in FIG. 34, the sprinkler head 410 generally includes a base or housing 412 and a stem 414, with a conventional filter 416 attached to the lower end of the stem. The base 412 is adapted to be threadably attached to a pressurized water source as described above. A water distribution plate 418 (or "rotor plate") is mounted in the base 412, via a flow rate or throttle adjustment shaft 420 that projects through the plate 418 and extends into the stem. A rotatable arc adjustment ring 422 is secured to the top of the base 412.

The rotor plate 418 is mounted for rotation relative to the normally stationary shaft 420. Externally, the rotor plate 418 is formed with a series of generally radially oriented water distribution grooves 424 that are similar to grooves 24 in FIG. 2. The grooves 424 also have lowermost entrance points that are preferably radially spaced from the shaft 420 in order to catch and distribute the stream emanating from the nozzle 426 in the same manner as previously described.

The rotational speed of the rotor plate 418 in this embodiment may also be slowed by a viscous dampening mechanism or "motor" (or "viscous retarder") that includes a generally cup-shaped stator 428 fixed to the shaft 420. The stator is located in a chamber 430 defined by upper and lower bearings 432, 434 as well as the interior surface 436 of the rotor plate 418. The chamber 430 is filled or partially filled with a viscous fluid (preferably silicone) that exhibits viscous shear as the rotor plate 418 rotates relative to the fixed stator 428, significantly slowing the rotational speed of the rotor plate as compared to a rotational speed that would be achieved without the viscous dampening motor. The viscous shearing action is enhanced by the shape of the upper bearing 432, the lower portion of which fits within, but remains spaced from, the cup-shaped stator 428. The construction of the viscous motor is substantially identical to the viscous motor illustrated in FIG. 2.

Upper and lower annular seals 438, 440 are similar to seals 38, 40, respectively and are mounted on the shaft 420 to prevent leakage of silicone fluid out of the chamber 430, along the shaft 420. A cap or retainer 442 is press fit into the plate 418, with a seal ring 444 engaging an upper surface 446 of the upper bearing 432 to provide additional sealing of chamber 430.

Figure 35:
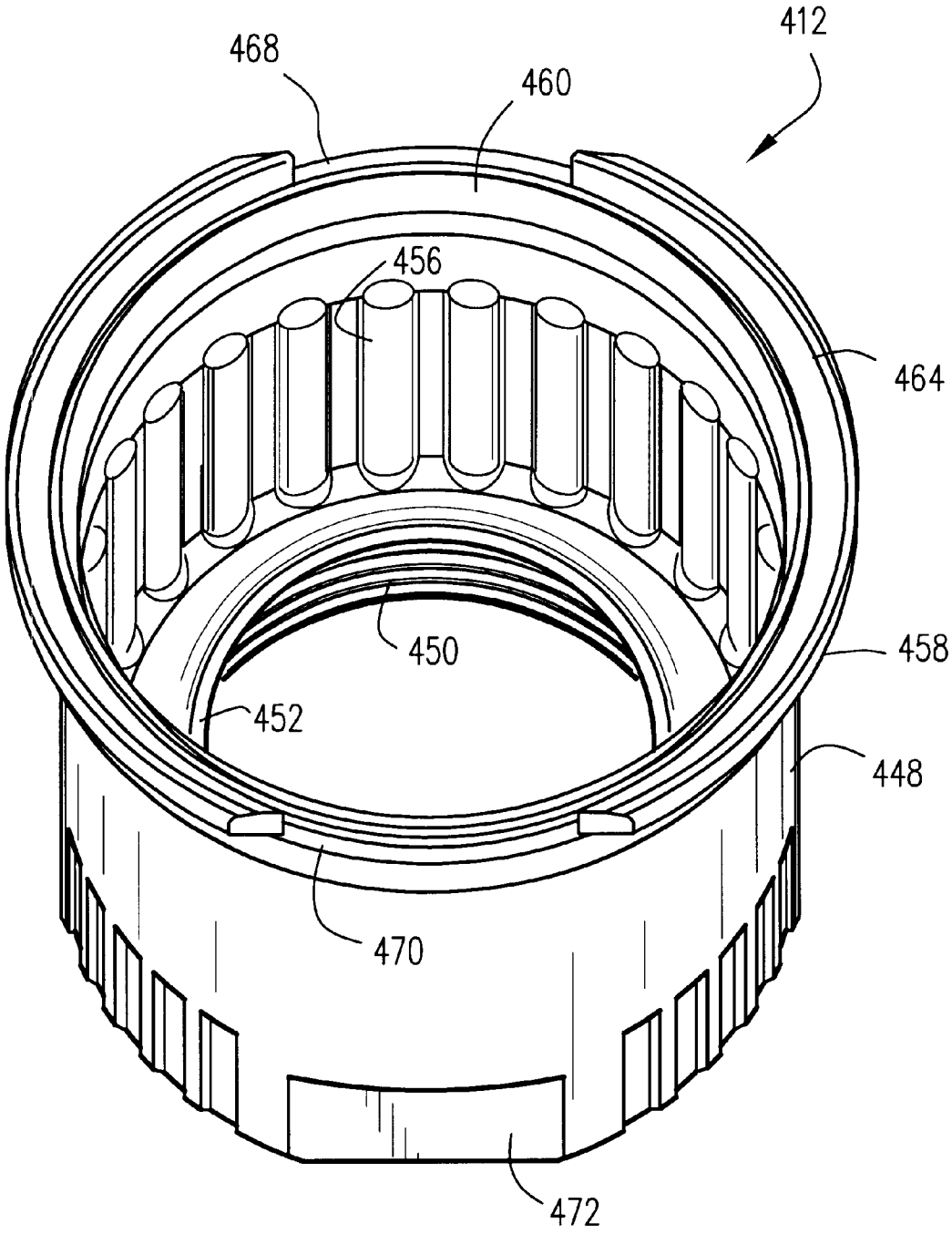
FIG. 35 is a perspective view of a base element of the sprinkler head in FIG. 34.

With reference also to FIG. 35, the base 412 includes a substantially cylindrical sleeve-like member 448 that is formed with an internally threaded inlet 450 by which the sprinkler head 410 may be attached to, for example, a conventional pop-up assembly or other sprinkler component. The inlet 450 also includes a radially in-turned edge 452 that serves as an annular seat for a seal 454. A substantial portion of the base 412 is formed on its interior surface with a plurality (24 in the illustrated embodiment) of circumferentially spaced, axially extending ribs or flutes 456. The upper end of the base 412 is diametrically enlarged via a radial flange 458 that includes a radially outwardly and upwardly tapered surface 460 that serves as a seat for a similarly tapered surface 462 on the arc adjustment ring 422 when the rotor plate 418 is in the retracted, inoperative position shown in FIG. 34.

Surface 460 merges with a less sharply tapered rim 464 that has an undercut on its outer side to facilitate retention of the arc adjustment ring 422 as in the embodiment shown in FIGS. 2 and 3. A radial shoulder 466 is adapted to engage an annular surface on the pop-up sprinkler body. As explained further below, the axially extending internal ribs or flutes 456 on the base 412 are utilized to normally prevent rotation of the stem 414 relative to the base 412, but to permit such rotation upon the application of torque to the arc adjustment ring 422 over and above that required to adjust the pattern arc (also referred to herein as a "click adjust" feature), in order to properly orient the pattern itself. Discontinuities or cut-outs 468, 470 in the rim 464 and flat 472 at the lower end of the base are provided for orienting the base during assembly.

Figure 36:
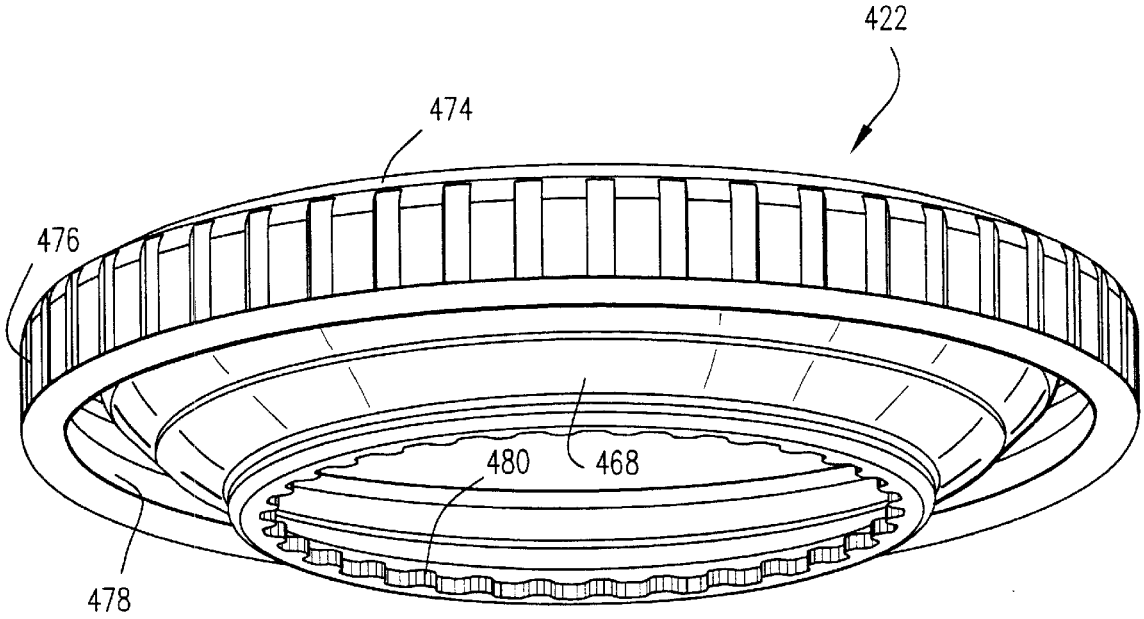
FIG. 36 is a perspective view of an arc adjustment control ring from FIG. 34.

The arc adjustment ring 422 shown in FIGS. 34 and 36 includes an upper radially outturned rim 474 that is adapted to fit over the upper rim 464 of the base 412. Rim 474 includes a depending skirt 476 that forms the outer diameter of the ring 422. The lower end of skirt 476 is provided with a radially in-turned curl 478 engaged in the undercut below rim 464 such that the arc adjustment ring 422 is rotatable, but otherwise axially fixed relative to the base 412. The previously described tapered surface 468 extends downwardly and inwardly to an annular row of radially inwardly facing (or horizontally projecting) gear teeth 480 that are used in the implementation of the arc adjustment capability as described further below.

Figure 37:
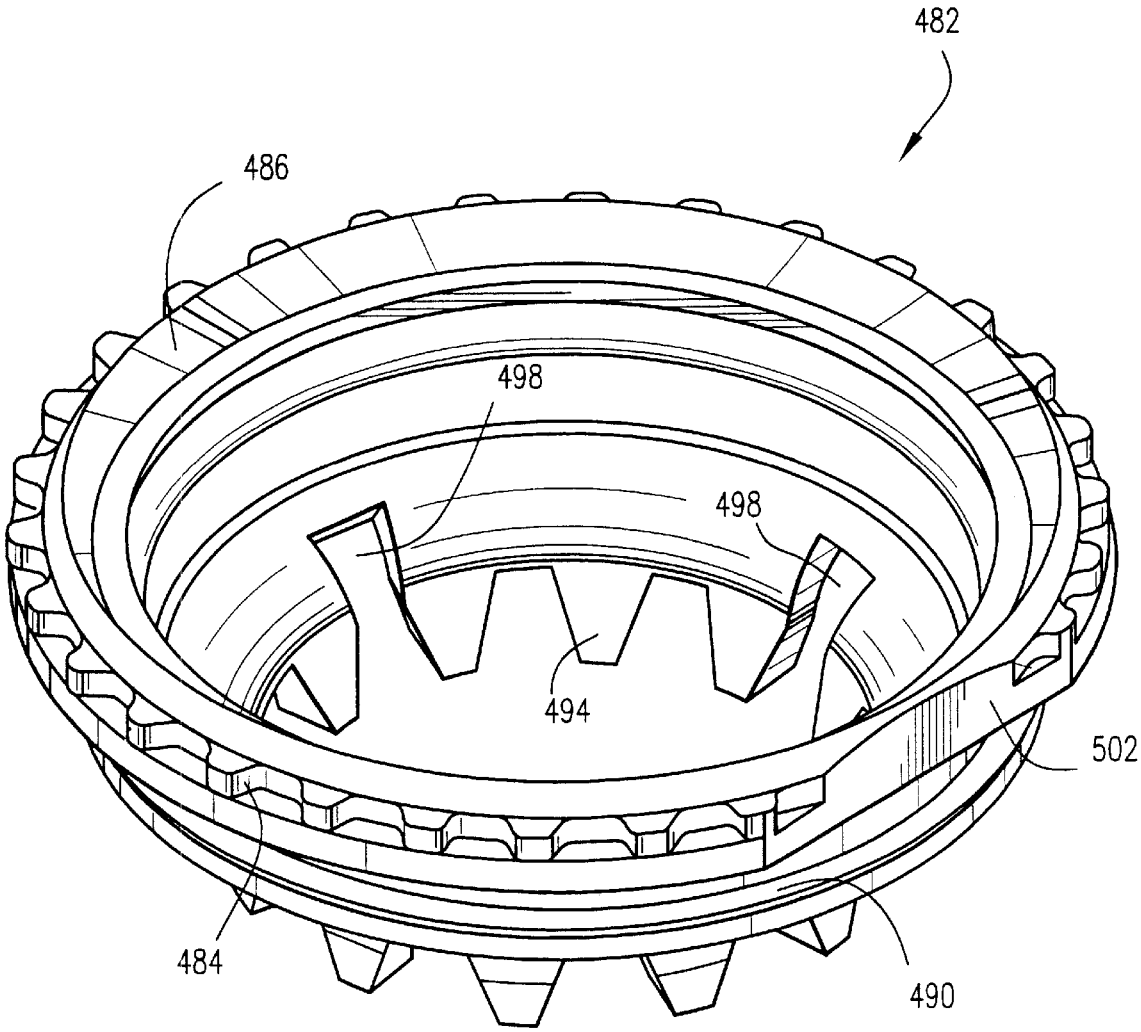
FIG. 37 is a perspective view of a drive ring taken from the sprinkler head illustrated in FIG. 34.
Figure 38:
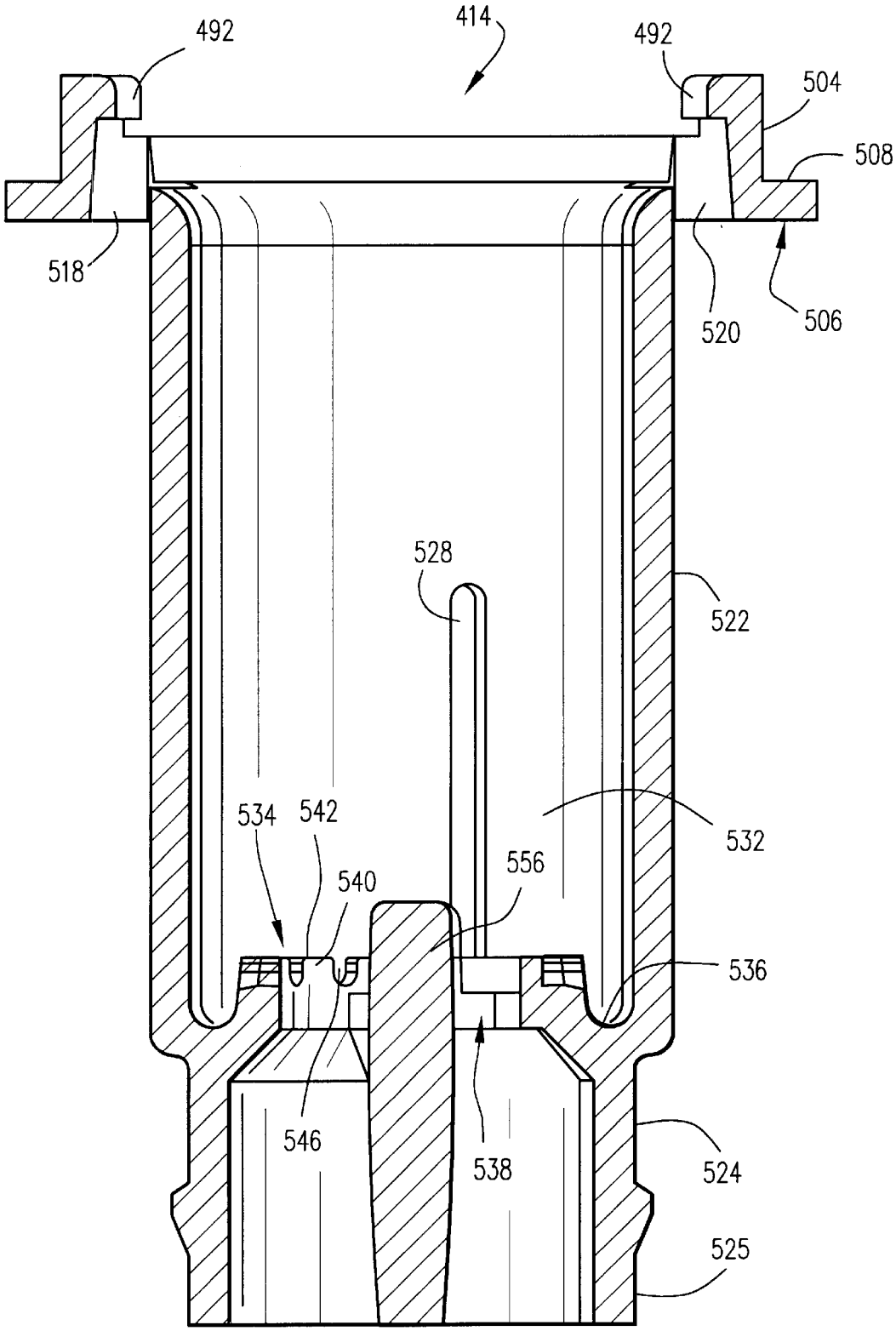
FIG. 38 is a cross sectional view of a stem component taken from the sprinkler head illustrated in FIG. 34.
Figure 39:
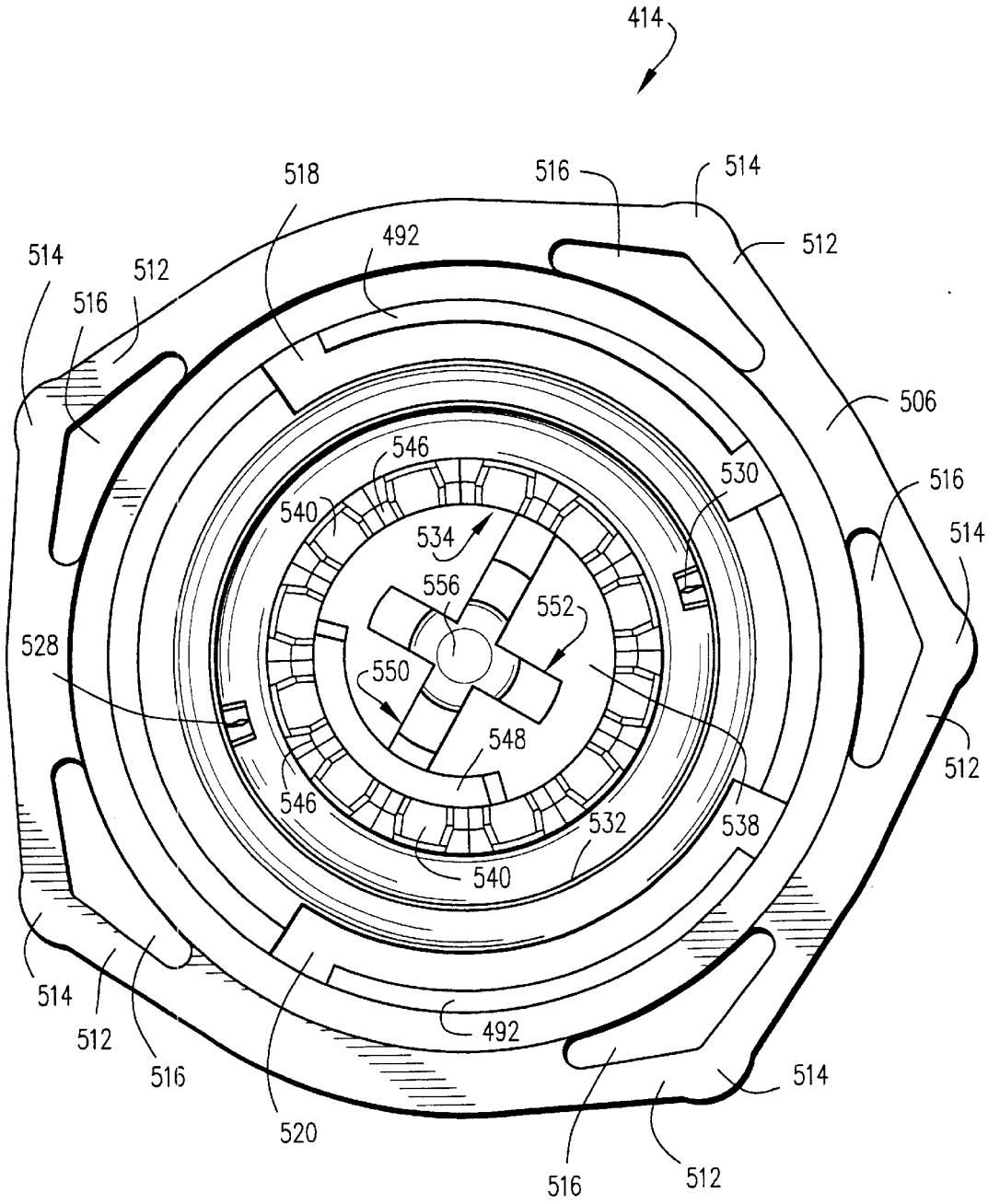
FIG. 39 is a top plan view of the stem shown in FIG. 38.
Figure 40:
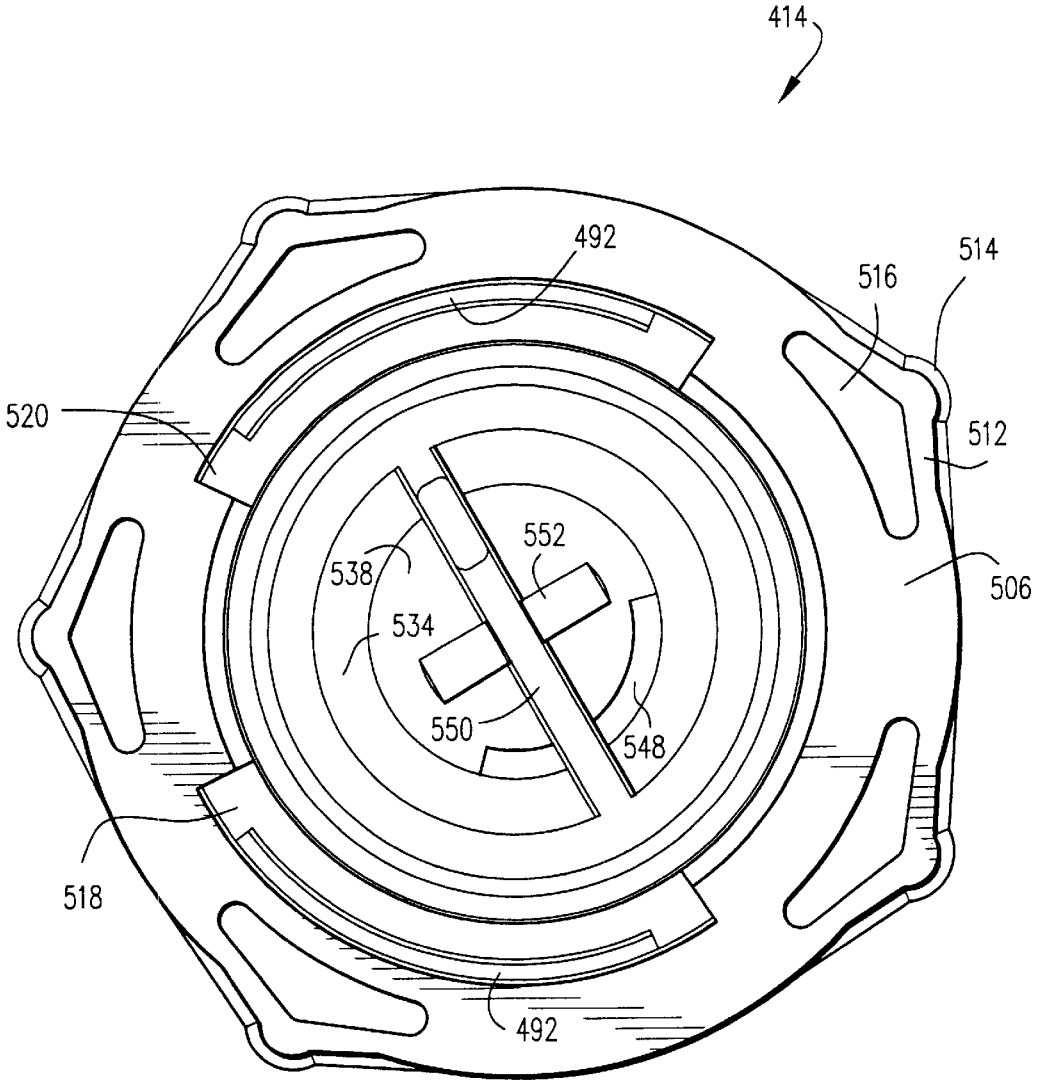
FIG. 40 is a bottom plan view of the stem illustrated in FIG. 38.
Figure 41:
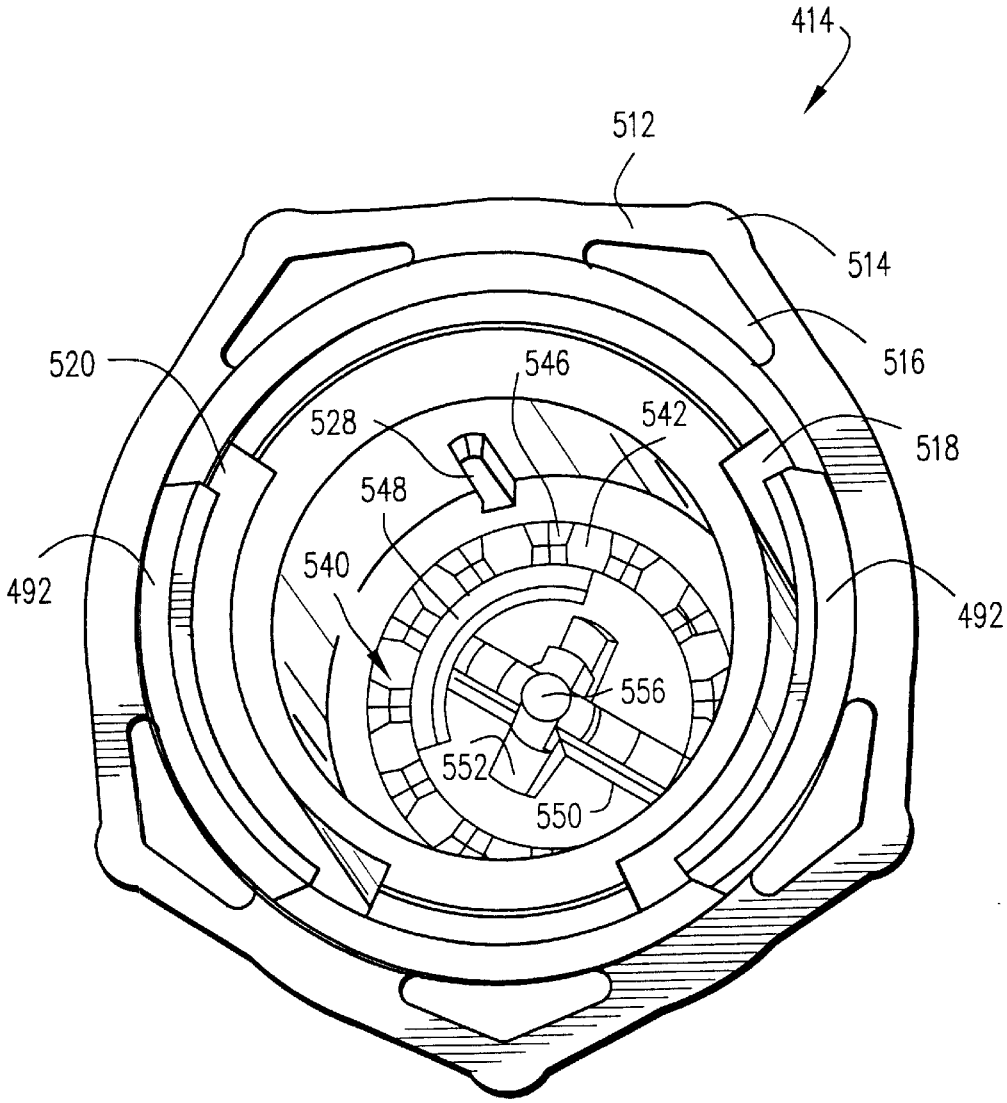
FIG. 41 is a perspective view of the stem shown in FIG. 38.

With reference now to FIG. 37, and with continuing reference to FIG. 34, an arc adjustment actuator or drive ring 482 is axially interposed between the arc adjustment ring 422 and the nozzle 426. The drive ring 482 is formed with a first radially outwardly facing annular row of teeth 484 that are adjacent and below a conically-shaped upper rim 486. An annular undercut or groove 488 on the outer surface of the ring provides a seat or shoulder 490 adapted to receive radially inwardly directed ribs 492 on the stem 414 (FIGS. 34, 40 and 41). A second annular row of teeth 494 project downwardly from the lower end of the ring, spaced radially inwardly of the upper row of teeth 484.

Figure 48:
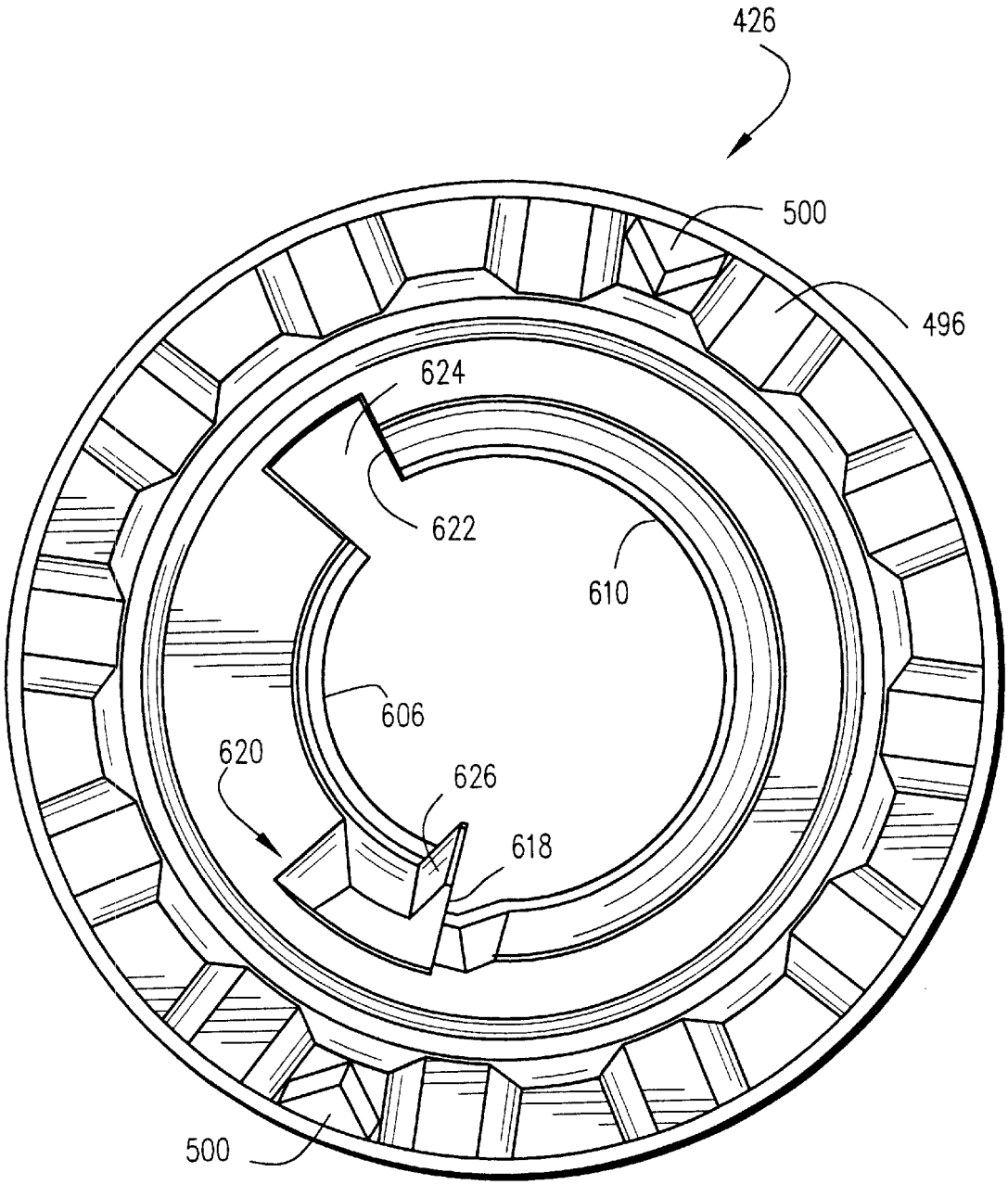
FIG. 48 is a top plan view of a nozzle component taken from FIG. 34.
Figure 49:
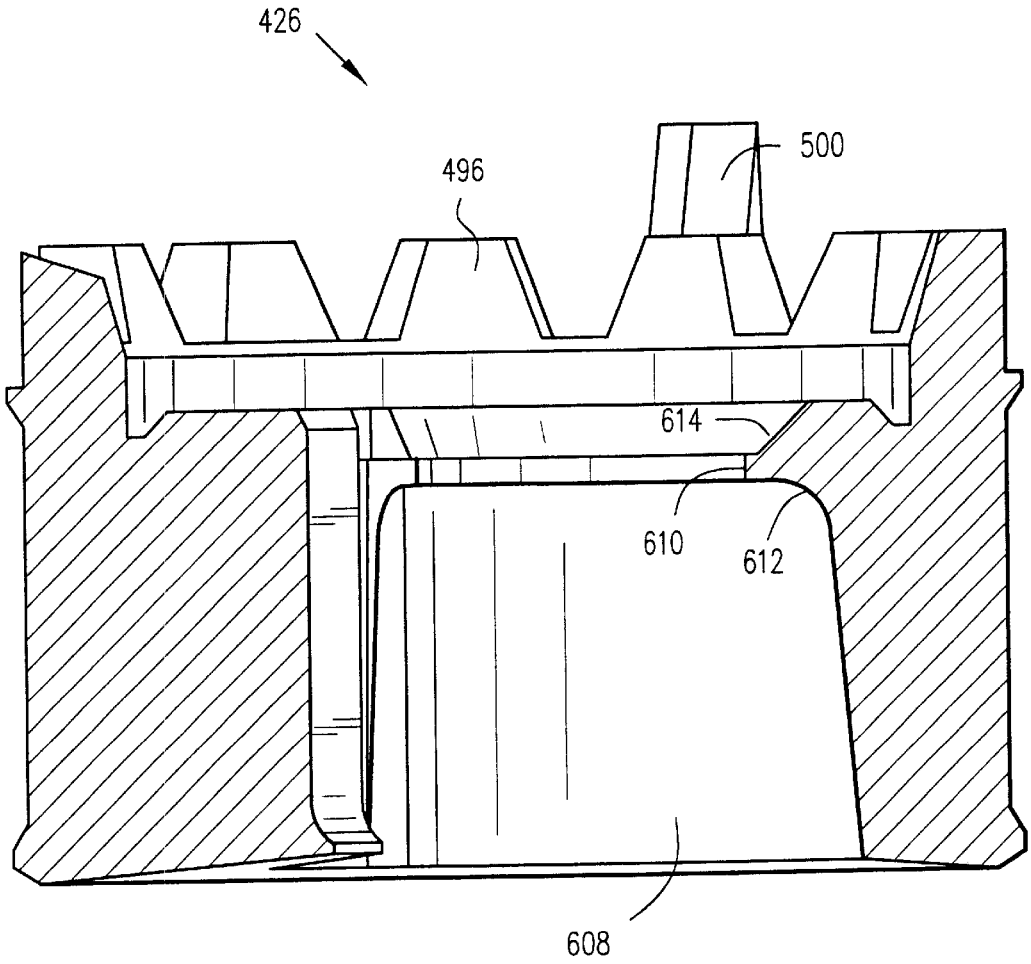
FIG. 49 is a cross sectional view of the nozzle shown in FIG. 48.
Figure 50:
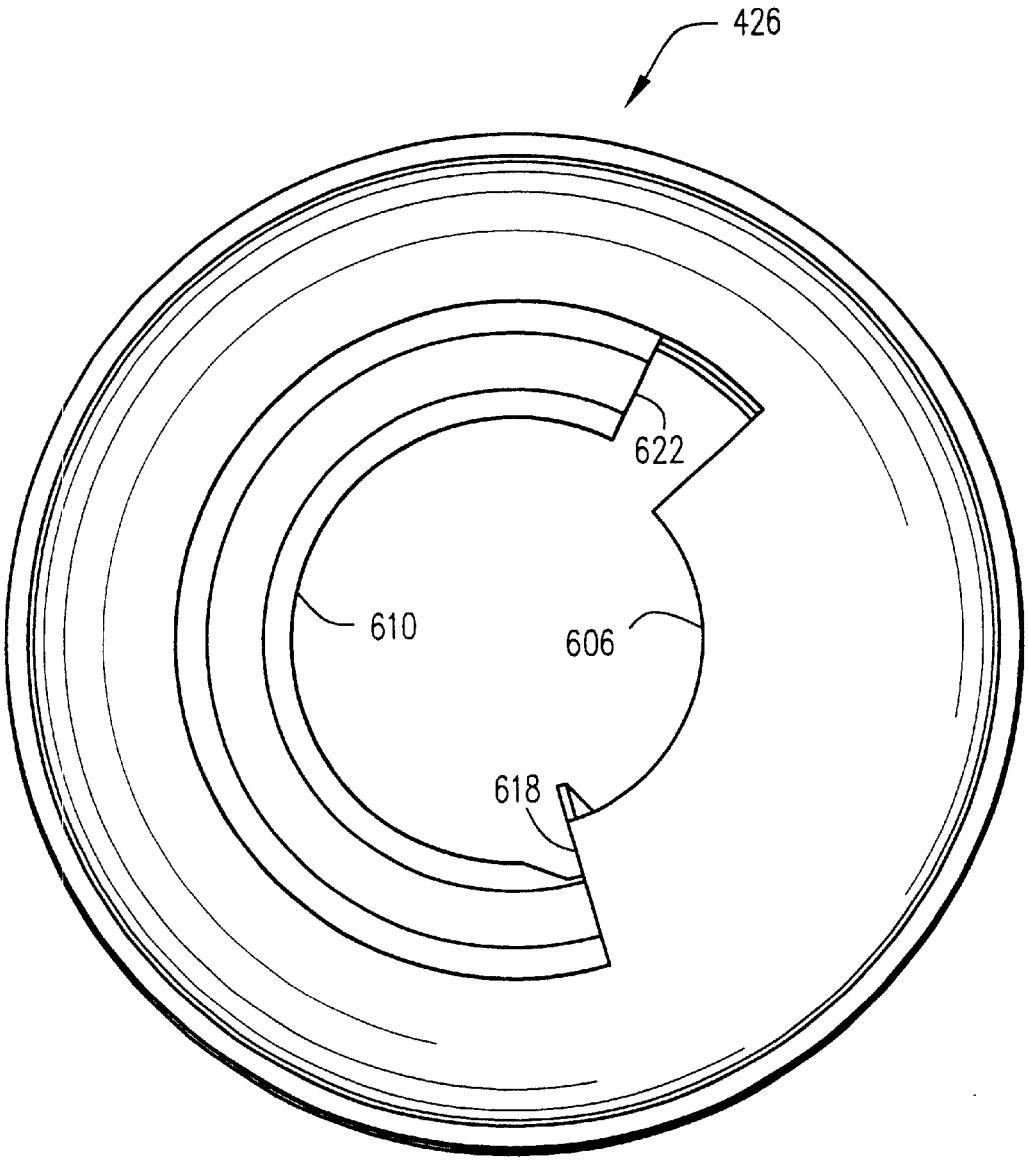
FIG. 50 is a bottom plan view of the nozzle shown in FIG. 49.
Figure 51:
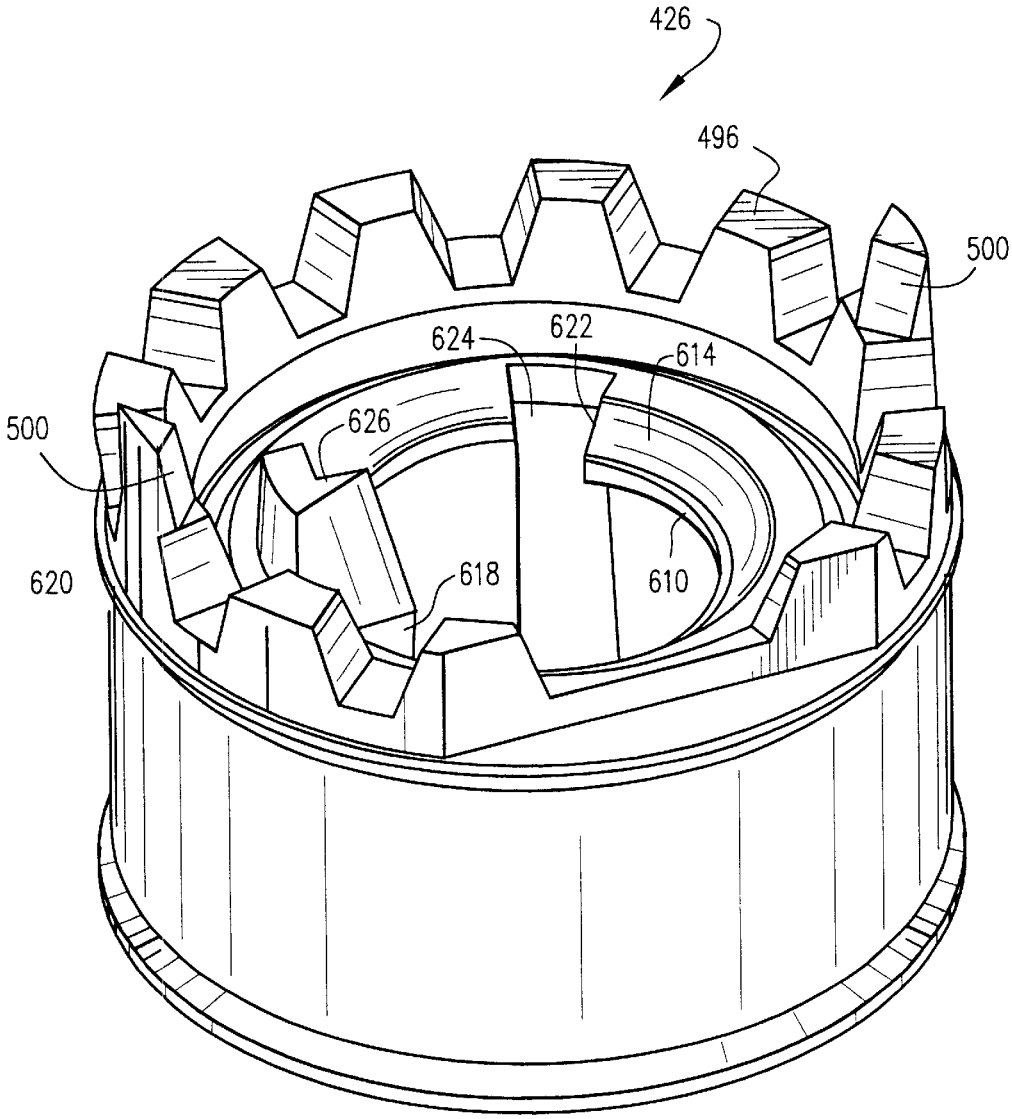
FIG. 51 is a perspective view of the nozzle shown in FIGS. 48–51.

The upper horizontally oriented row of teeth 484 are adapted to mesh with the row of teeth 480 on the arc adjustment ring 422, but only when the rotor plate 418 and stem 414 are extended relative to the base. The lower vertically oriented row of teeth 494 is adapted to always mesh with an upper row of teeth 496 on the nozzle 426 as described further below. Just below the annular seat 488 are four, circumferentially equally spaced windows 498 that are located directly above corresponding ones of the teeth 496 on the nozzle. In other words, these windows 498 are, in fact, extensions of the spaces between the lower row of teeth 494. These spaces or windows 498 are adapted to receive tabs 500 that extend upwardly from a pair of diametrically opposed teeth 496 (see also FIGS. 48, 49). These tabs 500 and windows or recesses 498 assure correct orientation of the drive ring 482 relative to the nozzle 426.

A vertical rib (not shown, but similar to rib 116 in FIG. 8) in the groove 448 limits rotation of the ring 422 and nozzle 426 by engaging a selected edge of one of the radially inwardly directed ribs 492. As will be explained further below, this rib limits the rotation of the nozzle 426. Because the position of the limiting rib on the drive ring 482 is thus related to the nozzle orifice, it will be appreciated that the nozzle and drive ring must be properly oriented on assembly. Thus, for a nozzle with adjustability through a range of 90°–210°, the tabs 500 on the nozzle will seat in one pair of windows 498 while for a nozzle with a greater range, e.g., up to 270°, the tabs 500 will seat in the other pair of windows. This arrangement permits one drive ring configuration to be used with different nozzles. The flat 502 at the upper end of the drive ring (see FIG. 37), also facilitates automated assembly with the stem 414.

FIGS. 38–41 illustrate the stem 414 in further detail. This stem is generally similar to stem 14 with changes noted below. As already mentioned, the stem 414 is formed at its upper end with a pair of circumferentially spaced, radially inwardly directed, arcuate ribs 492. These ribs extend from an outer cylindrical wall 504 that extends downwardly to a radial flange 506 that provides a seating surface 508 for a coil spring 510 (see FIG. 34). The flange 506 includes a plurality of circumferentially spaced, laterally extending spring tabs 512 that are unequally spaced about the flange 506. Specifically, the spring tabs 512 and associated rounded tips 514 are spaced to insure that each of the five tips 514 will be seated between respective pairs of the twenty-four flutes 456 in the base 412. As further described below, it is the interaction of spring tabs 512 with the flutes 456 that permit the sprinkling pattern to be reoriented even though the sprinkler head is attached to a fixed riser or other sprinkler component. In this regard, the openings 516 adjacent the spring tabs allow the latter to flex as they rotate past the flutes 456 on the stem during pattern reorientation, while allowing the base per se to remain rigid.

As in the first described embodiment, in order to form the arcuate, radially inwardly directed ribs 492, slots 518, 520 are formed at the root of the corresponding flange 506, thus permitting access by forming tools during manufacture.

Below flange 506, the stem 414 is made up of a substantially cylindrical tubular portion 522, with a lower end having an annular groove 524 and a reduced diameter inlet portion 525. Groove 524 is adapted to receive an upper end 526 of the filter 416 in snap-fit relationship. Interiorly, the tubular portion 522 is formed with a pair of diametrically opposed, axially extending ribs 528, 530, extending radially inwardly from the interior surface 532 of the tubular portion 522.

Ribs 528, 530 terminate at their lower ends at a location adjacent and above the annular groove 524, where an upstanding, internal ring 534 joins to the internal surface 532 via an annular trough 536. The ring 534 thus defines a constricted opening 538 within the reduced diameter inlet portion 525 of the stem. The ring 534 is formed with a plurality of circumferentially spaced upstanding teeth 540, upper surfaces 542 of which provide a seat for the throttle control member 544. It will be appreciated that the spaces 546 between the teeth 540 permit water to pass through the inlet opening 538 and into the stem even when the throttle member is in its fully closed position, i.e., when seated on surfaces 542. As in the previously describe embodiment, this arrangement prevents stalling of the rotor plate.

Note also the part-annular flow restricting flange 548 within the inlet opening 538. The flange 548 serves much like the tail end 186 of stream deflector 156 (FIGS. 2, 3, 14) to reduce the sensitivity of the throttling action. As will be discussed below, there is no tail end on the stream deflector component in this embodiment.

The cross-web 550 and shortened cross piece 552 remain substantially as in the earlier embodiment, providing a seat for the throttle sleeve 554, with the raised center boss 556 extending into the hollow sleeve to maintain the shaft 420 and throttle sleeve 554 centered in the stem.

As in the previously described embodiment, the shaft 420 extends downwardly through the nozzle 426 and through the stream deflector 564. The lower end of the shaft is provided with the externally threaded throttle sleeve 554 that is pressed onto (or otherwise secured to) the shaft 420 so as to be fixed thereto. The sleeve rests on the cross web 550 and shortened cross piece 552 as described previously. The internally threaded throttle control member 544 is threadably received on the axially fixed sleeve 554, such that rotation of the shaft 420 causes the throttle control member 544 to move toward or away from the seating surfaces 542 of the teeth 540, depending upon the direction of the rotation of the shaft. A slot 558 (FIG. 34) at the top of the shaft 420 enables rotation of the shaft by a screw driver or similar tool.

The manner in which the throttle control member 544 moves toward or away from the seat (teeth 540) on rotation of the shaft 420 via tool slot 558 remains as in the previously described embodiments. The flow rate reaches a minimum when the throttle control member is seated on the teeth 540. In this position, however, there is still sufficient flow between the teeth, through spaces 546, stem 414 and nozzle 426 to rotate the rotor plate 418, albeit at a reduced speed. This arrangement prevents the device from stalling, i.e., from stopping when the flow rate is significantly reduced. Note again that shaft 420 is stationary during normal operation, and is rotatable only to adjust the flow rate.

Figure 42:
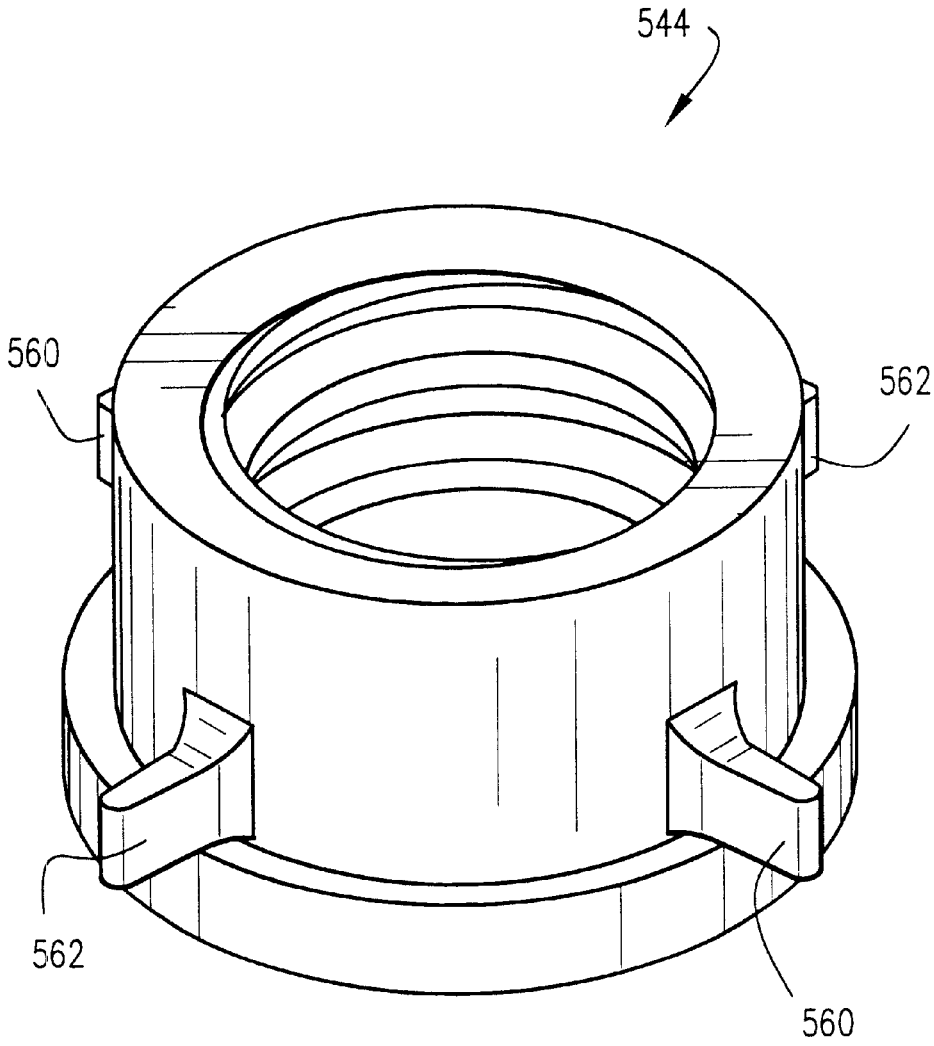
FIG. 42 is a perspective view of a throttle control member taken from the sprinkler head in FIG. 34.
Figure 43:
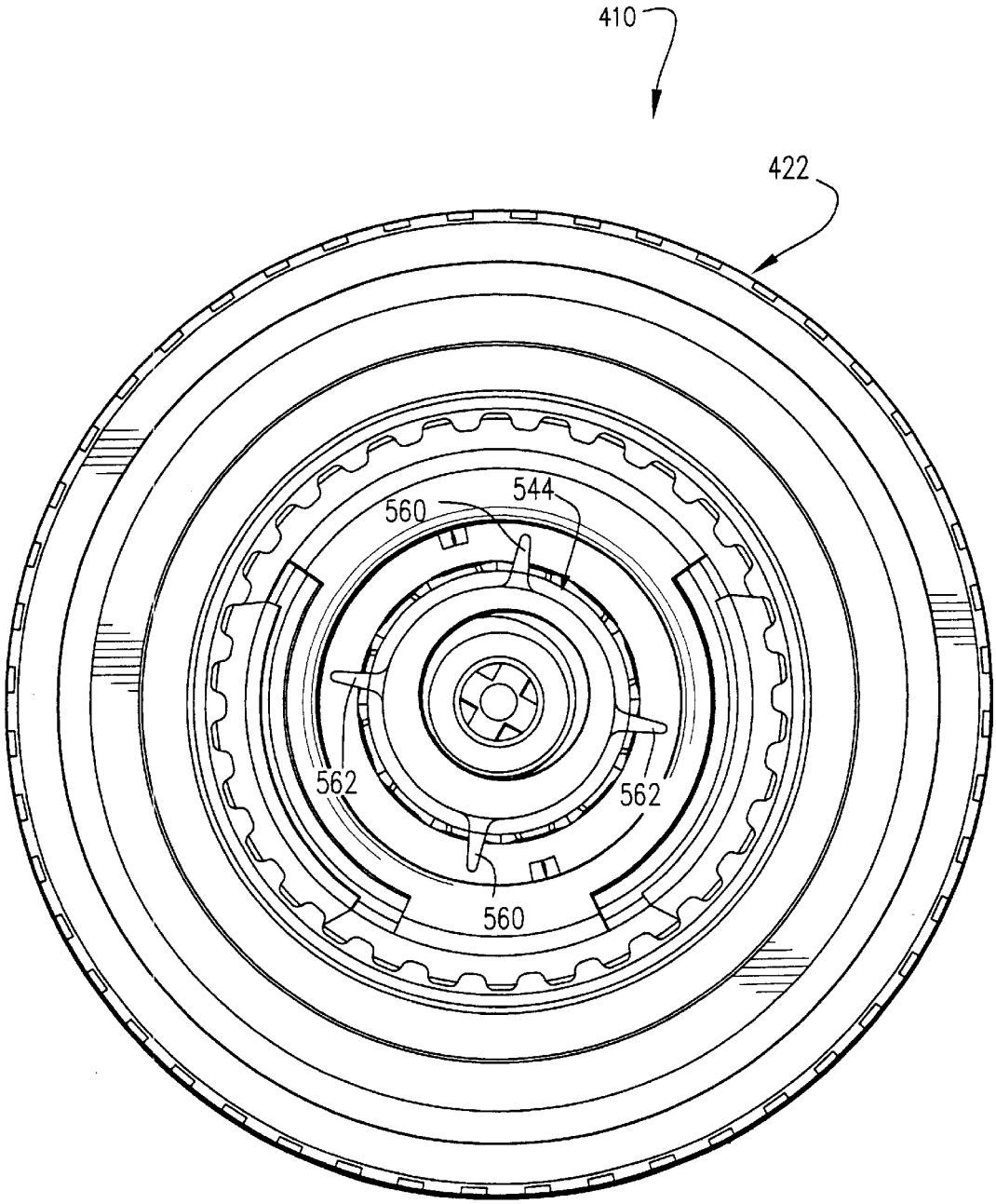
FIG. 43 is a plan view of the sprinkler head shown in FIG. 34, but with parts removed for clarity.
Figure 44:
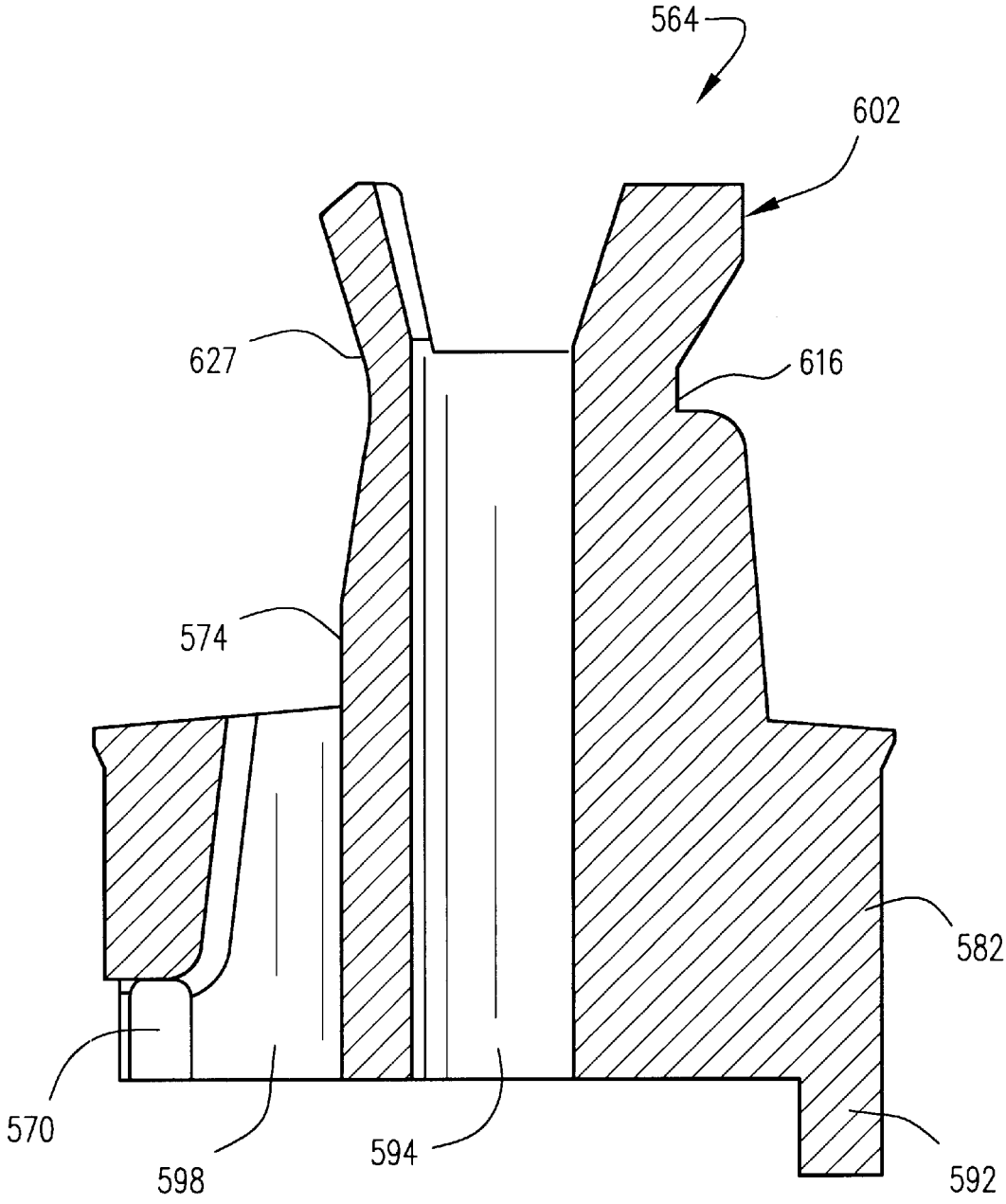
FIG. 44 is a cross section of a stream deflector component taken from FIG. 34.
Figure 45:
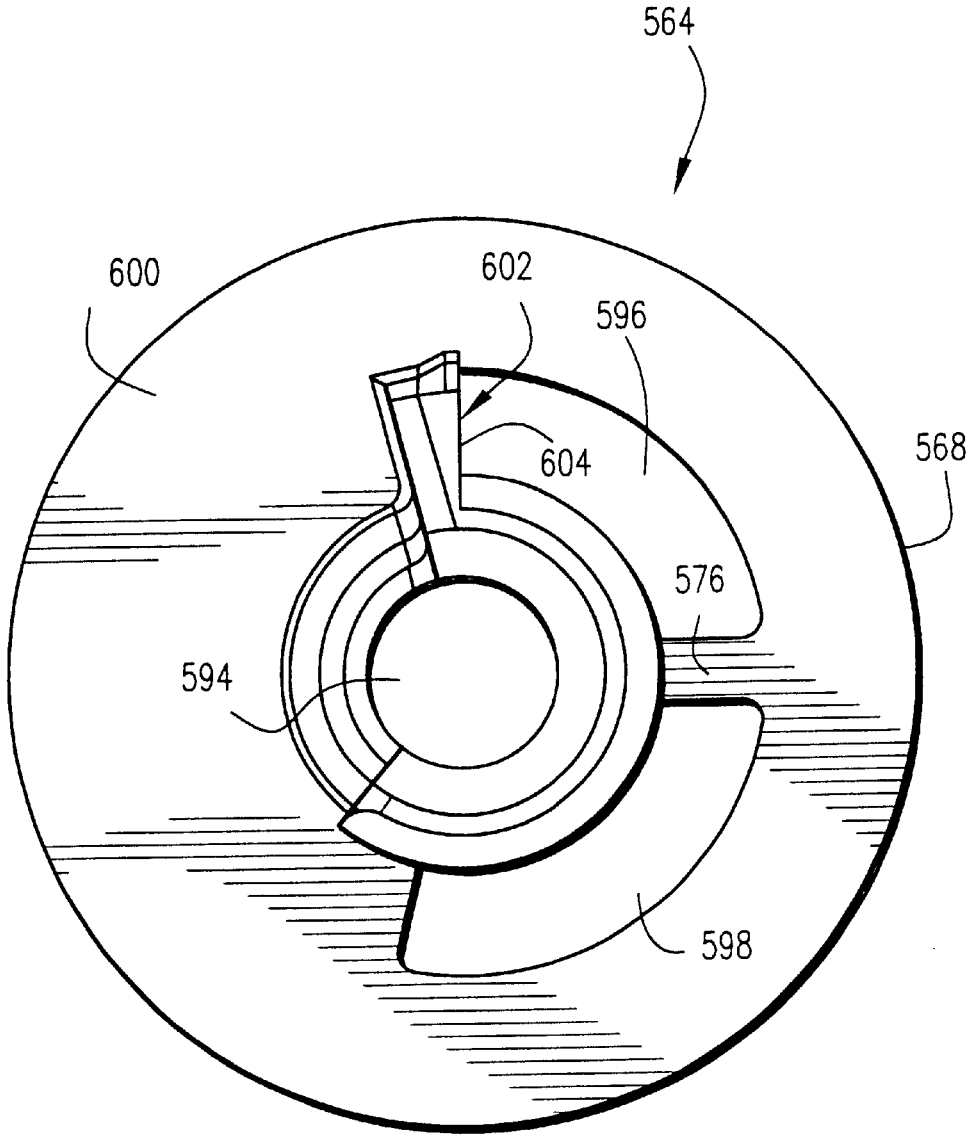
FIG. 45 is a top plan view of the stream deflector shown in FIG. 44.
Figure 46:
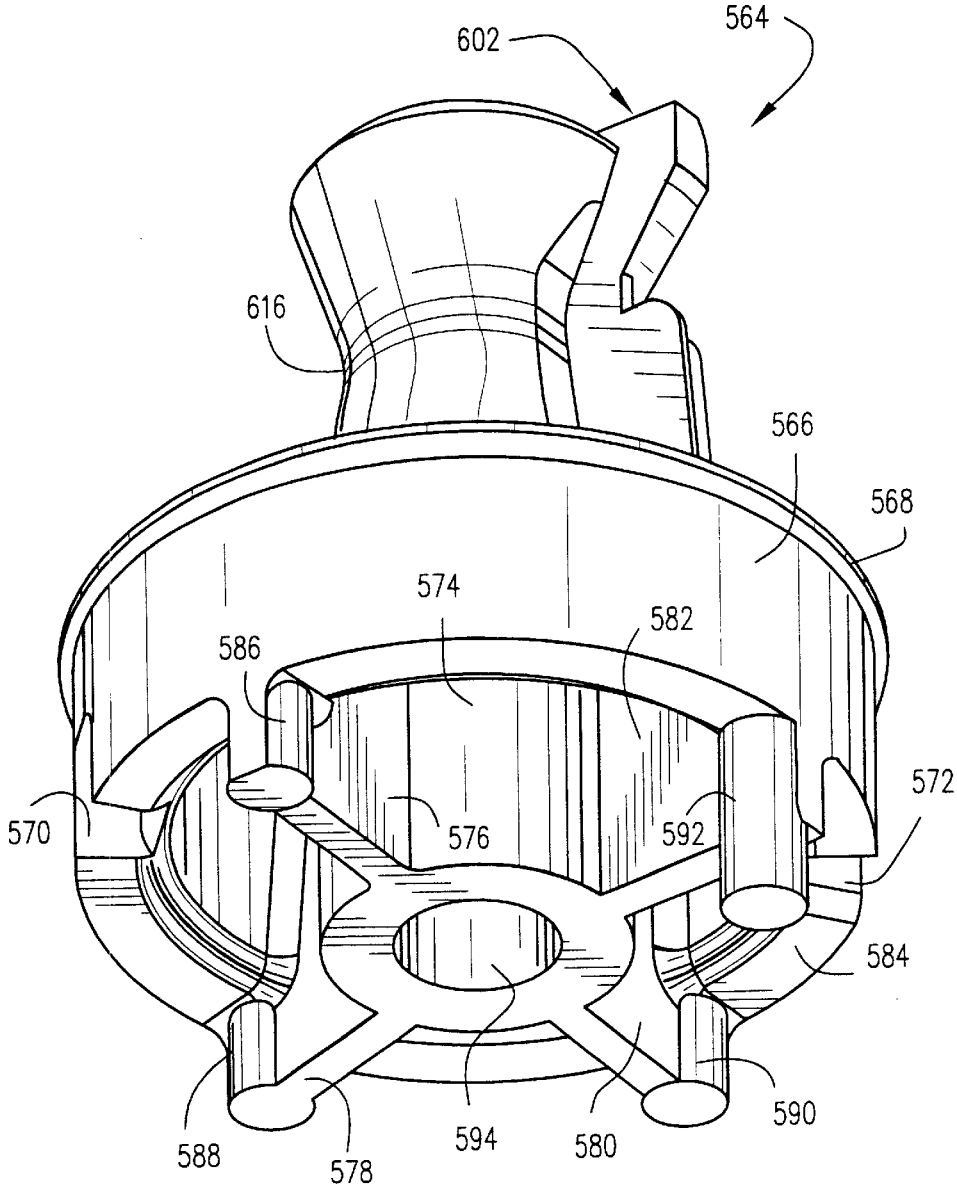
FIG. 46 is a perspective view of the stream deflector shown in FIG. 43.
Figure 47:
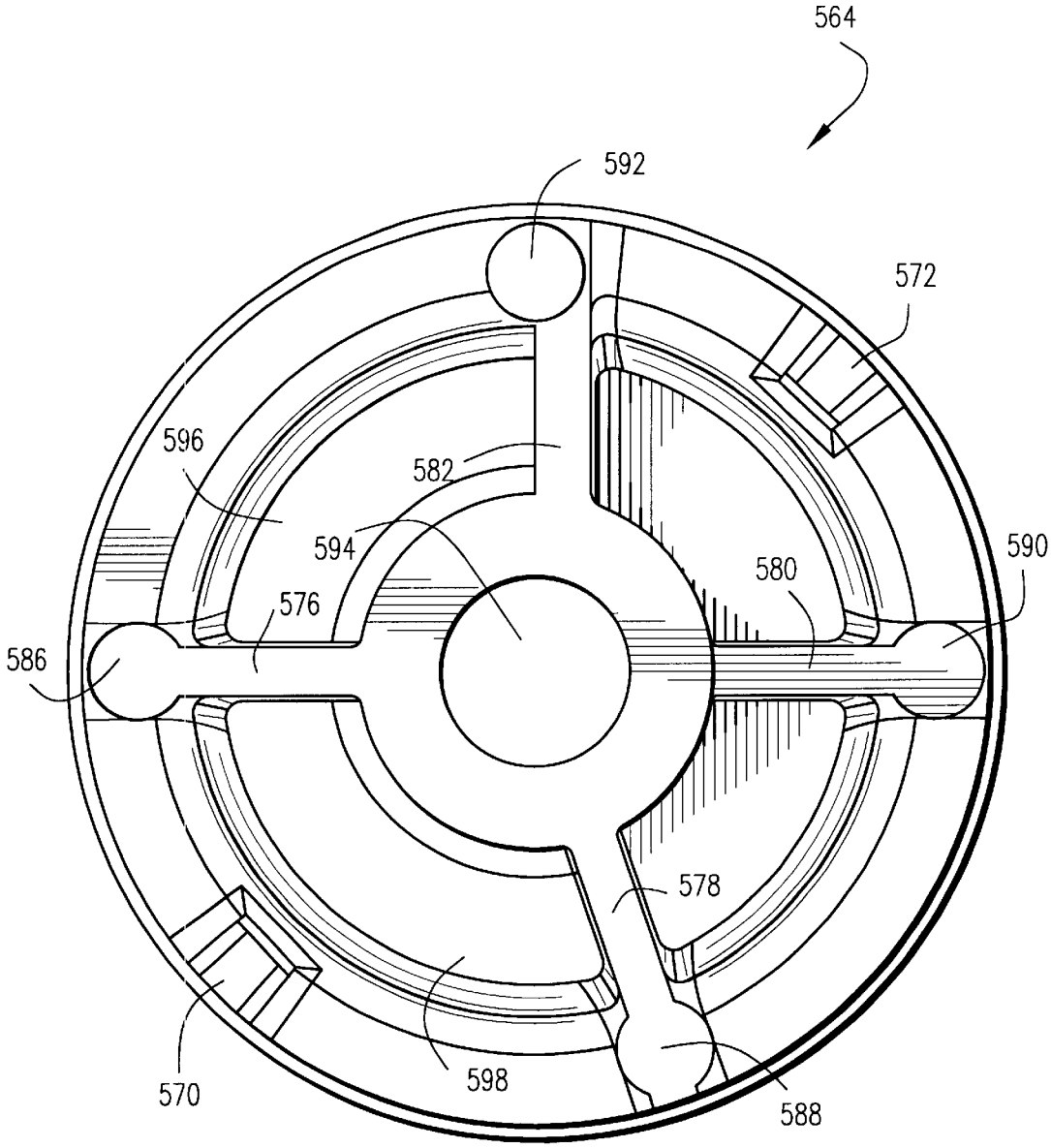
FIG. 47 is a bottom plan view of the stream deflector shown in FIG. 44.

The throttle control member 544, as best seen in FIG. 42, is formed with four, equally circmuferentially spaced ears (two diametrically opposed pairs 560, 562) that, during normal operation, are located between the ribs 528, 530 as best seen in FIG. 43. It will be appreciated that rotation of the shaft 420 will initially result in rotation of both the throttle sleeve 554 and the throttle control member 544 (in either direction), until the diametrically opposed ears 560 engage ribs 528, 530 to prevent further rotation of the throttle control member, causing it to move axially due to its threaded relationship with the sleeve 554. This assumes a normal application of torque via tool slot 558 to adjust the flow rate.

It will be appreciated, however, that if excess torque is applied after the throttle control member is seated on the teeth 540 of ring 534, the flexible ears 560 will permit the throttle control member 544 to rotate past the ribs 528, 530 until the other diametrically opposed pairs of ears 562 engage the ribs 528, 530. Should the application of excessive torque continue, this "slip clutch" arrangement will continue to work to prevent damage to the throttle components by permitting the throttle control member to rotate rather than move axially relative to the fixed internal components.

It will be understood that over-rotation in the throttle opening direction is handled in a similar manner, as permitted by the axial length of the ribs 528, 530.

Turning now to FIGS. 44–47, along with FIG. 34, the stream deflector 564 is received within the stem 414 and cooperates with the nozzle 426 to define an arcuate water discharge orifice (see in FIGS. 25 and 26) with an adjustable arcuate length. The stream deflector 564 also includes an annular ring or skirt portion 566 by which the deflector is secured within the stem 414. Specifically, an annular, radially outward flange 568 that seals against the interior surface 532 of the stem. A mating annular groove for receiving the flange may be provided along its axial length. The skirt portion 566 of the ring is formed with a pair of notches 570, 572 that open along the bottom edge of the skirt and are adapted to receive the upper ends of the ribs 528, 530 on the interior surface 532 of the stem. This arrangement fixes the stream deflector 564 against rotation.

A center hub 574 lies at the center of the stream deflector 564 and is connected to the skirt portion 566 by a plurality of radial spokes 576, 578, 580 and 582, all of which extend below the bottom edge 584 of the skirt portion 566. Each spoke terminates at its radially outward end in a respective cylindrical stub (586, 588, 590, 592) that lies on the bottom edge 584 of the skirt portion.

Stubs 586, 588 and 590 are flush with the bottom surfaces of the respective spokes 576, 578 and 580, while stub 592 extends beyond the bottom surface of spoke 582, serving as a further locator device during automated assembly. A bore 594 extends through the stream deflector and receives the shaft 420 as in the previously described embodiment.

The stream deflector 564 is designed for use with a nozzle (426) that produces an arcuate orifice that extends to a maximum of 210°, with adjustment within the range of 90°–210°. To this end, arcuate openings 596, 598 are formed in the surface 600, on either side of the spoke 576. Note that spoke 582 extends upwardly beyond the skirt portion, forming the upstanding tab 602, with surface 604 forming the "fixed" edge of the nozzle discharge orifice (similar to surface 204).

FIGS. 48–51 illustrate in greater detail the nozzle 426 that is supported on the stream deflector (within the stem 414) for rotation relative to the stream deflector 564. The nozzle 426 is a generally cylindrical member with a centered, axial opening that the deflector 564 and the shaft 420 pass through, with an arcuate surface 606 engaged by the hub 574 of the deflector. The nozzle 426 has an inlet end 608 and an outlet formed by an arcuate edge 610 with a rounded undercut 612 below the edge and a radially outwardly tapering surface 614 above the edge. Arcuate edge 610 is spaced radially outwardly of deflector surface 616 to thereby define the width of the arcuate discharge orifice. Circumferentially, the edge 610 extends approximately 250° from a first vertical surface 618 of an upstanding tab 620, to an edge 622 of a radial opening or notch 624. Vertical surface 618 thus comprises the "adjustable edge" of the nozzle orifice. Surfaces 604 and 618 may also be referred to as defining "limit positions." Note that the tab 620 is provided with a flexible ridge 626 that seals against the hourglass-shaped portion 627 of the deflector 564 that extends in either direction from surface 616. The manner in which the nozzle 426 interacts with the stream deflector 564 remains as described above in connection with the embodiment illustrated in FIGS. 2 and 3. The nozzle 426 is also formed with a flat that cuts across a portion of the teeth 496, and is used to facilitate auto-assembly with the stem 414. The nozzle shown as FIGS. 48–51 is designed to cooperate with the deflector 564 to provide a nozzle orifice with a maximum arcuate extent of 210°, and adjustable within 90°–210°. In other words, the arcuate extent of the orifice may vary between a minimum of 90° and a maximum of 210°.

Also as described above, when the nozzle 426 is in place, and with the rotor plate 418, stem 414 and deflector 564 extended relative to the base 412, a gear drive (or gear train) is established between the arc adjustment ring 422 and the nozzle 426 by reason of the engagement of teeth 480 on ring 422 with teeth 484 on the drive ring 482, and teeth 494 on the ring 482 with teeth 496 on the nozzle. Thus, rotation of the arc adjustment ring 422 will rotate the nozzle 426, relative to the deflector 564 to alter the arcuate length of the water discharge orifice between 90° and 210°, as described for the embodiment illustrated in FIGS. 2–26.

The present invention allows the internal stream deflector 564 and its integral fixed edge 604 to be rotated to re-orient one edge of the pattern by simply turning the arc adjustment ring 422 beyond its normal range. In other words, the ring 422 may be rotated to its most restricted position (with a 90° opening). Then, through the application of additional torque on the ring 422, the drive ring 482, stem 414, stream deflector 564 and nozzle 426 (along with other of the internal components) will rotate together until the fixed edge 604 is in the desired position. The ring 422 can then be rotated in an opposite direction to achieve the desired arc of coverage between 90° and 210°. Conversely, the arc adjustment ring 422 may be rotated to the fully open position (210°), and then rotated beyond that position through the application of additional torque to reorient the fixed edge 604. The arc adjustment ring 422 may then be rotated in the opposite direction to shorten the arc to any position between 90°–210°. As mentioned above, this "click adjust" feature is also useful with specialized, non-adjustable nozzles. For example, if a fixed rectangular pattern nozzle is employed, it is still necessary to locate an edge of the nozzle orifice where the pattern is to begin, and the above described "click adjust" feature permits this reorientation of the nozzle orifice. In addition, this feature helps to prevent damage to internal components whenever the arc adjustment ring is overtorqued.

The deflector 564 and nozzle 426 shown in FIGS. 34–51 achieve adjustability through 90–210°. For a head adjustable between 210° and 270°, it will be appreciated that the deflector and nozzle require appropriate modification to provide a larger discharge orifice, i.e., one capable of having a maximum arcuate extent of 270°.

Figure 52:
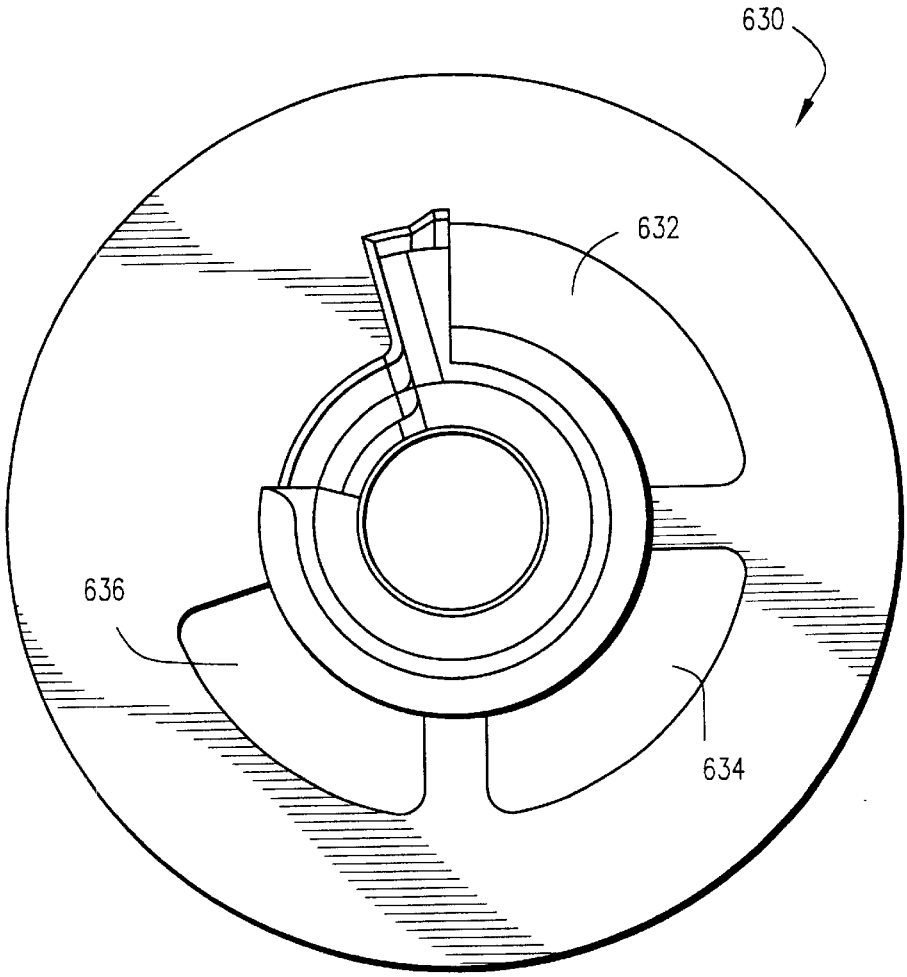
FIG. 52 is a top plan view of a modified stream deflector.
Figure 53:
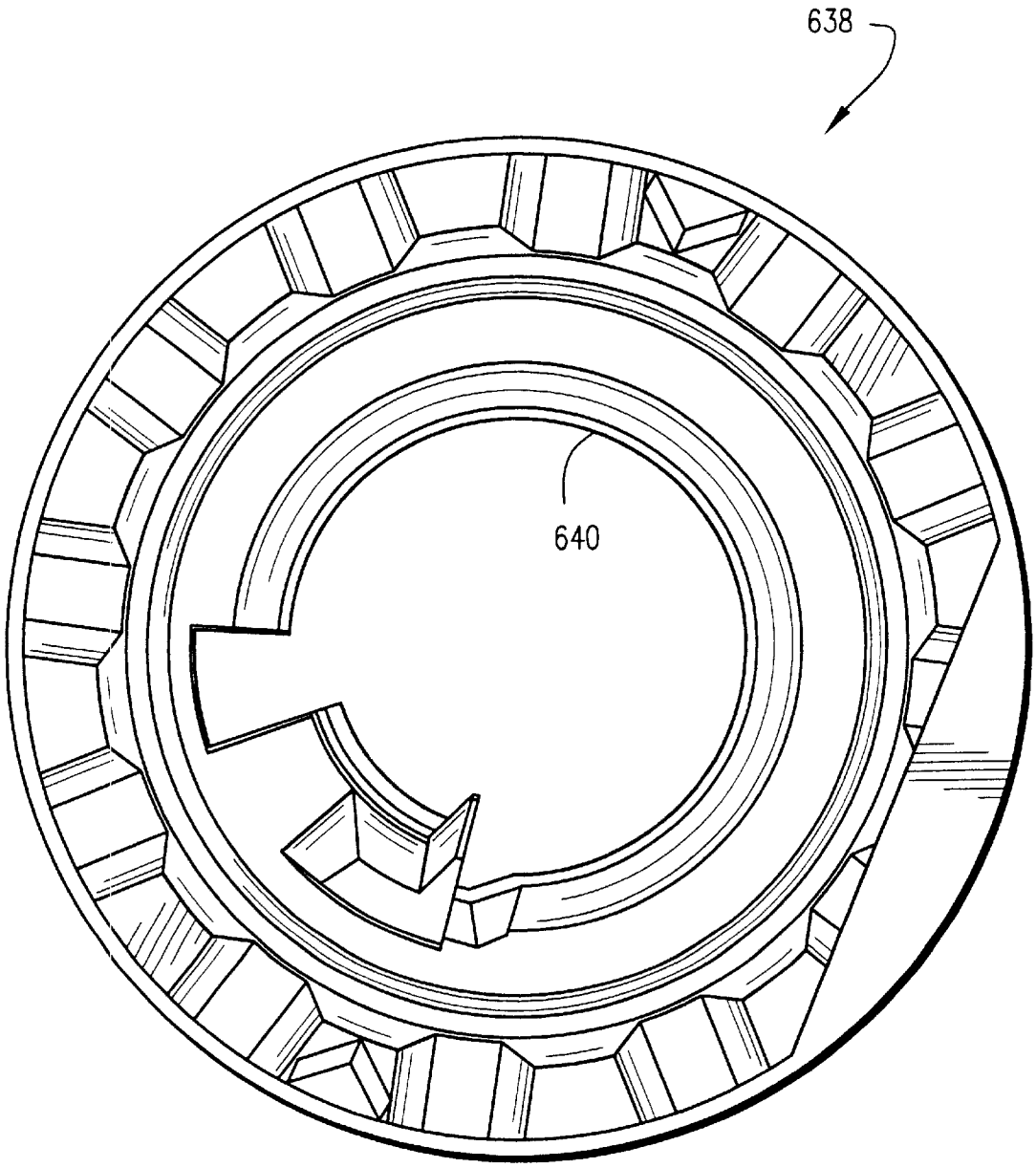
FIG. 53 is a top plan view of a modified nozzle for use with the stream deflector shown in FIG. 52.

FIG. 52 illustrates a modified stream deflector 630 that is provided with three openings 632, 634 and 636 that increases the flow of water to the nozzle orifice, in proportion to the maximum arcuate extent of the discharge orifice. FIG. 53 illustrates a correspondingly modified nozzle 638, where the orifice edge 640 now extends approximately 270°. Otherwise, the interaction between the stream deflector and nozzle remains as previously described.

Figure 54:
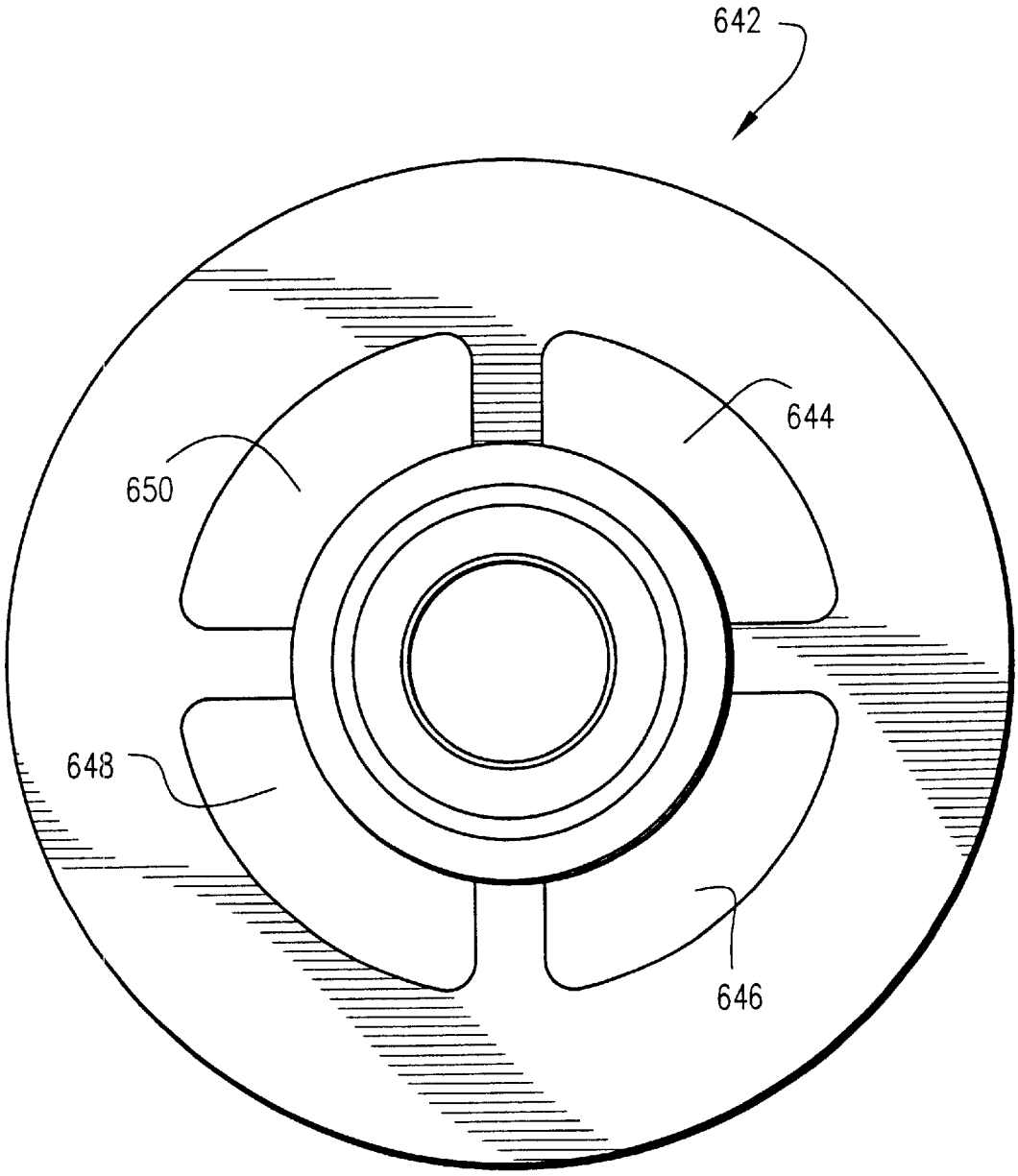
FIG. 54 is a top plan view of yet another modified stream deflector.
Figure 55:
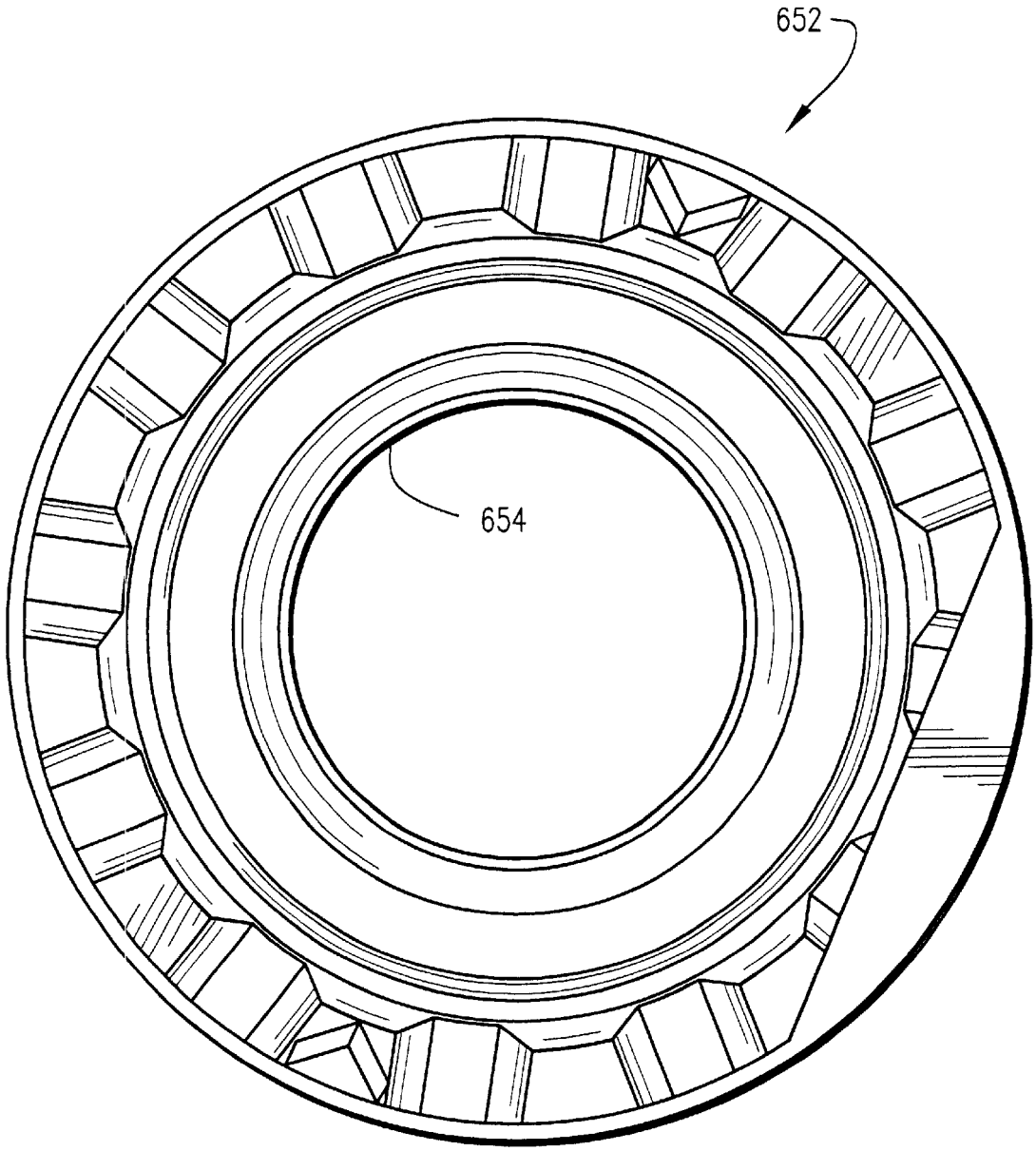
FIG. 55 is a top plan view of a nozzle modified for use with the stream deflector shown in FIG. 54.

FIG. 54 illustrates a stream deflector 642 that is designed for full 3600 flow through the nozzle, with four equally sized openings 644, 646, 648 and 650. Note that in this instance, there is no need for an upstanding projection with a fixed orifice edge as shown at 602 in FIGS. 44–46. FIG. 55 illustrates a correspondingly modified nozzle 652 with a 360° nozzle orifice edge 654. With this arrangement, no arc adjustment is possible, but flow rate adjustment is available as described above. On the other hand, rotation of the arc adjustment ring 422 will rotate the nozzle 426 relative to the deflector 564 and thus free the nozzle orifice of any accumulated dirt or sand particles. In the event the arc adjustment ring is over-torqued, the "click adjust" feature will prevent damage to internal components of the sprinkler.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler head comprising a base adapted to be secured to a component supplying water under pressure; an arc adjustment ring rotatably mounted on said base; a nozzle and a stream deflector supported by an elongated stem carried by said base, said nozzle and said stream deflector cooperating to define an adjustable nozzle orifice; a water distribution plate secured to a shaft in said stem and located downstream of said nozzle; said stem and said nozzle axially movable relative to said base; a drive train operatively connected between said arc adjustment ring and said nozzle to rotate said nozzle relative to said stream deflector to thereby adjust said nozzle orifice between a pair of limit positions; said stem rotatable within said base upon over-rotation of said arc adjustment ring beyond either of said pair of limit positions.

2. The sprinkler head of claim 1 wherein said drive train is operable only when said stem and nozzle are in an extended position relative to said base.

3. The sprinkler head of claim 1 wherein said base has an interior surface provided with a plurality of axially extending, closely spaced ribs and said stem is formed at one end thereof with a radially extending flange engaged with said closely spaced ribs.

4. The sprinkler head of claim 3 wherein said radially extending flange is provided with a plurality of annularly spaced spring tabs, each tab having a radial projection adapted to engage said ribs, wherein said spring tabs serve to hold said stem against rotation upon the application to said arc adjustment ring of a normal range of torque sufficient to permit rotation of said arc ring and nozzle between said limit positions, but permit over-rotation of said stem and nozzle relative to said base upon the application to said arc adjustment ring of excessive torque.

5. A sprinkler head comprising a base adapted to be secured to a sprinkler component;

a nozzle and a stream deflector supported in a stem mounted in said base for axial extending and retraction relative to said base, said nozzle having a first movable edge and said stream deflector having a second normally fixed edge cooperating to establish an adjustable arcuate discharge orifice defining a sprinkling pattern;

a water distribution plate supported on a shaft extending upwardly from said base, and adapted to be impinged by a stream emitted from the nozzle;

an arc adjustment ring rotatably mounted on said base, said arc adjustment ring operatively connectable with said nozzle for rotating said nozzle and first movable edge relative to said stream deflector and second normally fixed edge for adjusting an angular extent of said arcuate discharge orifice; and means for adjusting said second normally fixed edge relative to said base and said sprinkler component to reorient said sprinkling pattern, said means implemented via said arc adjustment ring.

6. The sprinkler head of claim 5 and further comprising means for adjusting flow rate through said nozzle.

7. The sprinkler head of claim 5 wherein said deflector and said nozzle are shaped to provide an arcuate discharge orifice adjustable between about 90° and about 210°.

8. The sprinkler head of claim 5 wherein said deflector and said nozzle are shaped to provide an arcuate discharge orifice adjustable between about 210° and about 270°.

9. The sprinkler head of claim 5 wherein said shaft is normally stationary and said water distribution plate rotates relative to said shaft.

10. The sprinkler head of claim 9 wherein said water distribution plate is mounted for rotation about said shaft and formed with an interior chamber defined by upper and lower bearings through which said shaft extends, and an interior surface of the water distribution plate; a stator fixed to the shaft and located within the chamber; and wherein said chamber is at least partially filled with a viscous fluid.

11. The sprinkler head of claim 5 wherein said sprinkler component comprises a pop-up sprinkler assembly including a fixed housing and an extendable tube, said base secured to said extendable tube; and wherein said stem, nozzle, stream deflector, shaft and water distribution plate are movable axially relative to said base from an inoperative retracted position where said water distribution plate is seated on said arc adjustment ring, to an operative extended position where said water distribution plate is axially spaced from said base.

12. The sprinkler head of claim 11 including a first coil spring radially outward of a stream emitted from the nozzle, said first coil spring having one end engaging a downstream end of said stem and an opposite end engaging said arc adjustment ring.

13. The sprinkler head of claim 12 wherein said first coil spring biases said water distribution plate toward said inoperative retracted position.

14. The sprinkler head of claim 11 wherein said arc adjustment ring is operatively connectable with said nozzle only when said water distribution plate is in said operative extended position.

15. The sprinkler head of claim 11 wherein in use, said extendable tube extends out of said fixed housing before said water distribution plate moves to said operative extended position.

16. A sprinkler head comprising a base;

an elongated stem supported within the base;

a nozzle and a stream deflector supported within the stem, said nozzle and stream deflector cooperating to define an arcuate orifice;

a water distribution plate supported on a shaft extending upwardly from said base, said water distribution plate located in axially spaced relationship to said nozzle and adapted to be impinged by a stream emitted from the nozzle;

a throttle control member secured to an upstream end of said shaft such that rotation of said shaft causes said throttle control member to move relative to a flow restriction portion, to thereby adjust flow rate through said nozzle and a throw radius of the stream-emitted from said nozzle, said throttle control member engageable with a seat in a maximum restriction position; and said throttle control member having flexible tabs extending radially therefrom for interaction with axially extending ribs on an interior surface of said stem to thereby constrain said throttle control member against rotation when said shaft is rotated and to thereby move said throttle control member axially toward or away from said maximum restriction position; said flexible tabs permitting rotation of said throttle control member with said shaft upon over-rotation of said shaft.

17. The sprinkler head of claim 16 wherein said throttle control member and said flow restriction seat are configured to always permit a predetermined minimum flow of water through said nozzle.

18. The sprinkler head of claim 17 wherein said predetermined minimum flow is sufficient to maintain rotation of said water distribution plate.

19. The sprinkler head of claim 16 wherein a distal end of said shaft projects from said water distribution plate to thereby allow a user to rotate said shaft to adjust said flow rate.

20. The sprinkler head of claim 19 wherein said distal end of said shaft is formed with a groove adapted to receive a tool for rotating said shaft.

21. The sprinkler head of claim 16 wherein said water distribution plate is formed with an interior chamber defined by upper and lower bearings through which said shaft extends, and an interior surface of the water distribution plate; a stator fixed to the shaft and located within the chamber; and wherein said chamber is at least partially filled with a viscous fluid.

22. The sprinkler head of claim 16 wherein said sprinkler component comprises a pop-up sprinkler assembly including a fixed housing and an extendable tube, said base located on an upper end of said extendable tube; and wherein said stem, nozzle, stream deflector, shaft and water distribution plate are movable axially relative to said base from an inoperative retracted position where said water distribution plate is seated on said base, to an operative extended position where said water distribution plate is axially spaced from said base.

23. The sprinkler head of claim 22 including a first coil spring radially outward of a stream emitted from the nozzle, wherein said coil spring biases said water distribution plate toward the inoperative position.

24. The sprinkler head assembly of claim 23 and wherein in use, said extendable tube extends out of said fixed housing before said water distribution plate moves to said operative extended position.

25. The sprinkler head of claim 16 wherein said throttle member and said stem are provided with cooperating guide elements for preventing rotation of said throttle member.

26. A sprinkler head comprising a base;

a nozzle and a stream deflector supported within the base, said nozzle having a first moveable edge and deflector having a second normally fixed edge cooperating to define an adjustable arcuate discharge orifice;

a water distribution plate supported on a shaft extending upwardly from said stem, said water distribution plate having a plurality of water distribution grooves therein located in axially spaced relationship to said nozzle and adapted to be impinged by a stream emitted from the nozzle;

an arc adjustment ring rotatably mounted on said base, said arc adjustment ring operatively connectable with said nozzle for rotating said nozzle and first movable edge relative to said stem and second normally fixed edge for adjustment of said arcuate discharge orifice;

means operable through said arc adjustment ring for adjusting said second normally fixed edge to reorient said sprinkling pattern; and a throttle control member secured to an upstream end of said shaft such that rotation of said shaft causes said throttle to move axially relative to a flow restriction seat portion, to thereby adjust flow rate through said nozzle, said throttle control member engageable with said seat in a maximum restriction position; and means for permitting rotation of said throttle control member with said shaft upon over-rotation of said shaft.

27. A sprinkler head comprising a base adapted to be secured to a component supplying water under pressure; an anular ring rotatably mounted on said base so as to be accessible to a user; a nozzle and a stream deflector supported by an elongated stem carried by said base, said nozzle and said stream deflector cooperating to define a nozzle orifice; a water distribution plate secured to a shaft in said stem and located downstream of said nozzle; said stem and said nozzle axially movable relative to said base; a drive train operatively connected between said annular ring and said nozzle to rotate said nozzle relative to said stream deflector between a pair of limit positions; said stem rotatable within said base upon over-rotation of said annular ring beyond either of said pair of limit positions to thereby prevent damage to internal components of the sprinkler head.

* * * * *

UNITED STATES PATENT AND TRADEMARK OFFICE

CERTIFICATE OF CORRECTION

PATENT NO. : 6,736,332 B2
DATED : May 18, 2004
INVENTOR(S) : Sesser et al.

It is certified that error appears in the above-identified patent and that said Letters Patent is hereby corrected as shown below:

Column 23,
Line 2, delete “stem” and insert -- base --.

Signed and Sealed this

Twenty-second Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,736,332 B2
APPLICATION NO. : 10/119294
DATED : May 18, 2004
INVENTOR(S) : Sesser et al.

It is certified that error appears in the above-identified patent and that said Letters Patent is hereby corrected as shown below:

Column 7, line 54, delete “32” and insert --38--.

Column 9, line 31, insert --in combination with tubular portion 132 forms a groove that-- after “that”.

Column 9, line 32, delete “155” after “a seat”.

Column 9, line 40, delete “surfaces” and insert --surface--.

Column 11, line 11, insert --or wall-- after “The other end”.

Column 11, line 21, insert --end or -- after “beyond the”.

Column 11, line 21, delete “surface” after “wall”.

Signed and Sealed this

Nineteenth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 6,736,332 B2
APPLICATION NO. : 10/119294
DATED : May 18, 2004
INVENTOR(S) : Sesser et al.

It is certified that error appears in the above-identified patent and that said Letters Patent is hereby corrected as shown below:

On page 1; Column 2, at INID Code 56, under References Cited, U.S. Patent Documents, please add:

| | | |
|---|---|---|
| 3,131,867 | 5/1964 | Miller et al. |
| 3,884,416 | 5/1975 | King |
| 3,940,066 | 2/1976 | Hunter |
| 4,119,275 | 10/1978 | Hunter |
| 4,154,404 | 5/1979 | Clawson |
| 4,261,515 | 4/1981 | Rosenberg et al. |
| 4,579,285 | 4/1986 | Hunter |
| Re. 32,386 | 3/1987 | Hunter |
| 4,796,809 | 1/1989 | Hunter |
| 4,815,662 | 3/1989 | Hunter |
| 4,842,201 | 6/1989 | Hunter |
| 4,850,532 | 7/1989 | Mackanos |
| 4,867,379 | 9/1989 | Hunter |
| 4,898,332 | 2/1990 | Hunter et al. |
| 4,932,590 | 6/1990 | Hunter |
| 4,944,456 | 7/1990 | Zakai |
| 4,967,961 | 11/1990 | Hunter |
| 4,971,250 | 11/1990 | Hunter |
| 4,986,474 | 1/1991 | Schisler et al. |
| 5,031,840 | 7/1991 | Grundy et al. |
| 5,058,806 | 10/1991 | Rupar |
| Re. 33, 823 | 2/1992 | Nelson et al. |
| 5,148,990 | 9/1992 | Kah, Jr. |
| 5,226,602 | 7/1993 | Cochran et al. |
| 5,228,023 | 2/1994 | Han et al. |
| 5,360,167 | 11/1994 | Grundy et al. |
| 5,556,036 | 9/1996 | Chase |
| 5,647,541 | 7/1997 | Nelson |
| 5,762,270 | 6/1998 | Kearby et al. |
| 5,823,440 | 10/1998 | Clark |

UNITED STATES PATENT AND TRADEMARK OFFICE

CERTIFICATE OF CORRECTION

PATENT NO. : 6,736,332 B2
APPLICATION NO. : 10/119294
DATED : May 18, 2004
INVENTOR(S) : Sesser et al.

It is certified that error appears in the above-identified patent and that said Letters Patent is hereby corrected as shown below:

On page 1; Column 2, at INID Code 56, under References Cited, U.S. Patent Documents, please add: (cont'd)

| | | |
|---|---|---|
| 5,927,607 | 7/1999 | Scott |

Signed and Sealed this

Tenth Day of July, 2007

JON W. DUDAS
*Director of the United States Patent and Trademark Office*